US009232864B2

(12) United States Patent
Hardy et al.

(10) Patent No.: US 9,232,864 B2
(45) Date of Patent: Jan. 12, 2016

(54) PRODUCT MANAGEMENT DISPLAY SYSTEM WITH TRACKLESS PUSHER MECHANISM

(71) Applicant: RTC Industries, Inc., Rolling Meadows, IL (US)

(72) Inventors: Stephen N. Hardy, Wadsworth, OH (US); John Pirone, Palatine, IL (US)

(73) Assignee: RTC Industries, Incorporated, Rolling Meadows, IL (US)

( * ) Notice: Subject to any disclaimer, the term of this patent is extended or adjusted under 35 U.S.C. 154(b) by 0 days.

(21) Appl. No.: 14/579,604

(22) Filed: Dec. 22, 2014

(65) Prior Publication Data

US 2015/0108075 A1 Apr. 23, 2015

Related U.S. Application Data

(63) Continuation-in-part of application No. 14/012,715, filed on Aug. 28, 2013, now Pat. No. 8,978,903, which (Continued)

(51) Int. Cl.
*A47B 73/00* (2006.01)
*A47G 29/087* (2006.01)
(Continued)

(52) U.S. Cl.
CPC ..... *A47F 1/126* (2013.01); *A47B 73/006* (2013.01); *A47B 87/0223* (2013.01);
(Continued)

(58) Field of Classification Search
CPC ..... F25D 25/02; F25D 25/027; B65G 1/07; B65G 1/08; B65G 1/10; B65G 1/06; B65G 83/00; G06F 11/06; A47B 57/58; A47B 57/583; A47B 57/585; A47B 57/586; A47B 57/588; A47B 87/0223; A47B 87/0269; A47B 73/006; E05B 69/006; E05B 73/00; E05B 3/00; A47F 1/126; A47F 1/125; A47F 1/04; A47F 7/17; A47F 1/06; A47F 1/08; A47F 1/12; A47F 3/02; A47F 1/10; A47F 1/03; A47F 5/005; A47F 3/14; A47F 7/28; A47F 5/0068; A47F 5/16; A47F 5/0018; A47F 5/0025; A47F 5/0043; A47F 7/024; A47F 7/0246; A47F 7/281; Y10T 29/49863; B42F 7/12
USPC ..... 211/59.3, 59.2, 119.003, 184, 211/90.01–90.04, 150, 175, 51, 126.1, 162, 211/126.3; 108/6, 60, 61, 71; 312/126, 35, 312/61, 71, 128, 131, 132, 137; 221/227, 221/255, 279, 75, 76, 90, 242, 226, 229, 221/231, 232
See application file for complete search history.

(56) References Cited

U.S. PATENT DOCUMENTS
153,227 A 7/1874 Walker
(Continued)

FOREIGN PATENT DOCUMENTS
BE 906083 A2 4/1987
(Continued)

OTHER PUBLICATIONS
Jan. 6, 2015—(JP) Office Action—App 2014-528646.
(Continued)

*Primary Examiner* — Jennifer E Novosad
(74) *Attorney, Agent, or Firm* — Banner & Witcoff, Ltd.

(57) ABSTRACT

A product management display system for merchandising product on a shelf or tray includes using a trackless pusher mechanism that travels along a surface on which product is placed. In one example, the tray or shelf can include a first product retaining member which prevents products from being pushed off of the tray. The pusher mechanism of an exemplary embodiment includes a pusher surface, a second product retaining member, and a pusher floor that extends forward of the pusher surface and between the pusher surface and the second product retaining member. A flat coiled spring or other biasing element may be operatively connected behind the pusher mechanism. In use, the product to be merchandised may be placed on the pusher floor. With this configuration, the pusher surface is prevented from pushing the last product off of the shelf and onto the floor.

17 Claims, 33 Drawing Sheets

Related U.S. Application Data is a continuation of application No. 13/542,419, filed on Jul. 5, 2012, now Pat. No. 8,739,984, which is a continuation-in-part of application No. 12/639,656, filed on Dec. 16, 2009, now Pat. No. 8,322,544, which is a continuation-in-part of application No. 12/357,860, filed on Jan. 22, 2009, now Pat. No. 8,453,850, which is a continuation-in-part of application No. 11/760,196, filed on Jun. 8, 2007, now Pat. No. 8,312,999, which is a continuation-in-part of application No. 11/411,761, filed on Apr. 25, 2006, now Pat. No. 7,823,734.

(60) Provisional application No. 61/553,545, filed on Oct. 31, 2011, provisional application No. 61/542,473, filed on Oct. 3, 2011, provisional application No. 61/530,736, filed on Sep. 2, 2011, provisional application No. 60/734,692, filed on Nov. 8, 2005, provisional application No. 60/716,362, filed on Sep. 12, 2005.

(51) Int. Cl.

| | |
|---|---|
| ***A47F 5/00*** | (2006.01) |
| ***A47F 1/04*** | (2006.01) |
| ***A47F 7/00*** | (2006.01) |
| ***A47F 1/12*** | (2006.01) |
| ***A47F 3/02*** | (2006.01) |
| ***A47F 3/14*** | (2006.01) |
| ***A47F 7/28*** | (2006.01) |
| ***A47B 87/02*** | (2006.01) |
| *A47B 57/58* | (2006.01) |
| *B42F 7/12* | (2006.01) |

(52) U.S. Cl.

CPC ..... *A47B 87/0269* (2013.01); *A47F 1/04* (2013.01); *A47F 1/12* (2013.01); *A47F 1/125* (2013.01); *A47F 3/02* (2013.01); *A47F 3/14* (2013.01); *A47F 5/005* (2013.01); *A47F 5/0068* (2013.01); *A47F 7/281* (2013.01); *A47B 57/585* (2013.01); *B42F 7/12* (2013.01); *Y10T 29/49863* (2015.01)

(56) References Cited

U.S. PATENT DOCUMENTS

| | | | |
|---|---|---|---|
| 154,940 | A | 9/1874 | Adams |
| 355,511 | A | 1/1887 | Danner |
| 431,373 | A | 7/1890 | Mendenhall |
| 436,704 | A | 9/1890 | Green |
| 452,673 | A | 5/1891 | Hunter |
| 551,642 | A | 12/1895 | Kleine |
| 607,890 | A | 7/1898 | Smith |
| 607,891 | A | 7/1898 | Smith |
| 632,231 | A | 9/1899 | Blades |
| 808,067 | A | 12/1905 | Briggs |
| 847,863 | A | 3/1907 | Watts |
| 927,988 | A | 7/1909 | Massey |
| 1,030,317 | A | 6/1912 | Middaugh |
| 1,156,140 | A | 10/1915 | Hair |
| 1,271,508 | A | 7/1918 | Hall |
| 1,282,532 | A | 10/1918 | Bochenek |
| 1,674,582 | A | 6/1928 | Wheeler |
| 1,682,580 | A | 8/1928 | Pratt |
| 1,703,987 | A | 3/1929 | Butler |
| 1,712,080 | A | 5/1929 | Kelly |
| 1,714,266 | A | 5/1929 | Johnson |
| 1,734,031 | A | 11/1929 | Carlston |
| 1,786,392 | A | 12/1930 | Kemp |
| 1,849,024 | A | 3/1932 | McKee |
| 1,910,516 | A | 5/1933 | Basenberg |
| 1,964,597 | A | 6/1934 | Rapellin |
| 1,971,749 | A | 8/1934 | Hamilton |
| 1,991,102 | A | 2/1935 | Kernaghan |
| 2,013,284 | A | 9/1935 | Michaud |
| 2,057,627 | A | 10/1936 | Ferris |
| 2,076,941 | A | 4/1937 | Farr |
| 2,079,754 | A | 5/1937 | Waxgiser |
| 2,085,479 | A | 6/1937 | Shaffer et al. |
| 2,110,299 | A | 3/1938 | Hinkle |
| 2,111,496 | A | 3/1938 | Scriba |
| 2,129,122 | A | 9/1938 | Follett |
| 2,185,605 | A | 1/1940 | Murphy |
| 2,218,444 | A | 10/1940 | Vineyard |
| 2,284,849 | A | 6/1942 | Schreyer |
| 2,308,851 | A | 1/1943 | Anderson |
| 2,499,088 | A | 2/1950 | Brill |
| 2,563,570 | A | 2/1950 | Williams |
| 2,516,122 | A | 7/1950 | Hughes |
| 2,538,165 | A | 1/1951 | Randtke |
| 2,538,908 | A | 1/1951 | McKeehan |
| 2,555,102 | A | 5/1951 | Anderson |
| 2,652,154 | A | 9/1953 | Stevens |
| 2,670,853 | A | 3/1954 | Schneider |
| 2,678,045 | A | 5/1954 | Erhard |
| 2,730,825 | A | 1/1956 | Wilds |
| 2,732,952 | A | 1/1956 | Skelton |
| 2,738,881 | A | 3/1956 | Michel |
| 2,750,049 | A | 6/1956 | Hunter |
| 2,767,042 | A | 10/1956 | Kesling |
| 2,775,365 | A | 12/1956 | Mestman |
| 2,828,178 | A | 3/1958 | Dahlgren |
| 2,893,596 | A | 7/1959 | Gabrielsen |
| 2,918,295 | A | 12/1959 | Milner |
| 2,934,212 | A | 4/1960 | Jacobson |
| 2,948,403 | A | 8/1960 | Vallez |
| 2,964,154 | A | 12/1960 | Erickson |
| 3,083,067 | A | 3/1963 | Vos et al. |
| 3,103,396 | A | 9/1963 | Portnoy |
| 3,110,402 | A | 11/1963 | Mogulescu |
| 3,121,494 | A | 2/1964 | Berk |
| 3,124,254 | A | 3/1964 | Davidson |
| 3,151,576 | A | 10/1964 | Patterson |
| 3,161,295 | A | 12/1964 | Chesley |
| 3,166,195 | A | 1/1965 | Taber |
| 3,285,429 | A | 11/1966 | Propst |
| 3,308,961 | A | 3/1967 | Chesley |
| 3,308,964 | A | 3/1967 | Pistone |
| 3,331,337 | A | 7/1967 | MacKay |
| 3,348,732 | A | 10/1967 | Shwarz |
| 3,405,716 | A | 10/1968 | Cafiero |
| 3,452,899 | A | 7/1969 | Libberton |
| 3,497,081 | A | 2/1970 | Field |
| 3,501,016 | A | 3/1970 | Kenneth |
| 3,501,019 | A | 3/1970 | Armstron |
| 3,501,020 | A | 3/1970 | Krikorian |
| 3,512,652 | A | 5/1970 | Armstrong |
| D219,058 | S | 10/1970 | Kaczur |
| 3,550,979 | A | 12/1970 | Protzmann |
| 3,598,246 | A | 8/1971 | Galli |
| 3,625,371 | A | 12/1971 | Dill |
| 3,652,154 | A | 3/1972 | Gebel |
| 3,667,826 | A | 6/1972 | Wood |
| 3,698,568 | A | 10/1972 | Armstrong |
| 3,709,371 | A | 1/1973 | Luck |
| 3,751,129 | A | 8/1973 | Wright et al. |
| 3,767,083 | A | 10/1973 | Webb |
| 3,776,388 | A | 12/1973 | Mattheis |
| 3,780,876 | A | 12/1973 | Elkins |
| 3,814,490 | A | 6/1974 | Dean et al. |
| 3,815,519 | A | 6/1974 | Meyer |
| 3,830,169 | A | 8/1974 | Madey |
| 3,836,008 | A | 9/1974 | Mraz |
| 3,848,745 | A | 11/1974 | Smith |
| 3,868,021 | A | 2/1975 | Heinrich |
| 3,870,156 | A | 3/1975 | O'Neill |
| 3,893,739 | A | 7/1975 | Bernard |
| 3,949,880 | A | 4/1976 | Fortunato |
| 3,960,273 | A | 6/1976 | Weston |
| 4,007,841 | A | 2/1977 | Seipel |
| 4,015,886 | A | 4/1977 | Wickenberg |
| 4,042,096 | A | 8/1977 | Smith |

(56) References Cited

U.S. PATENT DOCUMENTS

| | | | |
|---|---|---|---|
| 4,106,668 | A | 8/1978 | Gebhardt et al. |
| 4,205,763 | A | 6/1980 | Merl |
| 4,269,326 | A | 5/1981 | Delbrouck |
| 4,300,693 | A | 11/1981 | Spamer |
| 4,303,162 | A | 12/1981 | Suttles |
| 4,331,243 | A | 5/1982 | Doll |
| 4,351,439 | A | 9/1982 | Taylor |
| 4,378,872 | A | 4/1983 | Brown |
| 4,397,606 | A | 8/1983 | Bruton |
| 4,416,380 | A | 11/1983 | Flum |
| 4,437,572 | A | 3/1984 | Hoffman |
| 4,448,653 | A | 5/1984 | Wegmann |
| 4,454,948 | A | 6/1984 | Spamer |
| 4,454,949 | A | 6/1984 | Flum |
| 4,460,096 | A | 7/1984 | Ricci |
| D275,058 | S | 8/1984 | Flum |
| 4,463,854 | A | 8/1984 | MacKenzie |
| 4,467,927 | A | 8/1984 | Nathan |
| 4,470,943 | A | 9/1984 | Preis |
| 4,476,985 | A | 10/1984 | Norberg et al. |
| 4,478,337 | A | 10/1984 | Flum |
| 4,482,066 | A | 11/1984 | Dykstra |
| 4,488,653 | A | 12/1984 | Belokin |
| 4,500,147 | A | 2/1985 | Reister |
| 4,504,100 | A | 3/1985 | Chaumard |
| 4,550,838 | A | 11/1985 | Nathan et al. |
| 4,588,093 | A | 5/1986 | Field |
| 4,589,349 | A | 5/1986 | Gebhardt et al. |
| 4,590,696 | A | 5/1986 | Squitieri |
| 4,593,823 | A | 6/1986 | Fershko et al. |
| 4,602,560 | A | 7/1986 | Jacky |
| 4,606,280 | A | 8/1986 | Poulton et al. |
| 4,610,491 | A | 9/1986 | Freeman |
| 4,615,276 | A | 10/1986 | Garabedian |
| 4,620,489 | A | 11/1986 | Albano |
| 4,629,072 | A | 12/1986 | Loew |
| 4,651,883 | A | 3/1987 | Gullett et al. |
| 4,685,574 | A | 8/1987 | Young et al. |
| 4,705,175 | A | 11/1987 | Howard et al. |
| 4,706,821 | A | 11/1987 | Kohls et al. |
| 4,712,694 | A | 12/1987 | Breslow |
| 4,724,968 | A | 2/1988 | Wombacher |
| 4,729,481 | A | 3/1988 | Hawkinson et al. |
| 4,730,741 | A | 3/1988 | Jackle, III et al. |
| 4,742,936 | A | 5/1988 | Rein |
| 4,762,235 | A | 8/1988 | Howard et al. |
| 4,768,661 | A | 9/1988 | Pfeifer |
| 4,771,898 | A | 9/1988 | Howard et al. |
| 4,775,058 | A | 10/1988 | Yatsko |
| 4,776,472 | A | 10/1988 | Rosen |
| 4,790,037 | A | 12/1988 | Phillips |
| 4,801,025 | A | 1/1989 | Flum et al. |
| 4,809,855 | A | 3/1989 | Bustos |
| 4,828,144 | A | 5/1989 | Garrick |
| 4,830,201 | A | 5/1989 | Breslow |
| 4,836,390 | A | 6/1989 | Polvere |
| 4,846,367 | A | 7/1989 | Guigan et al. |
| 4,883,169 | A | 11/1989 | Flanagan, Jr. |
| 4,887,724 | A | 12/1989 | Pielechowski et al. |
| 4,887,737 | A | 12/1989 | Adenau |
| 4,896,779 | A | 1/1990 | Jureckson |
| 4,899,668 | A | 2/1990 | Valiulis |
| 4,899,893 | A | 2/1990 | Robertson |
| 4,901,853 | A | 2/1990 | Maryatt |
| 4,901,869 | A | 2/1990 | Hawkinson et al. |
| 4,901,872 | A | 2/1990 | Lang |
| 4,907,707 | A | 3/1990 | Crum |
| 4,923,070 | A | 5/1990 | Jackle et al. |
| 4,934,645 | A | 6/1990 | Breslow |
| 4,944,924 | A | 7/1990 | Mawhirt et al. |
| 4,958,739 | A | 9/1990 | Spamer |
| RE33,515 | E | 1/1991 | Fershko et al. |
| 4,981,224 | A | 1/1991 | Rushing |
| 4,997,094 | A | 3/1991 | Spamer et al. |
| 5,012,936 | A | 5/1991 | Crum |
| 5,025,936 | A | 6/1991 | Lamoureaux |
| 5,027,957 | A | 7/1991 | Skalski |
| 5,054,629 | A | 10/1991 | Breen |
| 5,082,125 | A | 1/1992 | Ninni |
| 5,088,607 | A | 2/1992 | Risafi et al. |
| 5,110,192 | A | 5/1992 | Lauterbach |
| 5,111,942 | A | 5/1992 | Bernardin |
| 5,123,546 | A | 6/1992 | Crum |
| 5,131,563 | A | 7/1992 | Yablans |
| 5,148,927 | A | 9/1992 | Gebka |
| 5,159,753 | A | 11/1992 | Torrence |
| 5,161,702 | A | 11/1992 | Skalski |
| 5,161,704 | A | 11/1992 | Valiulis |
| 5,178,258 | A | 1/1993 | Smalley et al. |
| 5,183,166 | A | 2/1993 | Belokin, Jr. et al. |
| 5,190,186 | A | 3/1993 | Yablans et al. |
| 5,197,610 | A | 3/1993 | Bustos |
| 5,203,463 | A | 4/1993 | Gold |
| 5,215,199 | A | 6/1993 | Bejarano |
| 5,240,126 | A | 8/1993 | Foster et al. |
| 5,255,802 | A | 10/1993 | Krinke et al. |
| 5,265,738 | A | 11/1993 | Yablans et al. |
| 5,295,596 | A | 3/1994 | Squitieri |
| 5,316,154 | A | 5/1994 | Hajec, Jr. |
| 5,322,668 | A | 6/1994 | Tomasso |
| 5,341,945 | A | 8/1994 | Gibson |
| 5,351,839 | A | 10/1994 | Beeler et al. |
| 5,366,099 | A | 11/1994 | Schmid |
| 5,381,908 | A | 1/1995 | Hepp |
| 5,390,802 | A | 2/1995 | Pappagallo et al. |
| 5,397,006 | A | 3/1995 | Terrell |
| 5,397,016 | A | 3/1995 | Torrence et al. |
| 5,405,193 | A | 4/1995 | Herrenbruck |
| 5,408,775 | A | 4/1995 | Abramson et al. |
| 5,413,229 | A | 5/1995 | Zuberbuhler et al. |
| 5,415,297 | A | 5/1995 | Klein et al. |
| 5,419,066 | A | 5/1995 | Harnois et al. |
| 5,439,122 | A | 8/1995 | Ramsay |
| 5,450,969 | A | 9/1995 | Johnson et al. |
| 5,458,248 | A | 10/1995 | Alain |
| 5,464,105 | A | 11/1995 | Mandeltort |
| 5,469,975 | A | 11/1995 | Fajnsztajn |
| 5,469,976 | A | 11/1995 | Burchell |
| 5,505,315 | A | 4/1996 | Carroll |
| 5,542,552 | A | 8/1996 | Yablans et al. |
| 5,562,217 | A | 10/1996 | Salveson et al. |
| 5,577,337 | A | 11/1996 | Lin |
| 5,597,150 | A | 1/1997 | Stein et al. |
| 5,613,621 | A | 3/1997 | Gervasi et al. |
| D378,888 | S | 4/1997 | Bertilsson |
| 5,615,780 | A | 4/1997 | Nimetz et al. |
| 5,634,564 | A | 6/1997 | Spamer et al. |
| 5,638,963 | A | 6/1997 | Finnelly et al. |
| 5,641,082 | A | 6/1997 | Grainger |
| 5,645,176 | A | 7/1997 | Jay |
| 5,655,670 | A | 8/1997 | Stuart |
| 5,657,702 | A | 8/1997 | Ribeyrolles |
| 5,665,304 | A | 9/1997 | Heinen et al. |
| 5,673,801 | A | 10/1997 | Markson |
| D386,363 | S | 11/1997 | Dardashti |
| 5,682,824 | A | 11/1997 | Visk |
| 5,685,664 | A | 11/1997 | Parham et al. |
| 5,690,038 | A | 11/1997 | Merit et al. |
| 5,695,076 | A | 12/1997 | Jay |
| 5,695,077 | A | 12/1997 | Jay |
| 5,707,034 | A | 1/1998 | Cotterill |
| 5,711,432 | A | 1/1998 | Stein et al. |
| 5,720,230 | A | 2/1998 | Mansfield |
| 5,730,320 | A | 3/1998 | David |
| 5,738,019 | A | 4/1998 | Parker |
| 5,740,944 | A | 4/1998 | Crawford |
| 5,743,428 | A | 4/1998 | Rankin, VI |
| 5,746,328 | A | 5/1998 | Beeler et al. |
| 5,749,478 | A | 5/1998 | Ellis |
| 5,765,390 | A | 6/1998 | Johnson et al. |
| 5,788,090 | A | 8/1998 | Kajiwara |
| 5,803,276 | A | 9/1998 | Vogler |
| 5,806,690 | A | 9/1998 | Johnson et al. |
| 5,826,731 | A | 10/1998 | Dardashti |

(56) References Cited

U.S. PATENT DOCUMENTS

| | | | |
|---|---|---|---|
| 5,839,588 | A | 11/1998 | Hawkinson |
| 5,848,709 | A | 12/1998 | Gelphman et al. |
| 5,855,283 | A | 1/1999 | Johnson |
| D405,632 | S | 2/1999 | Parham |
| 5,865,324 | A | 2/1999 | Jay et al. |
| 5,873,473 | A | 2/1999 | Pater |
| 5,873,489 | A | 2/1999 | Ide et al. |
| 5,878,895 | A | 3/1999 | Springs |
| 5,887,732 | A | 3/1999 | Zimmer et al. |
| 5,904,256 | A | 5/1999 | Jay |
| 5,906,283 | A | 5/1999 | Kump et al. |
| 5,944,201 | A | 8/1999 | Babboni et al. |
| 5,951,228 | A | 9/1999 | Pfeiffer et al. |
| 5,970,887 | A | 10/1999 | Hardy |
| 5,971,173 | A | 10/1999 | Valiulis et al. |
| 5,971,204 | A | 10/1999 | Apps |
| 5,975,318 | A | 11/1999 | Jay |
| 5,992,652 | A | 11/1999 | Springs |
| 5,992,653 | A | 11/1999 | Anderson et al. |
| 6,006,678 | A | 12/1999 | Merit et al. |
| 6,007,248 | A | 12/1999 | Fulterer |
| 6,021,908 | A | 2/2000 | Mathews |
| 6,026,984 | A | 2/2000 | Perrin |
| 6,041,720 | A | 3/2000 | Hardy |
| 6,044,982 | A | 4/2000 | Stuart |
| 6,047,647 | A | 4/2000 | Laraia, Jr. |
| 6,068,142 | A | 5/2000 | Primiano |
| 6,076,670 | A | 6/2000 | Yeranossian |
| 6,082,556 | A | 7/2000 | Primiano et al. |
| 6,082,557 | A | 7/2000 | Leahy |
| 6,082,558 | A | 7/2000 | Battaglia |
| 6,089,385 | A | 7/2000 | Nozawa |
| 6,102,185 | A | 8/2000 | Neuwirth et al. |
| 6,112,938 | A | 9/2000 | Apps |
| 6,129,218 | A | 10/2000 | Henry et al. |
| 6,132,158 | A | 10/2000 | Pfeiffer et al. |
| 6,142,316 | A | 11/2000 | Harbour et al. |
| 6,142,317 | A | 11/2000 | Merl |
| 6,164,462 | A | 12/2000 | Mumford |
| 6,164,491 | A | 12/2000 | Bustos et al. |
| 6,173,845 | B1 | 1/2001 | Higgins et al. |
| 6,186,725 | B1 | 2/2001 | Konstant |
| 6,189,734 | B1 | 2/2001 | Apps et al. |
| 6,209,731 | B1 | 4/2001 | Spamer et al. |
| 6,209,733 | B1 | 4/2001 | Higgins et al. |
| 6,226,910 | B1 | 5/2001 | Ireland |
| 6,227,385 | B1 | 5/2001 | Nickerson |
| 6,227,386 | B1 | 5/2001 | Close |
| 6,234,325 | B1 | 5/2001 | Higgins et al. |
| 6,234,326 | B1 | 5/2001 | Higgins et al. |
| 6,234,328 | B1 | 5/2001 | Mason |
| 6,237,784 | B1 | 5/2001 | Primiano |
| D445,615 | S | 7/2001 | Burke |
| 6,253,954 | B1 | 7/2001 | Yasaka |
| 6,299,004 | B1 | 10/2001 | Thalenfeld et al. |
| 6,305,559 | B1 | 10/2001 | Hardy |
| 6,308,839 | B1 | 10/2001 | Steinberg et al. |
| 6,309,034 | B1 | 10/2001 | Credle, Jr. et al. |
| 6,311,852 | B1 | 11/2001 | Ireland |
| 6,325,221 | B2 | 12/2001 | Parham |
| 6,325,222 | B1 | 12/2001 | Avery et al. |
| 6,330,758 | B1 | 12/2001 | Feibelman |
| 6,357,606 | B1 | 3/2002 | Henry |
| 6,357,985 | B1 | 3/2002 | Anzani et al. |
| 6,375,015 | B1 | 4/2002 | Wingate |
| 6,378,727 | B1 | 4/2002 | Dupuis et al. |
| 6,382,431 | B1 | 5/2002 | Burke |
| 6,390,310 | B1 | 5/2002 | Insalaco |
| 6,398,044 | B1 | 6/2002 | Robertson |
| 6,401,942 | B1 | 6/2002 | Eckert |
| 6,405,880 | B1 | 6/2002 | Webb |
| 6,409,026 | B2 | 6/2002 | Watanabe |
| 6,409,027 | B1 | 6/2002 | Chang et al. |
| 6,409,028 | B2 | 6/2002 | Nickerson |
| 6,419,100 | B1 | 7/2002 | Menz et al. |
| 6,428,123 | B1 | 8/2002 | Lucht et al. |
| 6,431,808 | B1 | 8/2002 | Lowrey et al. |
| 6,435,359 | B1 | 8/2002 | Priminano |
| 6,439,402 | B2 | 8/2002 | Robertson |
| 6,464,089 | B1 | 10/2002 | Rankin, VI |
| 6,471,053 | B1 | 10/2002 | Feibelman |
| 6,471,081 | B1 | 10/2002 | Weiler |
| 6,484,891 | B2 | 11/2002 | Burke |
| 6,490,983 | B1 | 12/2002 | Nicholson et al. |
| 6,497,326 | B1 | 12/2002 | Osawa |
| 6,505,747 | B1 | 1/2003 | Robertson |
| 6,523,664 | B2 | 2/2003 | Shaw et al. |
| 6,523,702 | B1 | 2/2003 | Primiano et al. |
| 6,523,703 | B1 | 2/2003 | Robertson |
| 6,527,127 | B2 | 3/2003 | Dumontet |
| 6,533,131 | B2 | 3/2003 | Bada |
| 6,554,143 | B1 | 4/2003 | Robertson |
| 6,571,498 | B1 | 6/2003 | Cyrluk |
| 6,598,754 | B2 | 7/2003 | Weiler |
| 6,604,638 | B1 | 8/2003 | Primiano et al. |
| 6,615,995 | B2 | 9/2003 | Primiano et al. |
| 6,622,874 | B1 | 9/2003 | Hawkinson |
| 6,637,604 | B1 | 10/2003 | Jay |
| 6,648,151 | B2 | 11/2003 | Battaglia et al. |
| 6,651,828 | B2 | 11/2003 | Dimattio et al. |
| 6,655,536 | B2 | 12/2003 | Jo et al. |
| 6,659,293 | B1 | 12/2003 | Smith |
| 6,666,533 | B1 | 12/2003 | Stavros |
| D485,699 | S | 1/2004 | Mueller et al. |
| 6,679,033 | B2 | 1/2004 | Hart et al. |
| 6,679,389 | B1 | 1/2004 | Robertson et al. |
| 6,691,891 | B2 | 2/2004 | Maldonado |
| 6,695,152 | B1 | 2/2004 | Fabrizio et al. |
| 6,715,621 | B2 | 4/2004 | Boron |
| 6,722,509 | B1 | 4/2004 | Robertson et al. |
| RE38,517 | E | 5/2004 | Pfeiffer et al. |
| 6,739,461 | B1 | 5/2004 | Robinson |
| 6,745,905 | B2 | 6/2004 | Bernstein |
| 6,749,070 | B2 | 6/2004 | Corbett, Jr. et al. |
| 6,756,975 | B1 | 6/2004 | Kishida et al. |
| 6,758,349 | B1 | 7/2004 | Kwap et al. |
| 6,769,552 | B1 | 8/2004 | Thalenfeld |
| 6,772,888 | B2 | 8/2004 | Burke |
| 6,779,670 | B2 | 8/2004 | Primiano et al. |
| 6,786,341 | B2 | 9/2004 | Stinnett et al. |
| 6,796,445 | B2 | 9/2004 | Cyrluk |
| 6,799,523 | B1 | 10/2004 | Cunha |
| 6,820,754 | B2 | 11/2004 | Ondrasik |
| 6,823,997 | B2 | 11/2004 | Linden et al. |
| 6,824,009 | B2 | 11/2004 | Hardy |
| 6,830,146 | B1 | 12/2004 | Scully et al. |
| 6,830,157 | B2 | 12/2004 | Robertson et al. |
| 6,843,382 | B2 | 1/2005 | Kanouchi et al. |
| 6,843,632 | B1 | 1/2005 | Hollander |
| 6,860,046 | B1 | 3/2005 | Squitieri |
| 6,866,156 | B2 | 3/2005 | Nagel et al. |
| 6,867,824 | B2 | 3/2005 | Eiraku et al. |
| 6,874,646 | B2 | 4/2005 | Jay |
| 6,889,854 | B2 | 5/2005 | Burke |
| 6,889,855 | B2 | 5/2005 | Nagel |
| 6,902,285 | B2 | 6/2005 | Eiraku et al. |
| 6,918,495 | B1 | 7/2005 | Hoy |
| 6,918,736 | B2 | 7/2005 | Hart et al. |
| 6,919,933 | B2 | 7/2005 | Zhang et al. |
| 6,923,330 | B1 | 8/2005 | Nagel |
| 6,929,133 | B1 | 8/2005 | Knapp, III et al. |
| 6,948,900 | B1 | 9/2005 | Neuman |
| 6,955,269 | B2 | 10/2005 | Menz |
| 6,957,941 | B2 | 10/2005 | Hart et al. |
| 6,962,260 | B2 | 11/2005 | Jay et al. |
| 6,963,386 | B2 | 11/2005 | Poliakine et al. |
| 6,964,235 | B2 | 11/2005 | Hardy |
| 6,964,344 | B1 | 11/2005 | Kim |
| 6,976,598 | B2 | 12/2005 | Engel |
| 6,981,597 | B2 | 1/2006 | Cash |
| 7,004,334 | B2 | 2/2006 | Walsh et al. |
| 7,007,790 | B2 | 3/2006 | Brannon |
| 7,028,450 | B2 | 4/2006 | Hart et al. |
| 7,028,852 | B2 | 4/2006 | Johnson et al. |

(56) References Cited

U.S. PATENT DOCUMENTS 7,063,217 B2 6/2006 Burke
7,080,969 B2 7/2006 Hart et al.
7,083,054 B2 8/2006 Squitieri
7,086,541 B2 8/2006 Robertson
7,093,546 B2 8/2006 Hardy
7,104,026 B2 9/2006 Welborn et al.
7,104,410 B2 9/2006 Primiano
7,108,143 B1 9/2006 Lin
7,111,914 B2 9/2006 Avendano
7,114,606 B2 10/2006 Shaw et al.
7,124,898 B2 10/2006 Richter et al.
7,140,499 B2 11/2006 Burke
7,140,705 B2 11/2006 Dressendorfer et al.
7,150,365 B2 12/2006 Hardy et al.
7,152,536 B2 12/2006 Hardy
7,168,546 B2 1/2007 Plesh, Sr.
7,168,579 B2 1/2007 Richter et al.
7,182,209 B2 2/2007 Squitieri
7,195,123 B2 3/2007 Roslof et al.
7,198,340 B1 4/2007 Ertz
7,200,903 B2 4/2007 Shaw et al.
7,201,281 B1 4/2007 Welker
7,216,770 B2 5/2007 Mueller et al.
7,229,143 B2 6/2007 Gilman
7,293,663 B2 11/2007 Lavery, Jr.
7,299,934 B2 11/2007 Hardy et al.
7,318,532 B1 1/2008 Lee et al.
7,347,335 B2 3/2008 Rankin, VI et al.
7,357,469 B2 4/2008 Ertz
7,395,938 B2 7/2008 Merit et al.
7,398,876 B2 7/2008 Vestergaard
7,404,494 B2 7/2008 Hardy
7,419,062 B2 9/2008 Mason
7,424,957 B1 9/2008 Luberto
7,451,881 B2 11/2008 Hardy et al.
7,458,473 B1 12/2008 Mason
7,478,731 B1 1/2009 Mason
7,497,342 B2 3/2009 Hardy
7,500,571 B2 3/2009 Hawkinson
7,530,452 B2 5/2009 Vestergaard
7,621,409 B2 11/2009 Hardy et al.
7,626,913 B2 12/2009 Usami
7,631,771 B2 12/2009 Nagel et al.
7,641,057 B2 1/2010 Mueller et al.
7,681,743 B2 3/2010 Hanretty et al.
7,681,744 B2 3/2010 Johnson
7,686,185 B2 3/2010 Zychinski
7,703,614 B2 4/2010 Schneider et al.
7,717,276 B2 5/2010 Alves
7,784,623 B2 8/2010 Mueller et al.
7,784,644 B2 8/2010 Albert et al.
7,815,060 B2 10/2010 Iellimo
7,823,724 B2 11/2010 Mowe et al.
7,823,734 B2 * 11/2010 Hardy ..... 211/59.3
7,828,158 B2 11/2010 Colelli et al.
7,882,969 B2 2/2011 Gerstner et al.
7,896,172 B1 3/2011 Hester
7,918,353 B1 4/2011 Luberto
7,931,156 B2 4/2011 Hardy
7,934,609 B2 5/2011 Alves et al.
7,980,398 B2 7/2011 Kahl et al.
7,993,088 B2 8/2011 Sonon et al.
8,016,139 B2 9/2011 Hanners et al.
8,025,162 B2 9/2011 Hardy
8,038,017 B2 10/2011 Close
8,096,427 B2 1/2012 Hardy
8,113,360 B2 2/2012 Olson
8,113,601 B2 2/2012 Hardy
D655,107 S 3/2012 Clark et al.
8,127,944 B2 3/2012 Hardy
8,162,154 B2 4/2012 Trulaske, Sr.
8,167,149 B2 5/2012 Wamsley et al.
8,177,076 B2 5/2012 Rataiczak, III et al.
8,215,520 B2 7/2012 Miller et al.
8,225,946 B2 7/2012 Yang et al.
8,267,258 B2 9/2012 Allwright et al.
8,276,772 B2 10/2012 Kim
8,312,999 B2 * 11/2012 Hardy ..... 211/59.3
8,322,544 B2 * 12/2012 Hardy ..... 211/59.3
8,333,285 B2 12/2012 Kiehnau et al.
8,342,340 B2 1/2013 Rataiczak, III et al.
8,360,253 B2 1/2013 Hardy
8,376,154 B2 2/2013 Sun
8,397,922 B2 3/2013 Kahl et al.
8,485,391 B2 7/2013 Vlastakis et al.
8,556,092 B2 10/2013 Valiulis et al.
8,573,379 B2 11/2013 Brugmann
8,579,123 B2 11/2013 Mueller et al.
8,622,227 B2 1/2014 Bird et al.
8,657,126 B1 2/2014 Loftin et al.
8,662,325 B2 3/2014 Davis et al.
8,739,984 B2 6/2014 Hardy
8,763,819 B2 7/2014 Theisen et al.
8,844,431 B2 9/2014 Davis et al.
8,978,904 B2 3/2015 Hardy
2001/0002658 A1 6/2001 Parham
2001/0010302 A1 8/2001 Nickerson
2001/0017284 A1 8/2001 Watanabe
2001/0019032 A1 9/2001 Battaglia et al.
2001/0020604 A1 9/2001 Battaglia et al.
2001/0020606 A1 9/2001 Battaglia et al.
2001/0042706 A1 11/2001 Ryan et al.
2001/0045403 A1 11/2001 Robertson
2001/0054297 A1 12/2001 Credle et al.
2002/0036178 A1 3/2002 Tombu
2002/0066706 A1 6/2002 Robertson
2002/0088762 A1 7/2002 Burke
2002/0108916 A1 8/2002 Nickerson
2002/0148794 A1 10/2002 Marihugh
2002/0170866 A1 11/2002 Johnson et al.
2002/0179553 A1 12/2002 Squitieri
2002/0182050 A1 12/2002 Hart et al.
2002/0189201 A1 12/2002 Hart et al.
2002/0189209 A1 12/2002 Hart et al.
2003/0000956 A1 1/2003 Maldonado
2003/0007859 A1 1/2003 Hart et al.
2003/0010732 A1 1/2003 Burke
2003/0057167 A1 3/2003 Johnson et al.
2003/0061973 A1 4/2003 Bustos
2003/0066811 A1 4/2003 Dimattio et al.
2003/0080075 A1 5/2003 Primiano et al.
2003/0084827 A1 5/2003 Nicholson et al.
2003/0085187 A1 5/2003 Johnson et al.
2003/0106867 A1 6/2003 Caterinacci
2003/0132178 A1 7/2003 Jay et al.
2003/0132182 A1 7/2003 Jay
2003/0136750 A1 7/2003 Fujii et al.
2003/0141265 A1 7/2003 Jo et al.
2003/0150829 A1 8/2003 Linden et al.
2003/0168420 A1 9/2003 Primiano
2003/0217980 A1 11/2003 Johnson et al.
2003/0226815 A1 12/2003 Gaunt et al.
2004/0000528 A1 1/2004 Nagel
2004/0004046 A1 1/2004 Primiano et al.
2004/0011754 A1 1/2004 Zadak
2004/0020879 A1 2/2004 Close
2004/0065631 A1 4/2004 Nagel
2004/0079715 A1 4/2004 Richter et al.
2004/0084390 A1 5/2004 Bernstein
2004/0094493 A1 5/2004 Higgins
2004/0104239 A1 6/2004 Black et al.
2004/0105556 A1 6/2004 Grove
2004/0118793 A1 6/2004 Burke
2004/0118795 A1 6/2004 Burke
2004/0140276 A1 7/2004 Waldron
2004/0140278 A1 7/2004 Mueller et al.
2004/0140279 A1 7/2004 Mueller et al.
2004/0178156 A1 9/2004 Knorring, Jr. et al.
2004/0182805 A1 9/2004 Harper
2004/0200793 A1 10/2004 Hardy
2004/0206054 A1 10/2004 Welborn et al.
2004/0232092 A1 11/2004 Cash
2004/0245197 A1 12/2004 McElvaney
2004/0247422 A1 12/2004 Neumann et al.

(56) References Cited

U.S. PATENT DOCUMENTS

| | | | | |
|---|---|---|---|---|
| 2005/0040123 | A1 | 2/2005 | Ali | |
| 2005/0072657 | A1 | 4/2005 | Lawless et al. | |
| 2005/0072747 | A1 | 4/2005 | Roslof et al. | |
| 2005/0076817 | A1 | 4/2005 | Boks et al. | |
| 2005/0077259 | A1 | 4/2005 | Menz | |
| 2005/0092702 | A1 | 5/2005 | Nagel | |
| 2005/0098515 | A1 | 5/2005 | Close | |
| 2005/0127014 | A1 | 6/2005 | Richter et al. | |
| 2005/0133471 | A1 | 6/2005 | Squitieri | |
| 2005/0139560 | A1 | 6/2005 | Whiteside et al. | |
| 2005/0150847 | A1 | 7/2005 | Hawkinson | |
| 2005/0189310 | A1 | 9/2005 | Richter et al. | |
| 2005/0199563 | A1 | 9/2005 | Richter et al. | |
| 2005/0199564 | A1 | 9/2005 | Johnson et al. | |
| 2005/0199565 | A1 | 9/2005 | Richter et al. | |
| 2005/0218094 | A1 | 10/2005 | Howerton et al. | |
| 2005/0224437 | A1 | 10/2005 | Lee | |
| 2005/0249577 | A1 | 11/2005 | Hart et al. | |
| 2005/0258113 | A1 | 11/2005 | Close et al. | |
| 2005/0263465 | A1 | 12/2005 | Chung | |
| 2006/0001337 | A1 | 1/2006 | Walburn | |
| 2006/0032827 | A1 | 2/2006 | Phoy | |
| 2006/0049122 | A1 | 3/2006 | Mueller et al. | |
| 2006/0049125 | A1 | 3/2006 | Stowell | |
| 2006/0104758 | A1 | 5/2006 | Hart et al. | |
| 2006/0163180 | A1 | 7/2006 | Rankin et al. | |
| 2006/0163272 | A1 | 7/2006 | Gamble | |
| 2006/0186064 | A1 | 8/2006 | Merit et al. | |
| 2006/0186066 | A1 | 8/2006 | Johnson et al. | |
| 2006/0196840 | A1 | 9/2006 | Jay et al. | |
| 2006/0213852 | A1 | 9/2006 | Kwon | |
| 2006/0226095 | A1 | 10/2006 | Hardy | |
| 2006/0237381 | A1 | 10/2006 | Lockwood et al. | |
| 2006/0260518 | A1 | 11/2006 | Josefsson et al. | |
| 2006/0263192 | A1 | 11/2006 | Hart et al. | |
| 2006/0273053 | A1 | 12/2006 | Roslof et al. | |
| 2006/0283150 | A1 | 12/2006 | Hart et al. | |
| 2006/0283151 | A1 | 12/2006 | Welborn et al. | |
| 2007/0006885 | A1 | 1/2007 | Shultz et al. | |
| 2007/0029270 | A1 | 2/2007 | Hawkinson | |
| 2007/0068885 | A1 | 3/2007 | Busto et al. | |
| 2007/0108142 | A1 | 5/2007 | Medcalf et al. | |
| 2007/0108146 | A1 | 5/2007 | Nawrocki | |
| 2007/0138114 | A1 | 6/2007 | Dumontet | |
| 2007/0170127 | A1 | 7/2007 | Johnson | |
| 2007/0175839 | A1 | 8/2007 | Schneider et al. | |
| 2007/0175844 | A1 | 8/2007 | Schneider | |
| 2007/0194037 | A1 | 8/2007 | Close | |
| 2007/0251905 | A1 | 11/2007 | Trotta | |
| 2007/0256992 | A1 | 11/2007 | Olson | |
| 2007/0267364 | A1 | 11/2007 | Barkdoll | |
| 2007/0278164 | A1 | 12/2007 | Lang et al. | |
| 2008/0011696 | A1 | 1/2008 | Richter et al. | |
| 2008/0017598 | A1 | 1/2008 | Rataiczak et al. | |
| 2008/0129161 | A1 | 6/2008 | Menz et al. | |
| 2008/0142458 | A1 | 6/2008 | Medcalf | |
| 2008/0156751 | A1 | 7/2008 | Richter et al. | |
| 2008/0156752 | A1 | 7/2008 | Bryson et al. | |
| 2008/0164229 | A1 | 7/2008 | Richter et al. | |
| 2008/0250986 | A1 | 10/2008 | Boon | |
| 2008/0314852 | A1 | 12/2008 | Richter et al. | |
| 2009/0020548 | A1 | 1/2009 | VanDruff | |
| 2009/0084812 | A1 | 4/2009 | Kirschner | |
| 2009/0101606 | A1 | 4/2009 | Olson | |
| 2009/0272705 | A1 | 11/2009 | Francis | |
| 2010/0012602 | A1 | 1/2010 | Valiulis et al. | |
| 2010/0072152 | A1 | 3/2010 | Kim | |
| 2010/0078402 | A1 | 4/2010 | Davis et al. | |
| 2010/0089847 | A1* | 4/2010 | Rataiczak et al. | 211/59.3 |
| 2010/0096345 | A1 | 4/2010 | Crawbuck et al. | |
| 2010/0108624 | A1 | 5/2010 | Sparkowski | |
| 2010/0133214 | A1 | 6/2010 | Evans | |
| 2010/0176075 | A1 | 7/2010 | Nagel et al. | |
| 2010/0200526 | A1 | 8/2010 | Barkdoll | |
| 2010/0206829 | A1 | 8/2010 | Clements et al. | |
| 2010/0252519 | A1 | 10/2010 | Hanners et al. | |
| 2010/0258513 | A1 | 10/2010 | Meyer et al. | |
| 2010/0276383 | A1 | 11/2010 | Hardy | |
| 2011/0168652 | A1 | 7/2011 | Barkdoll | |
| 2011/0174750 | A1 | 7/2011 | Poulokefalos | |
| 2011/0204012 | A1 | 8/2011 | Eguchi et al. | |
| 2011/0215060 | A1 | 9/2011 | Niederhuefner | |
| 2011/0284571 | A1 | 11/2011 | Lockwood et al. | |
| 2011/0304316 | A1 | 12/2011 | Hachmann et al. | |
| 2012/0074088 | A1 | 3/2012 | Dotson et al. | |
| 2012/0118840 | A1* | 5/2012 | Howley | 211/59.3 |
| 2012/0217212 | A1 | 8/2012 | Czalkiewicz et al. | |
| 2012/0285916 | A1 | 11/2012 | O'Quinn et al. | |
| 2013/0015155 | A1 | 1/2013 | Brugmann | |
| 2013/0026117 | A1 | 1/2013 | Hardy | |
| 2013/0037562 | A1 | 2/2013 | Close | |
| 2013/0206713 | A1 | 8/2013 | Hardy | |
| 2013/0213916 | A1 | 8/2013 | Leahy et al. | |
| 2014/0091696 | A1 | 4/2014 | Welker et al. | |
| 2014/0305891 | A1 | 10/2014 | Vogler et al. | |
| 2014/0360953 | A1* | 12/2014 | Pichel | 211/59.3 |
| 2015/0090675 | A1 | 4/2015 | Vosshernrich | |

FOREIGN PATENT DOCUMENTS

| | | | |
|---|---|---|---|
| BE | 1013877 | A6 | 11/2002 |
| CH | 412251 | A | 4/1966 |
| DE | 969003 | C | 4/1958 |
| DE | 1819158 | U | 10/1960 |
| DE | 2002720 | A1 | 7/1971 |
| DE | 7311113 | U | 8/1973 |
| DE | 2232398 | A1 | 1/1974 |
| DE | 2825724 | C3 | 5/1981 |
| DE | 8308485 | U1 | 9/1983 |
| DE | 3211880 | A1 | 10/1983 |
| DE | 8426651 | U1 | 2/1985 |
| DE | 8717386.7 | | 4/1988 |
| DE | 3707410 | A1 | 9/1988 |
| DE | 9300431.1 | | 3/1993 |
| DE | 29618870 | U1 | 12/1996 |
| DE | 29902688 | U1 | 7/1999 |
| DE | 19808162 | A1 | 9/1999 |
| DE | 202007011927 | U1 | 11/2007 |
| DE | 202013102529 | U1 | 6/2013 |
| EP | 0004921 | A1 | 10/1979 |
| EP | 0018003 | A2 | 10/1980 |
| EP | 69003 | A1 | 1/1983 |
| EP | 0176209 | A2 | 4/1986 |
| EP | 0224107 | A2 | 6/1987 |
| EP | 270016 | A2 | 6/1988 |
| EP | 336696 | A2 | 10/1989 |
| EP | 337340 | A3 | 5/1990 |
| EP | 398500 | A1 | 11/1990 |
| EP | 0408400 | A1 | 1/1991 |
| EP | 478570 | A1 | 4/1992 |
| EP | 555935 | A1 | 8/1993 |
| EP | 0568396 | A1 | 11/1993 |
| EP | 0587059 | A2 | 3/1994 |
| EP | 454586 | B1 | 7/1995 |
| EP | 782831 | A1 | 7/1997 |
| EP | 986980 | A1 | 3/2000 |
| EP | 779047 | B1 | 4/2000 |
| EP | 1010647 | A1 | 6/2000 |
| EP | 1077040 | A1 | 2/2001 |
| EP | 1151941 | A2 | 11/2001 |
| EP | 1174060 | A1 | 1/2002 |
| EP | 1208773 | A1 | 5/2002 |
| EP | 1256296 | A2 | 11/2002 |
| EP | 1312285 | A1 | 5/2003 |
| EP | 1356752 | A1 | 10/2003 |
| EP | 1372436 | A1 | 1/2004 |
| EP | 1395152 | A1 | 3/2004 |
| EP | 979628 | B1 | 4/2004 |
| EP | 1406527 | A1 | 4/2004 |
| EP | 1420669 | A2 | 5/2004 |
| EP | 1462035 | A2 | 9/2004 |
| EP | 1510156 | A2 | 3/2005 |
| EP | 1549182 | A1 | 7/2005 |
| EP | 1662944 | A1 | 6/2006 |

(56) References Cited

FOREIGN PATENT DOCUMENTS

| | | | |
|---|---|---|---|
| EP | 1806076 | A2 | 7/2007 |
| EP | 1857021 | A2 | 11/2007 |
| EP | 1864597 | A1 | 12/2007 |
| EP | 1940263 | A2 | 7/2008 |
| EP | 2005402 | A2 | 12/2008 |
| EP | 2159169 | A1 | 3/2010 |
| EP | 2181945 | A1 | 5/2010 |
| EP | 2222208 | A1 | 9/2010 |
| EP | 2237703 | A1 | 10/2010 |
| EP | 2282660 | A1 | 2/2011 |
| EP | 2308353 | A1 | 4/2011 |
| EP | 2338384 | A1 | 6/2011 |
| EP | 2353458 | A2 | 8/2011 |
| EP | 2398358 | A1 | 12/2011 |
| EP | 2415371 | A1 | 2/2012 |
| EP | 2531077 | A1 | 12/2012 |
| EP | 2545813 | A1 | 1/2013 |
| EP | 2591703 | A1 | 5/2013 |
| EP | 2625987 | A1 | 8/2013 |
| FR | 2385365 | B1 | 6/1982 |
| FR | 2526338 | A1 | 11/1983 |
| FR | 2617385 | A1 | 1/1989 |
| FR | 2724098 | A1 | 3/1996 |
| FR | 2859364 | A1 | 3/2005 |
| GB | 697994 | A | 10/1953 |
| GB | 740311 | A | 11/1955 |
| GB | 881700 | A | 11/1961 |
| GB | 1082150 | A | 9/1967 |
| GB | 1088654 | A | 10/1967 |
| GB | 2027339 | B | 8/1982 |
| GB | D2037553 | | 7/1994 |
| GB | 2281289 | A | 3/1995 |
| GB | 2290077 | A | 12/1995 |
| GB | 2297241 | A | 7/1996 |
| GB | 2283407 | B | 10/1997 |
| GB | 2392667 | B | 11/2004 |
| GB | 2386116 | B | 12/2005 |
| JP | 54168195 | | 11/1979 |
| JP | 186856 | U | 2/1982 |
| JP | 59218113 | | 8/1984 |
| JP | 62060521 | A | 3/1987 |
| JP | 6329463 | | 2/1988 |
| JP | 6397114 | A | 4/1988 |
| JP | S63099810 | A | 5/1988 |
| JP | 02191413 | | 7/1990 |
| JP | 345766 | U | 4/1991 |
| JP | 423463 | U | 2/1992 |
| JP | 6202945 | | 7/1994 |
| JP | 677614 | U | 11/1994 |
| JP | 3005457 | U | 12/1994 |
| JP | H08507447 | A | 8/1996 |
| JP | 9238787 | A | 9/1997 |
| JP | 10263710 | | 10/1998 |
| JP | 1118889 | A | 1/1999 |
| JP | 11006284 | | 1/1999 |
| JP | 11018889 | A | 1/1999 |
| JP | 11313737 | | 11/1999 |
| JP | 11342054 | | 12/1999 |
| JP | 2000023802 | A | 1/2000 |
| JP | 2000106988 | A | 4/2000 |
| JP | 2000157378 | A | 6/2000 |
| JP | 2000350642 | A | 12/2000 |
| JP | 2001104117 | A | 4/2001 |
| JP | 2003210286 | A | 7/2003 |
| JP | 3099639 | U | 4/2004 |
| JP | 3115289 | Y | 9/2005 |
| JP | 3115812 | U | 11/2005 |
| JP | 2007307244 | A | 11/2007 |
| JP | 4708539 | B2 | 6/2011 |
| JP | 05277023 | B2 | 8/2013 |
| KR | 200292985 | Y1 | 10/2002 |
| NL | 106617 | A | 11/1963 |
| NL | 8520125 | | 1/1986 |
| NL | 1018330 | C2 | 5/2002 |
| SE | 394537 | B | 6/1977 |
| SU | 1600615 | A3 | 10/1990 |
| WO | 91/15141 | A1 | 10/1991 |
| WO | 9201614 | A1 | 2/1992 |
| WO | 9806305 | A1 | 2/1998 |
| WO | 00/48488 | A1 | 8/2000 |
| WO | 00/54632 | A1 | 9/2000 |
| WO | 0071004 | A1 | 11/2000 |
| WO | 0165981 | | 9/2001 |
| WO | 02089104 | A2 | 11/2002 |
| WO | 02091885 | A1 | 11/2002 |
| WO | 03005862 | A2 | 1/2003 |
| WO | 03013316 | A2 | 2/2003 |
| WO | 03032775 | A2 | 4/2003 |
| WO | 2004105556 | A2 | 12/2004 |
| WO | 2005021406 | A2 | 3/2005 |
| WO | 2006019947 | A2 | 2/2006 |
| WO | 6094058 | | 8/2006 |
| WO | 2007073294 | A1 | 6/2007 |
| WO | 2007133086 | A1 | 11/2007 |
| WO | 2008/153561 | | 12/2008 |
| WO | 2009029099 | A1 | 3/2009 |
| WO | 10014742 | A1 | 2/2010 |
| WO | 11018059 | A1 | 2/2011 |
| WO | 12047480 | A1 | 4/2012 |
| WO | 12125301 | A1 | 9/2012 |
| WO | 13066686 | A1 | 5/2013 |

OTHER PUBLICATIONS

RTC Industries, Inc. v. Henschei-Steinau, Inc., Complaint, Case: 1 :11-cv-05497 Document #:1 Filed: Aug. 12, 2011 p. 1 of 6 p. Id #:1.
RTC Industries, Inc. v. Henschei-Steinau, Inc., Plaintiffs Notice of Dismissal Pursuant to Fed. R Civ. P. 41(a)(1)(A)(i) Case: 1: 11-cv-05497 Document#: 15 Filed: Oct. 21, 2011 p. 1 of 3 p. ID #:51.
RTC Industries, Inc. v. Henschei-Steinau, Inc., Complaint, Case: 1:10-cv-07460 Document#:1 Filed Nov. 19, 2010.
http://www.posexpert.pl/public/files/PDF/Popychacze%20produkt%C3%B3w.pdf; Sep. 2006.
http://www.hl-display.sk/eng/Catalogue2005/0ptimal-eng.pdf; 2005.
http://www.triononline.com/trionshelfworks/sw2.php; May 2007.
http://web .archive. org/web/20070516135906/hllp :1 lwww. triononline .com/productlines/wonderBar. php; May 2007.
http://www.lpportal.com/feature-articles/item/15-product-protection%E2%80%94beyond-eas.html; Mar. 2004.
http://www.posexpert.pl/public/files/PDF/Zarz%C4%85dzanie%20p%C3%B3%C5%82k%C4%85%20(ang.).pdf; 2006.
http://www.postuning.de/fileadmin/PDF-Downloads/Prospekte/EN__ Tabak. pdf; 2006.
http://www.postuning.de/fileadmin/PDF-Downloads/Prospekte/EN__ePusher.pdf: Feb. 2005.
Vue 3040 Sanden; Apr. 2005.
http://www.storereadysolutions. com/srs. nsf/l_rinc/ A 56 F52C F98E 1289386257 449006011 DD !Open Document; 2006.
http://ers.rtc. com/SRS Fi les/SRS Flyer ProfitPusher. pdf; 2006.
Box-to-Shelf Pusher System- http://www.displaypeople.com/pdf/BOX__ TO__SHELF SELL__SHEET__Jan__19__ V3.pdf. dated Jan. 19, 2011.
Shelf Works—Expandable Wire Tray System—http://www. lriononline.com/pdf/ExpWTray.pdf. dated Jan. 6, 2003.
FFR DSI—Power Zone Trak-Set Self-facing System—http://www. ffr-dsi.com/sell-sheets/Power%20Zone%20Trak-Set%20Self-facing%20System.pdf.—dated Jan. 6, 2011.
International Search Report & Written Opinion for PCT/US2012/053374 mailed Nov. 27.2012. (12 pages).
International Search Report & Written Opinion for PCT/US2012/053357 mailed Nov. 22, 2012. (13 pages).
Final Office Action dated Nov. 5, 2013 for Japanese Application No. 2012-8725 (011610.00402), 8 pages.
RTC Industries, Inc., v. Fasteners for Retail, Inc., and SuperValu, Inc. d/b/a Cub Foods, Stipulation of Dismissal, Civil Action No. 05 C 6940, Apr. 2006.
RTC vs. Fasteners for Retail, Case No. 05C 6940, Document No. 26, filed Apr. 25, 2006.
RTC Industries, Inc., v. HMG Worldwide Corporation, Complaint, Civil Action No. DOC 3300, dated May 31, 2000.

(56) References Cited

OTHER PUBLICATIONS

RTC Industries, Inc. v. HMG Worldwide Corporation, Amended Complaint, dated Jan. 19, 2001.
RTC Industries, Inc. v. HMG Worldwide Corporation, RTC's Reply to HMG Worldwide Corporation's Amended Counterclaims, Civil Action No. DO CV 3300, dated Mar. 7, 2001.
RTC Industries, Inc., v. Fasteners for Retail, Inc., and SuperValu, Inc. d/b/a Cub Foods, Complaint, Civil Action No. 05C 6940.
RTC Industries, Inc. v. HMG Worldwide Corporation, Notice of Motion, Civil Action No. 00 Civ. 3300 (JHL), dated Feb. 22, 2001.
RTC Industries, Inc. v. William Merit & Associates, Inc, Evidentiary Objections to RTC Industries, Inc.'s Memorandum; in Opposition to William Merit & Associates' Motion for Partial Summary Judgment, Civil Action No. 04 C 1254, dated D; Jul. 2, 2004.
RTC Industries, Inc., v. William Merit & Associates, Inc., William Merit & Associates' Reply to RTC Industries, Inc.'s; Response to William Merit & Associates' Statement under Local Rule 56.1 of Material Facts to Which There is No Genuine Issue and Statement of Additional Facts that Require the Denial of Summary Judgment, Civil Action No. 04 C D 1254, dated Jul. 2, 2004.
RTC Industries, Inc. v. William Merit & Associates, Inc., Exhibits and Declarations in Support of William Merit &; Associates, Inc.'s Reply to RTC Industries, Inc.'s Memorandum in Opposition to William Merit & Associates' Motion for D; Partial Summary Judgment, Civil Action No. 04 C 1254, dated Jul. 2, 2004.
RTC Industries, Inc., v. William Merit & Associates, Inc., Notice of RTC Industries, Inc.'s Motion for Leave to File its Sur-Reply to William Merit's Motion for Partial Summary Judgment, Civil Action No. 04 C 1254, dated Jul. 6, 2004.
RTC Industries, Inc., v. William Merit & Associates, Inc., RTC Industries, Inc.'s Sur-Reply to William Merit's Motion for Partial Summary Judgment, Civil Action No. 04 C 1254, dated Jul. 6, 2004.
RTC Industries, Inc. v. William Merit & Associates, Inc. RTC's Response to Defendant's Evidentiary Objections to RTC;.Industries, Inc.'s Memorandum in Opposition to William Merit & Associates' Motion for Partial Summary Judgment, D; Civil Action No. 04 C 1254, dated Jul. 6, 2004.
RTC Industries, Inc. v. Fasteners for Retail Inc., Plaintiff RTC Industries Inc.'s Complaint, Civil Action No. 03C 3137, dated May 12, 2003.
RTC Industries, Inc., v. Fasteners for Retail Inc., and CVS Corporation, Amended Complaint, Civil Action No. 03C 3137, dated Aug. 6, 2003.
RTC Industries, Inc. v. Semasys, Inc., and Uni-Sun, Inc., Complaint, Civil Action No. 04C 4081, dated Jun. 17, 2004.
RTC Industries, Inc. v. Display Specialties, Inc., Complaint, Civil Action No. 04C 3370, dated May 12, 2004.
RTC Industries, Inc. v. William Merit & Associates, Inc., Complaint, Civil Action No. 04C 1254, dated Feb. 18, 2004.
RTC Industries, Inc. v. William Merit & Associates, Inc, Defendant's Notice of Motion for Partial Summary Judgment of; Non-Infringement that Claims 1-8 of U.S. Pat. No. 4,830,201 are Not infringed, Civil Action No. 04C 1254, dated ; Apr. 29, 2004.
RTC Industries, Inc., v. William Merit & Associates, William Merit & Associates, Inc.'s Statement Under Local Rule 56.1 of Material Facts to Which There is no Genuine Issue, Civil Action No. 04 C 1254, dated Apr. 29, 2004.
RTC Industries, Inc. v. William Merit & Associates, Inc., Defendant's Notice of Motion for Leave to File Memorandum in Support of Motion for Partial Summary Judgment in Excess of Page Limit, Civil Action No. 04 C 1254, dated Apr. 29, 2004.
RTC Industries, Inc. v. William Merit & Associates, Inc., Declaration of William Merit in Support of Defendant's Motion; for Partial Summary Judgment that Claims 1-8 of U.S. Pat. No. 4,830,201 are Not Infringed, Civil Action No. 04 C ; 1254, dated Apr. 29, 2004.
RTC Industries, Inc. v. William Merit & Associates, Inc, RTC Industries, Inc.'s Responses to Defendant William Merit &; Associates, Inc.'s First Set of Requests for Admission to Plaintiff RTC Industries, Inc., Civil Action No. 04 C 1254, ; dated Jun. 1, 2004.
RTC Industries, Inc., v. William Merit & Associates, Inc., RTC Industries, Inc.'s Memorandum in Opposition to William Merit & Associates' Motion for Partial Summary Judgment, Civil Action No. 04 C 1254, dated Jun. 18, 2004.
RTC Industries, Inc. v. William Merit & Associates, Inc., Notice of Filing of Additional Exhibit (The Chesley Patent) to; RTC Industries, Inc.'s Memorandum in Opposition to William Merit & Associates' Motion for Partial Summary ; Judgment, Civil Action No. 04 C 1254, dated Jun. 22, 2004.
RTC Industries, Inc. v. William Merit & Associates, Inc., William Merit & Associates Inc.'s Reply to RTC Industries, Inc.'s Memorandum in Opposition to William Merit & Associates' Motion for Partial Summary Judgment, dated Jul. 2, 2004.
RTC Industries, Inc., v. William Merit & Associates, Inc., Memorandum Opinion, Civil Action No. 04 C 1254, dated Jul. 15, 2004.
RTC Industries, Inc. v. Fasteners for Retail Inc., and CVS Corporation, Reply, Civil Action No. 03C 3137, dated Sep. 17, 2003.
RTC Industries, Inc. v. Fasteners for Retail, Inc. and CVS Pharmacy, Inc., to Vulcan Spring & Mfg. Co., Subpoena in a Civil Case, Case No. 03C 3137 N.D. Illinois, dated Oct. 28, 2003.
RTC Industries, Inc. v. Fasteners for Retail Inc., and CVS Pharmacy, Inc., to Rexam Beauty and Closures, Inc., Subpoena in a Civil Case, Case No. 03C 3137 N.D. Illinois, dated Nov. 11, 2003.
RTC Industries, Inc. v. Fasteners for Retail Inc., and CVS Pharmacy, Inc. to Rexam Cosmetic Packaging, Inc., Subpoena in a Civil Case, Case No. 03C 3137 N.D. Illinois, dated Nov. 11, 2003.
RTC Industries, Inc., v. William Merit & Associates, Inc., Index of Exhibits, Civil Action No. 04 C 1254, dated Jun. 18, 2004.
RTC Industries, Inc. v. Fasteners for Retail Inc., and CVS Corporation, Notice of Motion to Modify and Temporarily Quash Five Subpoenas for Violation of Federal Rule of Civil Procedure 45, Civil Action No. 03C 3137, dated Dec. 8, 2003.
RTC Industries, Inc. v. Fasteners for Retail, Inc. and CVS Pharmacy, Inc., Defendants' Opposition to Plaintifrs Motion; to Modify and Temporarily Quash Five Subpoenas for Violation of Federal Rule of Civil Procedure 45, Case No. 03C; 3137, dated Dec. 10, 2003.
RTC Industries, Inc. v. Fasteners for Retail Inc., and CVS Corporation, RTC Industries' Reply to Defendants'; Opposition to RTC's Motion to Modify and Temporarily Quash Five Subpoenas for Violation of Federal Rule of Civil ; Procedure 45, Civil Action No. 03C 3137, dated Dec. 11, 2003.
RTC Ind. Inc. v. Fasteners for Retail, Minute Order of Dec. 12, 2003 by Honorable Joan B. Gottschall, Case No. 1:03-cv-03137.
RTC Industries, Inc., v. William Merit & Associates, Inc., RTC Industries, Inc.'s Response to William Merit & Associates; Statement under Local Rule 56.1 of Material Facts to Which There is No Genuine Issue and Statement of Additional ; Facts that Require the Denial of Summary Judgment, Civil Action No. 04 C 1254, dated Jun. 18, 2004.
FFR Yellow pp., 2003 product Catalog, "Merchandising Ideas Made Easy for Every Retain Environment," dated 2003. pp. 1-14.
RTC Industries, Inc. v. William Merit & Associates, Inc.—Complaint—dated Feb. 18, 2004 p. 1-11.
RTC Industries, Inc. v. Fasteners for Retaillnc.,Complaint, dated May 12, 2003 p. 1-6.
RTC Industries Inc. v. HMG Worldwide Corporation—Complaint—dated May 31, 2000 p. 1-10.
RTC Industries, Inc. v. Display Specialities, Inc.—Complaint dated May 12, 2004 p. 1-19.
RTC Industries, Inc. v. Semasys, Inc.—Complaint, dated Jun. 17, 2004, p. 1-12.
RTC Industries, Inc. v. Fasteners for Retail, Inc., and Super Valu, Inc. d/b/a Cub Foods, Complaint, dated Dec. 18, 2005 ; p. 1-25.
VIDPRO International, Inc. v. RTC Industries, Inc.—Original Complaint—dated Jun. 2, 1995, p. 1-28.
European Search Report for Application No. 14164097 (011610. 00544) dated Jun. 11, 2014, 6 pages.
Jul. 10, 2015—(PCT) International Search Report—PCT/US2015/024482.
Aug. 25, 2015—(EP) Office Action—App 12772157.9.

* cited by examiner

FIG. 3
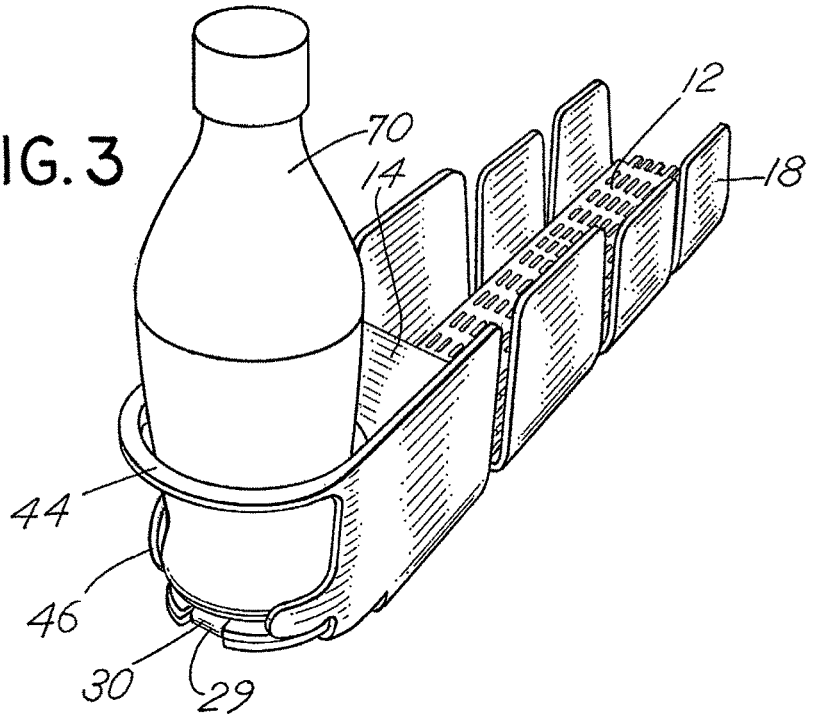
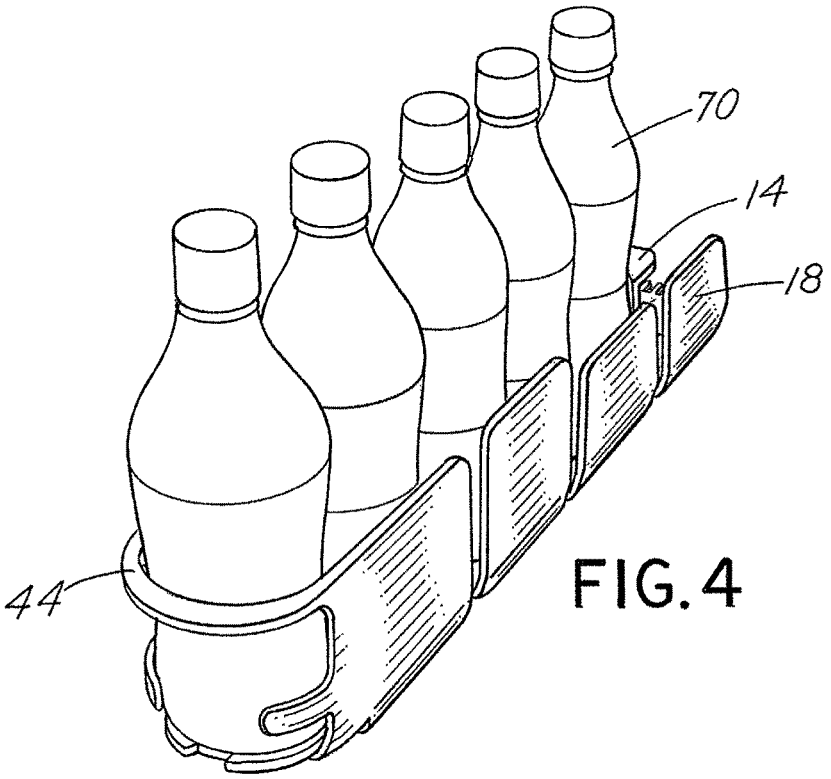
FIG. 4

FIG.9
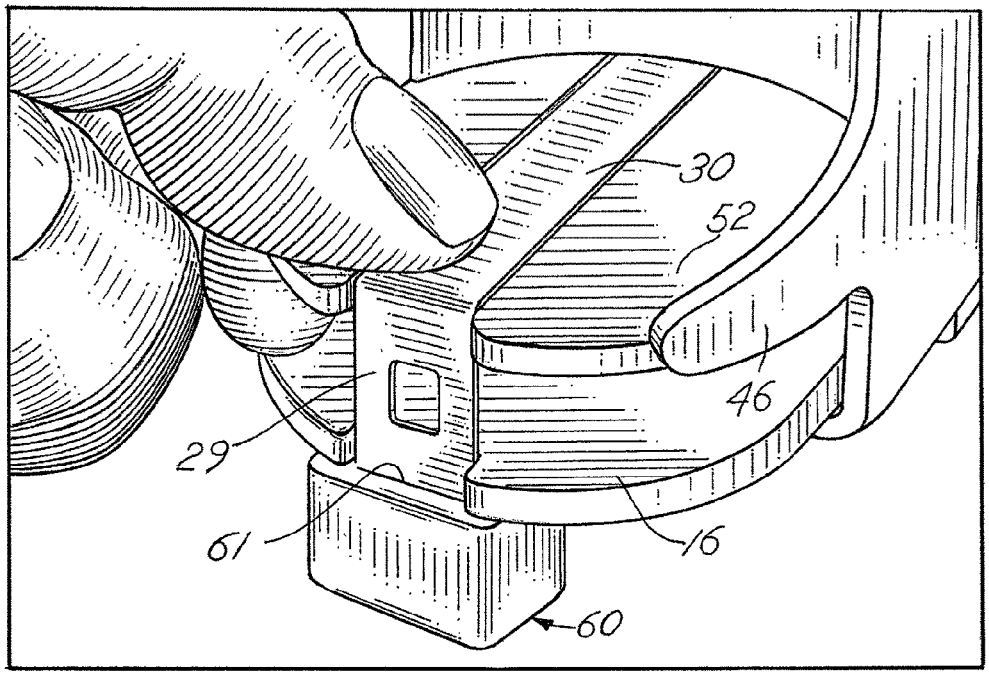
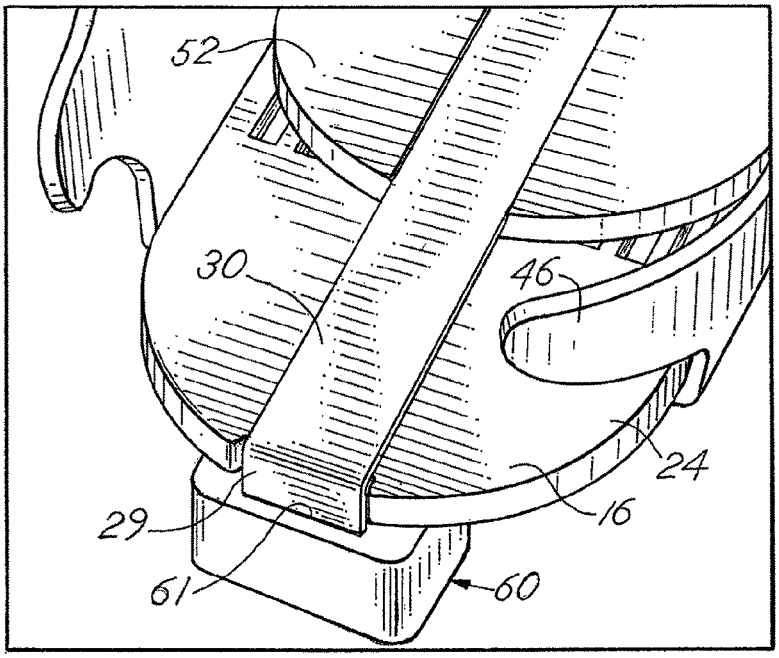
FIG.10

FIG.11
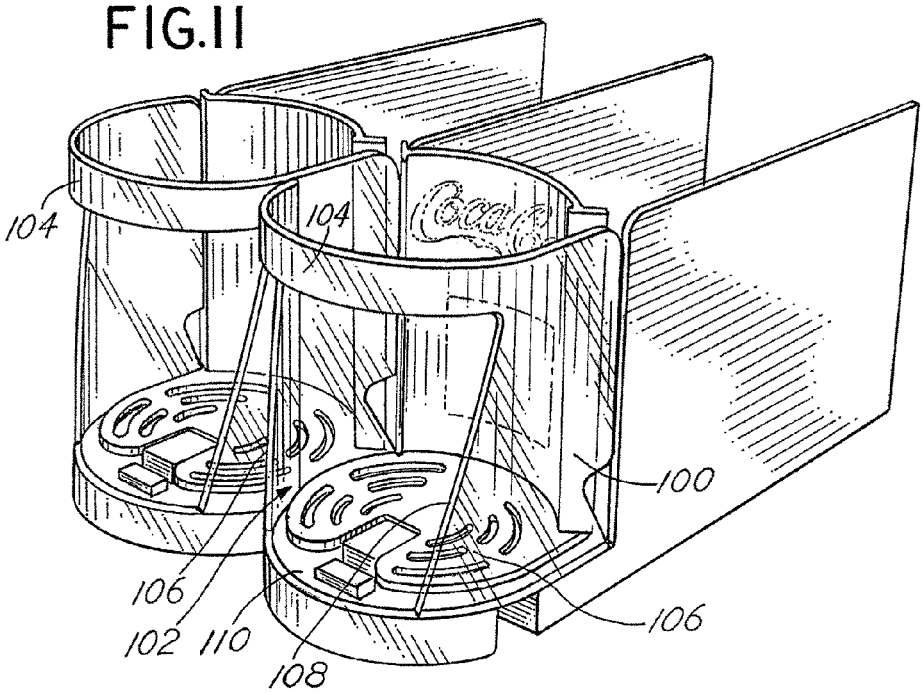
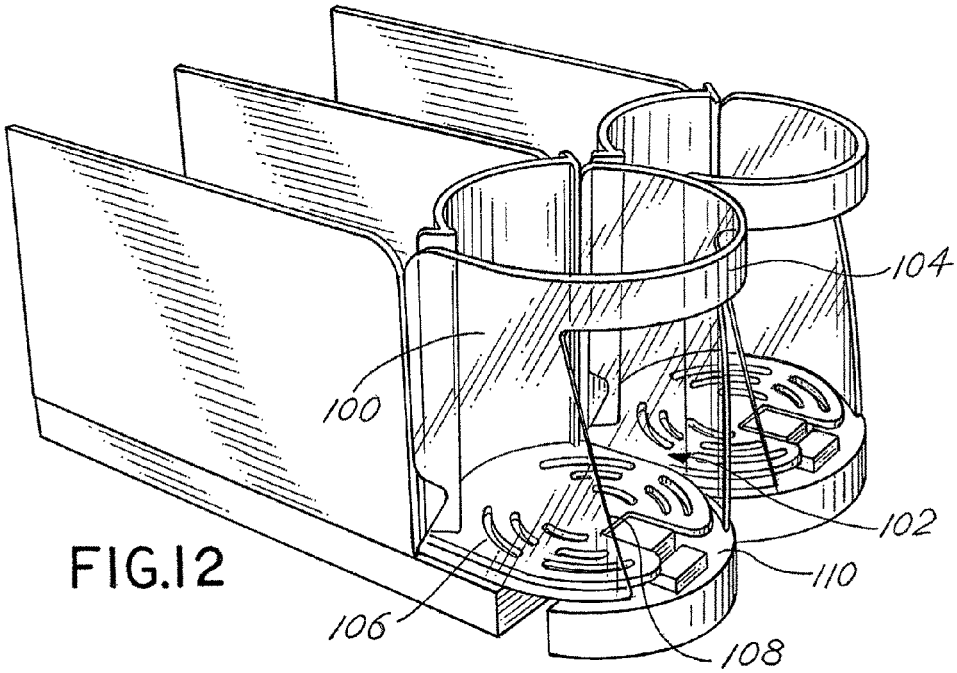
FIG.12

FIG.13
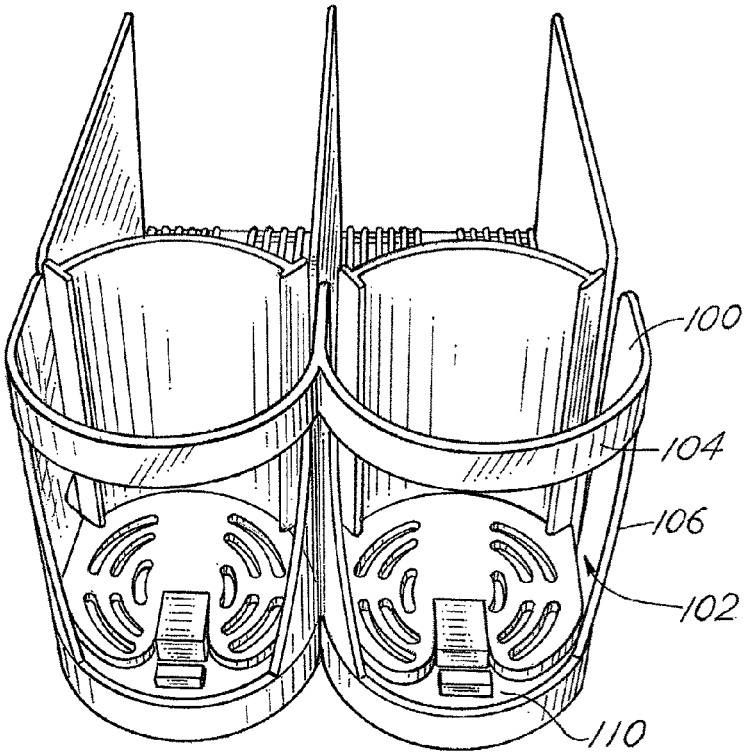
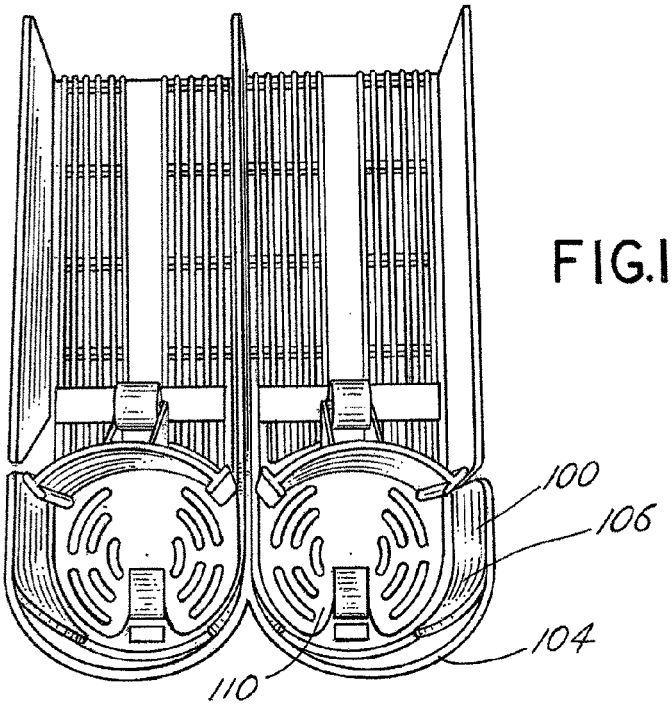
FIG.14

FIG. 21
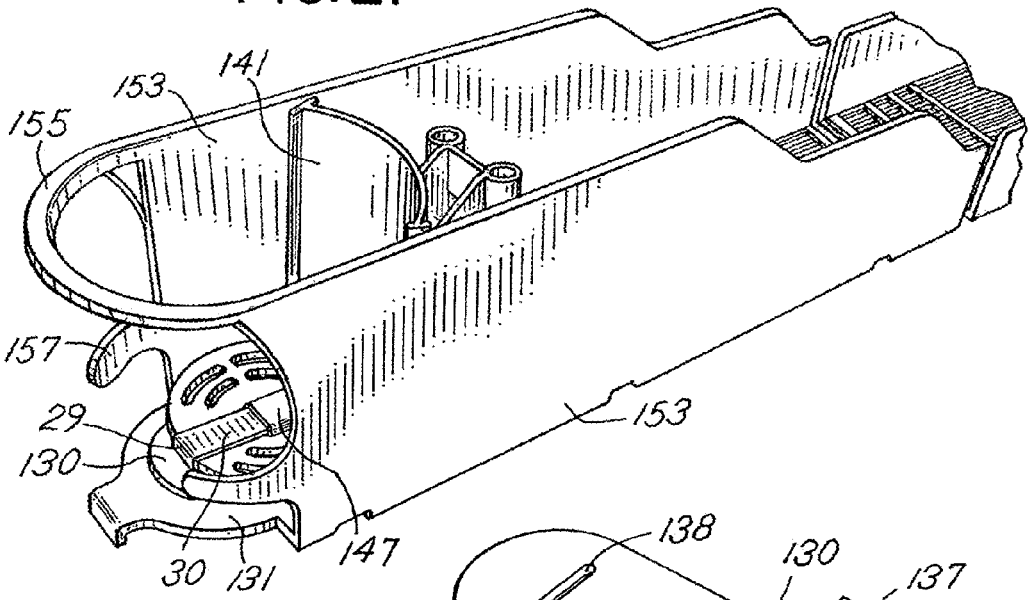
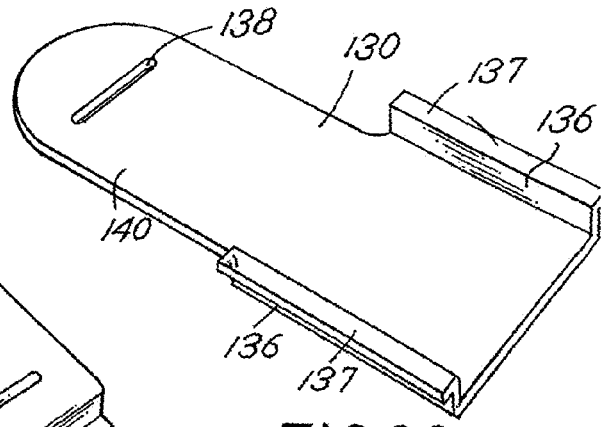
FIG. 22
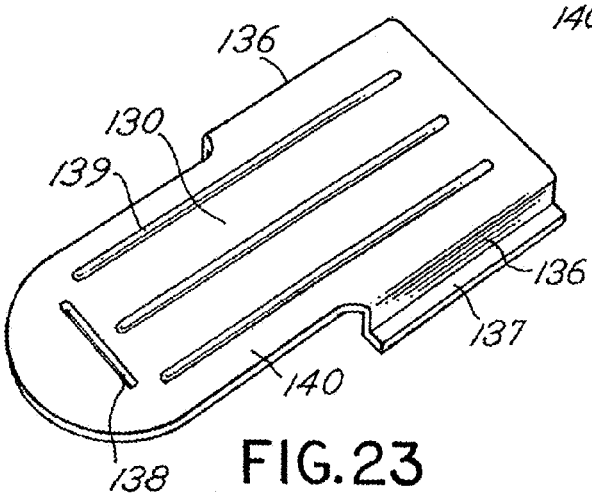
FIG. 23

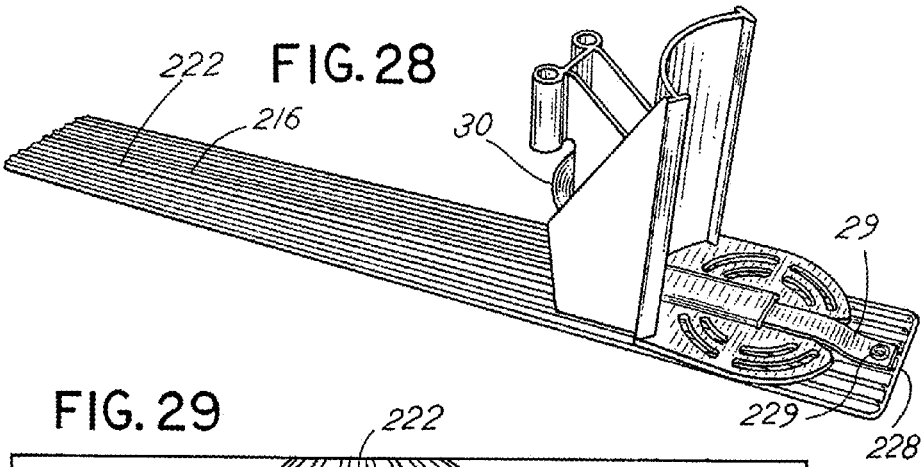
FIG. 28
FIG. 29
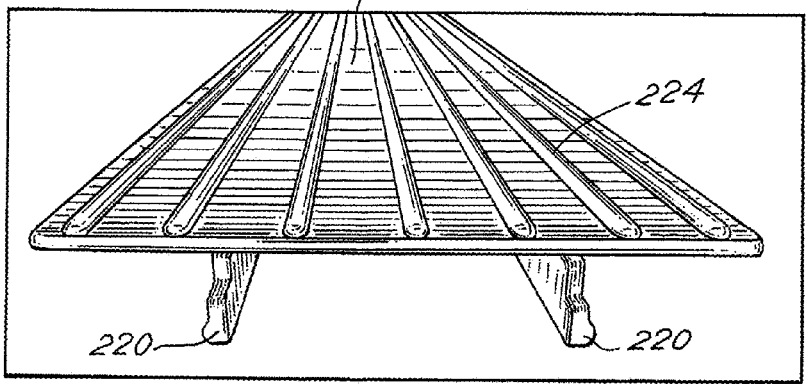
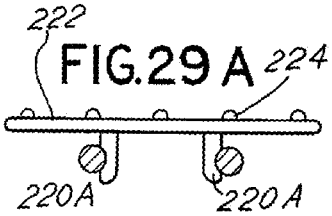
FIG. 29 A
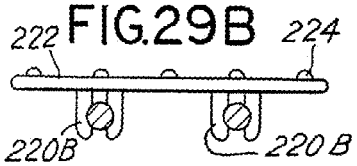
FIG. 29B
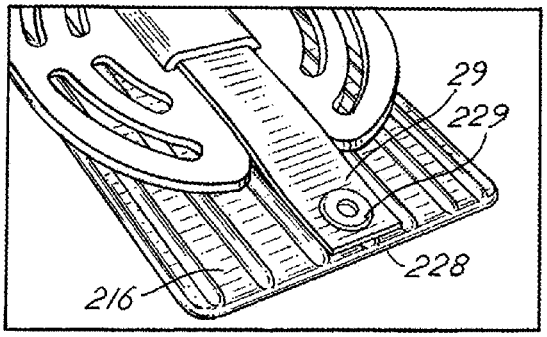
FIG. 30

FIG.31
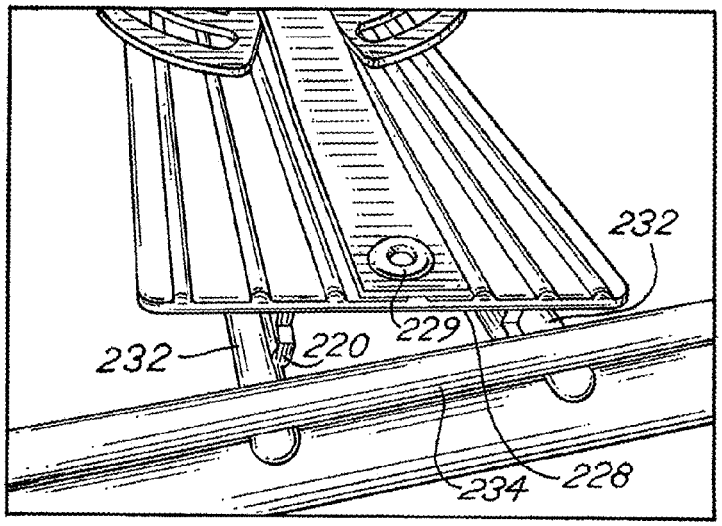
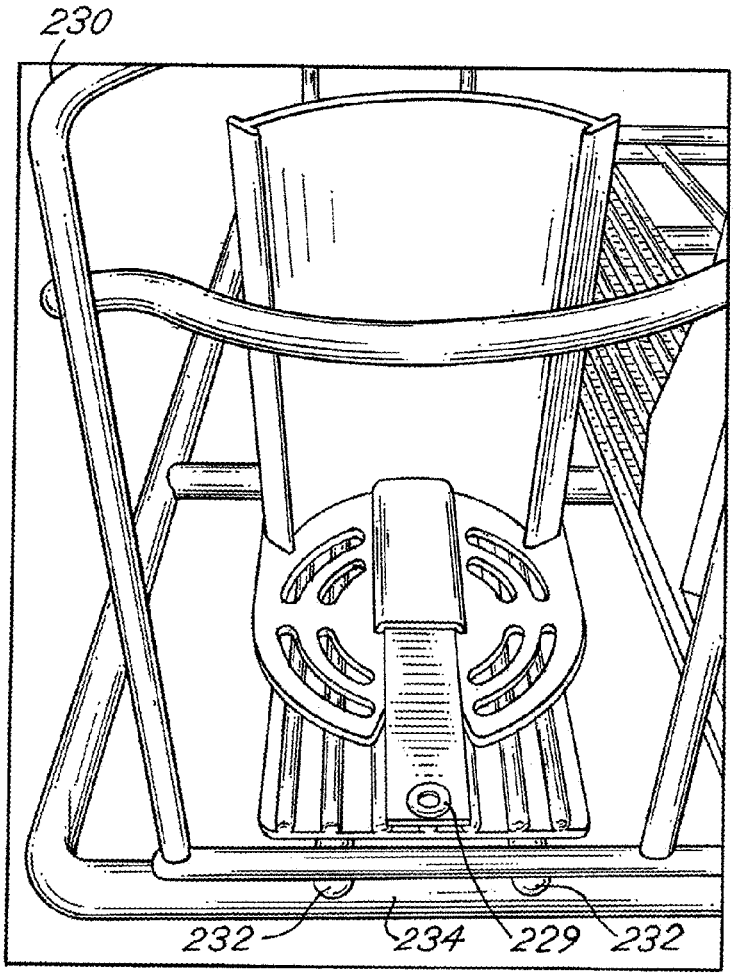
FIG.32

PRODUCT MANAGEMENT DISPLAY SYSTEM WITH TRACKLESS PUSHER MECHANISM

CROSS REFERENCE TO RELATED APPLICATION

This Application is a continuation-in-part of U.S. application Ser. No. 14/012,715 filed on Aug. 28, 2013, which is a continuation of U.S. application Ser. No. 13/542,419 filed on Jul. 5, 2012, now U.S. Pat. No. 8,739,984, which claims benefit to U.S. Provisional Application Nos. 61/530,736 filed Sep. 2, 2011, 61/542,473 filed Oct. 3, 2011, and 61/553,545 filed Oct. 31, 2011, and is also a continuation-in-part of U.S. application Ser. No. 12/639,656 filed Dec. 16, 2009, now U.S. Pat. No. 8,322,544, which is a continuation-in-part application of U.S. application Ser. No. 12/357,860 filed Jan. 22, 2009, now U.S. Pat. No. 8,453,850, which is a continuation-in-part application of U.S. application Ser. No. 11/760,196 filed Jun. 8, 2007, now U.S. Pat. No. 8,312,999, which is a continuation-in-part application of U.S. application Ser. No. 11/411,761 filed Apr. 25, 2006, now U.S. Pat. No. 7,823,734, which claims benefit to U.S. Provisional Application Nos. 60/716,362 filed Sep. 12, 2005 and 60/734,692 filed Nov. 8, 2005, all the above listed applications are incorporated herein fully by reference.

FIELD

The exemplary embodiments of this disclosure relate generally to a shelf assembly for use in merchandising product and more particularly to a shelf assembly having improved mechanisms for displaying and pushing product on the shelves.

BACKGROUND

It is known that retail and wholesale stores, such as convenience stores, drug stores, grocery stores, discount stores, and the like, require a large amount of shelving both to store product and to display the product to consumers. In displaying product, it is desirable for the product on the shelves to be situated toward the front of the shelf so that the product is visible and accessible to consumers. In the case of coolers or refrigerators that are used to store and display such products as soft drinks, energy drinks, bottled water, and other bottled or canned beverages, it is desirable for these products to also be situated toward the front of the shelf and visible and accessible to the consumers.

To accomplish this placement of product, known systems may include inclined trays or floors that through gravity will cause the product to move toward the front of the shelf. Many of these systems include floors or shelves made of a plastic material such as polypropylene that due its low coefficient of friction permit the product to easily slide along the inclined floor or surface. However, over time, these surfaces can become obstructed with debris or sticky substances that inhibit the product from properly sliding, sometimes causing several products to tip over thus blocking additional product from moving to the front of the shelf.

Other systems include the use of a pusher system to push the product toward the front of the shelf as the product at the front of the shelf is removed. The known pusher systems are typically mounted to a track and include a pusher paddle and a coiled spring to urge the product forward. Occasionally, as the system is used, and over time, the track becomes obstructed with dirt or sticky materials that hinder the proper operation of the pusher system in the track. In addition, depending on the size, shape and weight of the product to be merchandised, the known pusher paddles may occasionally tip or bend backwards, thereby causing a binding of the pusher mechanism in the track. In those situations, the pusher mechanism may not properly push product toward the front of the shelf.

Certain examples discussed herein are directed at providing a trackless pusher system that works with gravity-fed merchandise systems (i.e., inclined shelves or trays) and non-gravity-fed merchandise systems.

SUMMARY

One exemplary embodiment is directed to a product management display system for merchandising product on a shelf. This embodiment includes using a trackless pusher mechanism that travels along a surface on which product is placed. The trackless system overcomes the known problems with the use of tracks to hold and guide the known pusher mechanisms. It should be understood however that the teachings of this embodiment may be used with systems that include tracks for mounting a pusher mechanism or the like.

The pusher mechanism can include a pusher paddle and a floor that extends forward of the pusher paddle. A flat coiled spring or other biasing element can be operatively connected behind the pusher paddle and extend across the floor of the pusher mechanism and to the front of the shelf. Alternatively, the flat coiled spring or biasing element can extend across the divider to the front of the shelf assembly. With this configuration, the pusher paddle is prevented from tipping or bending backwards during operation.

An exemplary embodiment also includes the use of a pushing mechanism with the merchandising of product on horizontal or non-inclined shelves or surfaces, as well as with gravity-fed systems, or systems that use gravity as a mechanism to urge product toward the front of the shelf.

In accordance with an exemplary illustrative embodiment of the invention, the pusher paddle may define a concave pushing surface for pushing cylindrical products, such as soft drink bottles or cans. Alternatively, the pusher paddle may define a flat pushing surface that may further include at its upper edge a curved rib or similar structure that can also be used to push cylindrical products.

In accordance with another exemplary illustrative embodiment of the invention, the floor of the pusher mechanism can include a notched or cut-out portion to align the pusher mechanism relative to the coiled spring. Also, the floor of the system also can include a notch or cut-out portion for receiving and mounting a flat end of the coiled spring to the floor. A spring tip may be placed on the end of the coiled spring to mount the coiled spring to the floor of the system. Alternatively, the end of the coiled spring can mount to the divider of the assembly.

In accordance with yet another exemplary embodiment, an adaptor for a product management display system may be positioned on a floor surface of the display system. The adaptor may include a planar surface with at least two ribs extending outwardly from the planar surface and across the planar surface in a substantially parallel manner. A coiled spring may be positioned between the parallel extending ribs. With this configuration, product to be merchandised may sit on the ribs, and not directly on the coiled spring, to enhance the forward movement of certain types of product, such as cans of a beverage.

In yet another alternative aspect, a mounting member may be used to mount the end of the coiled spring to the floor of the system. For those systems that include spaced-apart glide rails that are joined together by connecting ribs, the mounting member may be snap-fit to or otherwise mounted on the floor and between the glide rails.

In yet another alternative aspect, the trackless pusher system is retrofitted into an existing shelf assembly. This allows for the placement of the trackless pusher system in an existing shelving system as a low cost alternative to purchasing the entire trackless pusher assembly.

In another exemplary embodiment, the coil spring can be mounted to the retainer. An end of the coil spring can be directly mounted to the retainer or alternatively the end can be mounted to the retainer via an adapter. The adapter can have a curved portion which is received in a correspondingly shaped curved slot in the retainer to secure the end of the spring to the display assembly.

In another exemplary embodiment, the trays can be attached via a dovetail connection to form a shelf assembly. Additionally the dividers can be adjusted such that the width of the product rows can be adapted to receive different sized products.

In accordance with yet another exemplary embodiment, the product management display system can be arranged in a stackable arrangement. The assembly can be provided with a first tray and a second tray each having a first wall and a second wall. The first and second trays are each adapted to receive a pusher mechanism, and a retainer mechanism. First and second spacers are mounted to the first and second trays for stacking the first and second trays on top of one another. The first and second spacer can be provided with a plurality of detents, and the first tray and the second tray can each be provided with a plurality of correspondingly shaped sockets for receiving the plurality of detents.

Another example pusher mechanism for a product management display system having a surface may include a pusher surface, a product retainer extending parallel to the pusher surface, a pusher floor extending forwardly from the pusher surface, the pusher floor configured to permit at least one product to sit upon the pusher floor, the pusher floor positionable on and movable across at least a portion of the surface of the display system, and a coiled spring. The pusher mechanism can sit on top of and may not extend below the surface of the display system, is positionable on a surface of the display system, and is mounted to and held onto the display system by the coiled spring. The coiled spring can include a coiled end which is positioned behind the pusher surface. The pusher floor can be substantially parallel to the surface of the display system. The pusher surface and the product retainer may extend upwardly from the pusher floor, the product retainer can be spaced apart from the pusher surface such that the pusher surface, the product retainer and the pusher floor define a space for receiving at least one product therein. The product can be a bottle and the bottle can be configured to fit between the pusher surface and the product retainer. Only one bottle can be permitted to fit between the pusher surface and the product retainer. The pusher surface can be concave shaped. The pusher floor can define channel for receiving a coiled spring. The coiled spring can be extendable across at least a portion of the pusher floor and operatively attached behind the pusher surface. The pusher mechanism can be mounted to the surface of the display system only by the coiled spring.

Another product management display system may include a tray defining a surface configured to hold a row of products, a first product retainer configured to prevent product from falling off of the tray, a pusher mechanism having a pusher surface, a second product retainer extending parallel to the pusher surface. The pusher mechanism can be configured to slide across at least a portion of the surface of the tray and may have a coiled spring with a coiled end positioned behind the pusher surface and a front end, and at least one divider for maintaining the products in a row. The pusher mechanism can be configured to sit on top of and not extend below the surface of the tray. The pusher mechanism can be mounted to the surface of the display system by the coiled spring. The pusher surface and the second product retainer can be configured to extend upwardly from the pusher floor, and the product retainer can be spaced apart from the pusher surface for receiving at least one product therein. The pusher surface and the second product retainer can define a space that can be configured to receive a last one of the row products. In one example, the product is a bottle, and the pusher surface and the second retainer are configured to receive only one bottle, and the second product retainer can be configured to hold the last one of the plurality of products.

The pusher surface and the second product retainer can define a space that is configured to receive a product. The product can be a bottle and the space can be configured to receive only one bottle. The pusher mechanism can be mounted to the surface of the display system only by the coiled spring. The product management display system can further include a first divider and a second divider, and the first product retainer and the second product retainer can be configured to extend between the first divider and the second divider. At least a portion of the coiled spring can be configured to extend across at least a portion of the tray surface to a front portion of the tray. The surface of the display system can be horizontal. The first product retainer and the second product retainer can be transparent.

Another example product management display system may include a tray defining a surface, a first product retainer configured to prevent product from falling off of the tray, and a pusher mechanism. The pusher mechanism can include a pusher surface, a second product retainer, and a pusher floor extending forwardly from the pusher surface. The pusher floor can be configured to permit at least one product to sit upon the pusher floor between the pusher surface and the second product retainer, and the pusher floor can be positionable on and movable across the surface of the display system. The pusher mechanism can be configured to sit on top of and not extend below the surface of the display system, and can be configured to be mounted to and held onto the display system by the coiled spring and can be mounted to and held onto the display system only by the coiled spring. The second product retainer can be configured to hold the last one of the plurality of products. The pusher surface can be concave shaped. The pusher floor can define a plurality of apertures. The pusher floor and the second product retainer can be configured to hold a single bottle.

BRIEF DESCRIPTION OF THE DRAWINGS

FIG. 3 depicts another isometric view of the system of FIG. 2 with product placed in the system.

FIG. 4 depicts another isometric view of the system of FIG. 2 with multiple product placed in the system.

FIG. 9 depicts the exemplary tip of FIG. 7 being mounted to an end of a coiled spring.

FIG. 10 depicts the exemplary tip of FIG. 7 mounted to an end of a coiled spring.

FIG. 11 depicts an isometric view of an alternative exemplary embodiment of a product management display system of the present invention.

FIG. 12 depicts another isometric view of the system of FIG. 11.

FIG. 13 depicts a front view of the system of FIG. 11.

FIG. 14 depicts a top view of the system of FIG. 11.

FIG. 21 depicts an isometric view of an alternative exemplary embodiment of a product management display system of the present invention.

FIG. 22 depicts an isometric bottom view of an exemplary mounting member that may be used to mount the end of the coiled spring to the floor of the display system.

FIG. 23 depicts an isometric top view of the exemplary mounting member of FIG. 22.

FIG. 28 depicts an isometric view of an alternative exemplary embodiment of a product management display system of the present invention.

FIG. 29 depicts a close-up isometric view of the tray of the exemplary embodiment of FIG. 28.

FIG. 29A depicts a cross-sectional view of the exemplary embodiment of FIG. 28 illustrating a first securing method.

FIG. 29B depicts a cross-sectional view of the exemplary embodiment of FIG. 28 illustrating a second securing method.

FIG. 30 depicts a close-up isometric view of the embodiment of FIG. 28 illustrating the rivet attaching the spring to the tray.

FIG. 31 depicts an isometric view of the embodiment of FIG. 28 being assembled in a preexisting wire shelf.

FIG. 32 depicts an isometric view of the embodiment of FIG. 28 assembled in a preexisting wire shelf.

Figure 1:
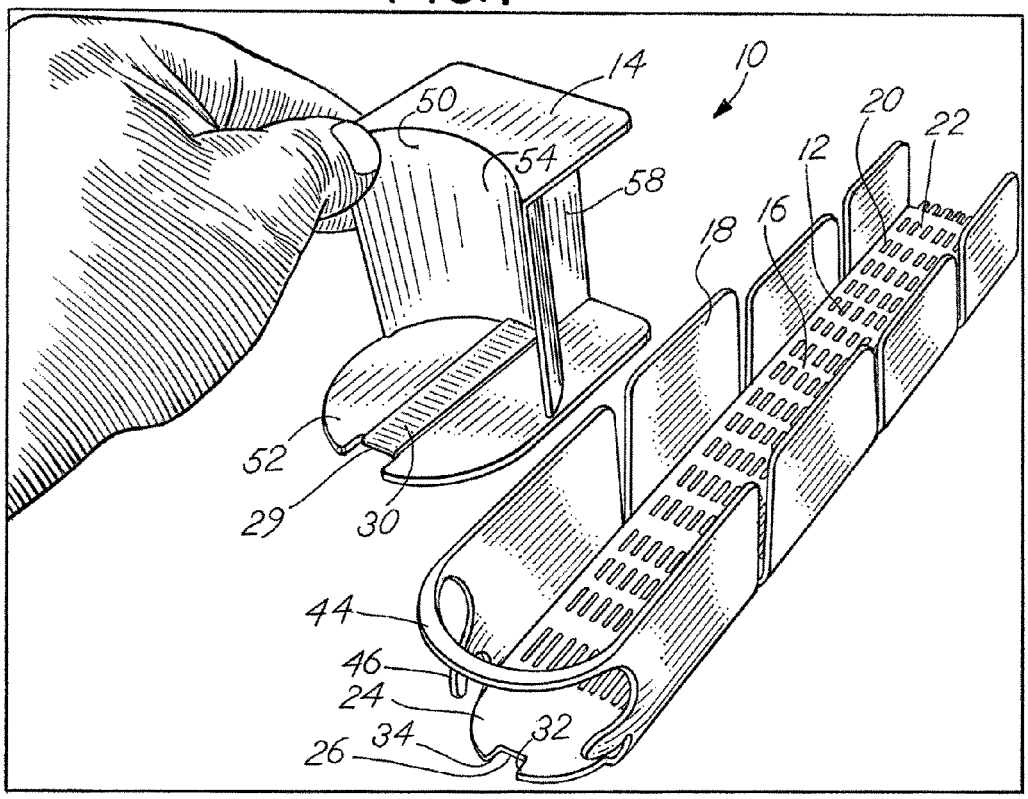
FIG. 1 depicts an isometric exploded view of an exemplary embodiment of a product management display system of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, the use of the term "mount," "mounted" or "mounting" is meant to broadly include any technique or method of mounting, attaching, joining or coupling one part to another, whether directly or indirectly.

DETAILED DESCRIPTION OF THE EMBODIMENTS

The invention may be embodied in various forms. Referring to the Figures wherein like numerals indicate like elements, there is depicted in FIG. 1 an isometric exploded view of an exemplary embodiment. Exemplary merchandise system 10 includes a product dispensing tray 12 in which is mounted an exemplary trackless pusher mechanism 14. As described in more detail below, the pusher mechanism 14 will fit in the tray 12 and will slide along the surface of the tray without the use of tracks, rails, or guides typically used to hold a conventional pusher mechanism to the tray or floor of the tray. The pusher mechanism defines a pusher paddle and a pusher floor that extends forward of the pusher paddle. A coiled spring may extend across the pusher floor and operatively connect to the tray at a forward position on the tray. In one aspect of the invention, product to be merchandised may be placed in the tray in front of the pusher paddle and may sit on the pusher floor as well as the coiled spring. With this configuration, the weight of the product will prevent the pusher paddle from tipping to ensure proper pushing of the product. In addition, the problems associated with debris or sticky materials hindering the effectiveness of known pusher systems that use tracks, rails or guides have been eliminated. Other aspects, embodiments and features of the invention and its teachings are set forth in more detail below.

The exemplary tray 12 may define a surface 16 and one or more dividing panels or dividers 18 to separate the tray into numerous rows for placement of product. In an alternative aspect, the tray 12 may be a shelf or any other surface on which products may be placed for merchandising. The surface 16 may be a solid surface or a surface defining a plurality of spaced-apart apertures 20 separated by a plurality of support ribs 22. The apertures 20 and ribs 22 provide a surface that permits the slidable movement of product placed on this surface and also permits liquids and dirt to pass through the apertures 20 so that they do not collect on the surface 16. The surface 16 may be made of any suitable material that permits the slidable movement of product on the surface 16. Other surface or floor configurations are known and may be used with the principles of the invention.

As depicted in FIGS. 9 and 10, the surface 16 may define a rounded end portion 24 that includes a notch or cut-out portion 26. The end portion 24 may be rounded to match the shape of the product that is placed on the tray. For example, the depicted end portion 24 is rounded or defines a semi-circular shape to match the contour of a bottle or can that may be placed in the tray and on the end portion 24. Other shapes of the end portion may be used with the disclosure depending on the product to be merchandised.

The notch 26 may be used to receive and mount an end 29 of a coiled spring 30 or similar biasing element. The notch 26 may define opposing angled edge surfaces 32 that are joined by edge 34. The edge 34 is preferably centered across the width of the product row formed in the tray 12 and extends perpendicular to the length of the tray. This configuration will center the coiled spring 30 relative to the tray 12 and will permit the spring to extend in a substantially parallel manner relative to the length of the tray. In other words, the depicted edge 34 of the notch 26 will permit the spring 30 to extend along the length of the tray 12 at or near the center of the product row formed by the tray. One skilled in the art will appreciate that the location and configuration of the notch may vary depending on the desired placement of the spring.

The coiled spring 30 may define an end 29 that is configured to be placed across the notch 26 and onto the edge 34. In one aspect, the end 29 of the coiled spring may be V-shaped and function as a hook such that the end 29 will wrap around the edge 34 with a portion of the end 29 of the coiled spring extending beneath the end portion 24 of the surface 16. This configuration permits an easy installation of the coiled spring onto the tray.

Figure 7:
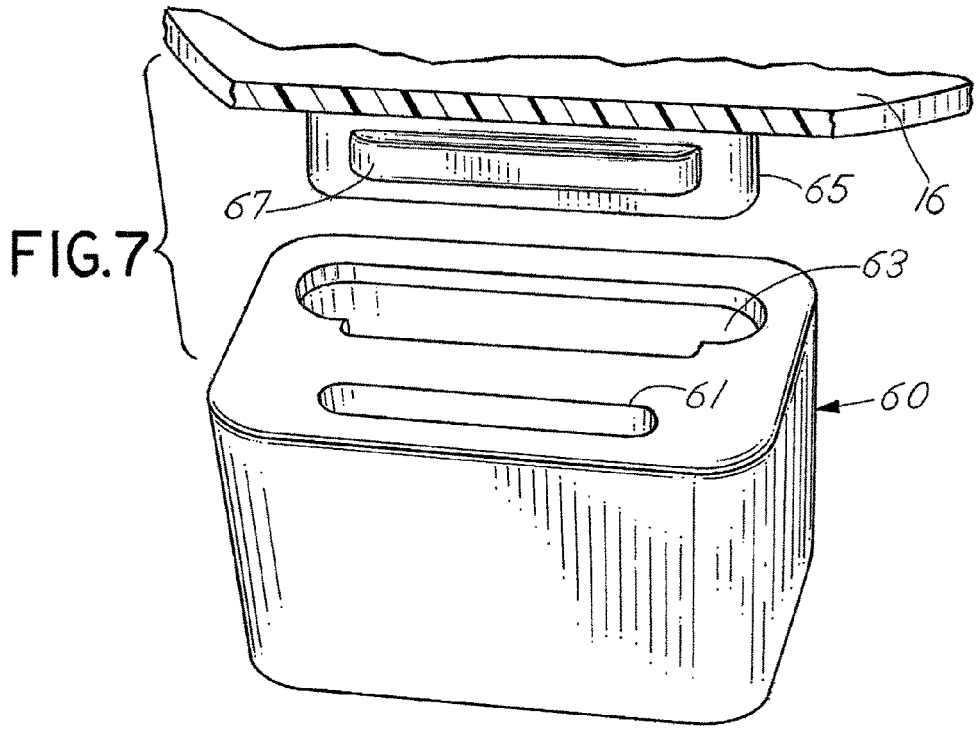
FIG. 7 depicts an exemplary tip for an end of a coiled spring that may be used with the product management display system of the invention.

In another aspect, and referring to FIG. 7, a spring tip 60 may be added to the end 29 of the spring 30 to assist with the mounting of the spring to the system. The spring tip 60 may define numerous shapes and configurations depending on the configuration of the tray and the surface on which the spring end needs to attach. The spring tip 60 may be permanently attached to the end 29 of the coiled spring 30 or it may be detachable to permit the interchange or replacement of the spring tip 60. The spring tip 60 may be made of plastic and may define one or more apertures. Aperture 61 may be used to receive the end 29 of the coiled spring 30. A second aperture 63 may be used to receive a mating tongue or mounting member 65 extending from the surface 16 of the tray 12, as discussed below. With this configuration, the end 29 of the coiled spring 30 may be operatively connected to the tray 12.

In another aspect, the end 29 of the coiled spring may snap-fit into an aperture formed in the surface 16, or may be otherwise inserted and secured to an aperture or opening in the tray, thereby securing the end 29 of the coiled spring 30 in position.

Referring back to FIG. 1, dividers 18 may also be used to separate product into rows. The dividers 18 extend substantially upwardly from the surface 16 and as illustrated in FIG. 1, may be positioned on opposing sides of the surface 16. Alternatively, the dividers 18 may be positioned at any desired position on the tray 12 or to the surface 16. The dividers 18 may be formed as a unitary structure with the surface 16, or the dividers 18 may be detachable to provide added flexibility with the system. The dividers may be attached to a front or back rail depending on the system. The dividers 18 may define numerous configurations and may extend upwardly any desired distance to provide the desired height of the dividers between the rows of product to be merchandised. This height may be adjustable by adding divider extenders or the like.

Figure 6:
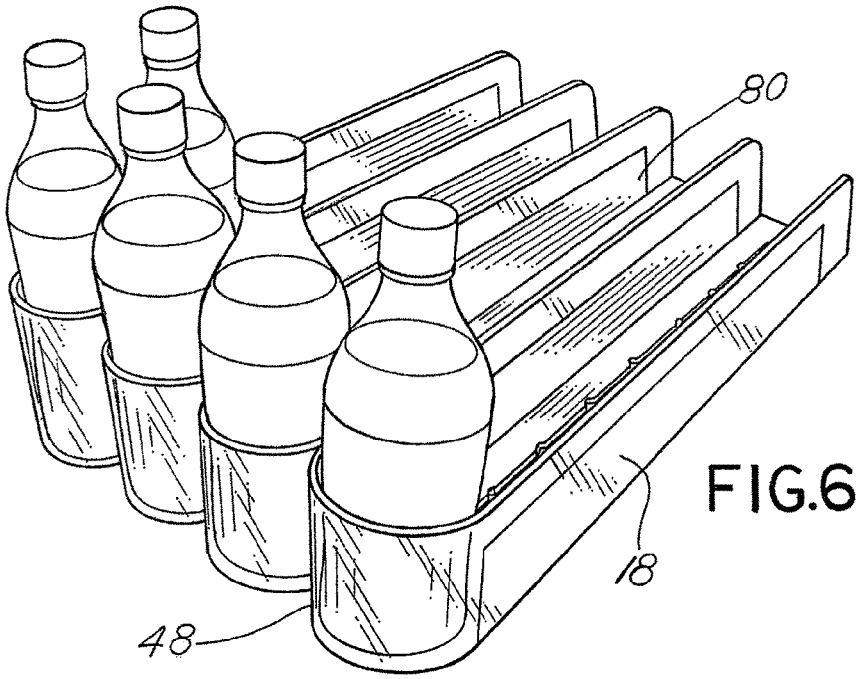
FIG. 6 depicts an alternative embodiment of the tray or product channel of the present invention.

Located at the front of the tray 12 and extending between the dividers 18 may be one or more product-retaining members 44. The product-retaining members 44 serve as a front retaining wall or bar to hold the product in the tray 12 and to prevent the product from falling out of the tray 12. These members are also configured to permit the easy removal of the forward-most product positioned in the tray 12. The product-retaining member 44 may be one or more curve-shaped retaining ribs as depicted in FIG. 1. These illustrated retaining ribs may extend from one divider to another divider thereby joining the dividers. The retaining ribs may also extend part-way between the dividers, as also shown in FIG. 1 as rib 46, to also assist in retaining the product in the tray. Alternatively, and as shown in FIG. 6 the product-retaining member 44 may be a curve-shaped solid retaining wall 48 that extends between dividers. The retaining wall 48 may be transparent or semi-transparent to permit visualization of the product on the shelf. In another aspect, the retaining wall 48 may also extend part-way between the dividers 18. In yet another embodiment depicted in FIGS. 11-15, the retaining wall 100 may be attached to the surface of the tray and not connect to the dividers. In this embodiment, the retaining wall 100 may form an opening 102 defined by an upper member 104, opposing, curved side walls 106 that further define an angled edge 108, and a floor member 110. The side walls 106 may also be straight and not curved depending on the system. The end of the coiled spring may also snap-fit into the floor 110 or otherwise attached to the tray using any of the techniques described herein. One of skill in the art will readily appreciate that there are numerous shapes and configurations possible for the product-retaining member 44 and that the depicted configurations are merely exemplary embodiments of these numerous configurations.

Referring back to FIG. 1, the exemplary trackless pusher mechanism 14 defines a pusher paddle 50 and a pusher floor 52. The pusher paddle 50 and pusher floor 52 may be formed as a single, unitary structure or may be separate structures that are joined together using known techniques. In addition, the pusher paddle 50 and pusher floor 52 may be made of any known suitable plastic or metal material. The pusher paddle and pusher floor may be reinforced using any known reinforcing techniques.

Figure 5:
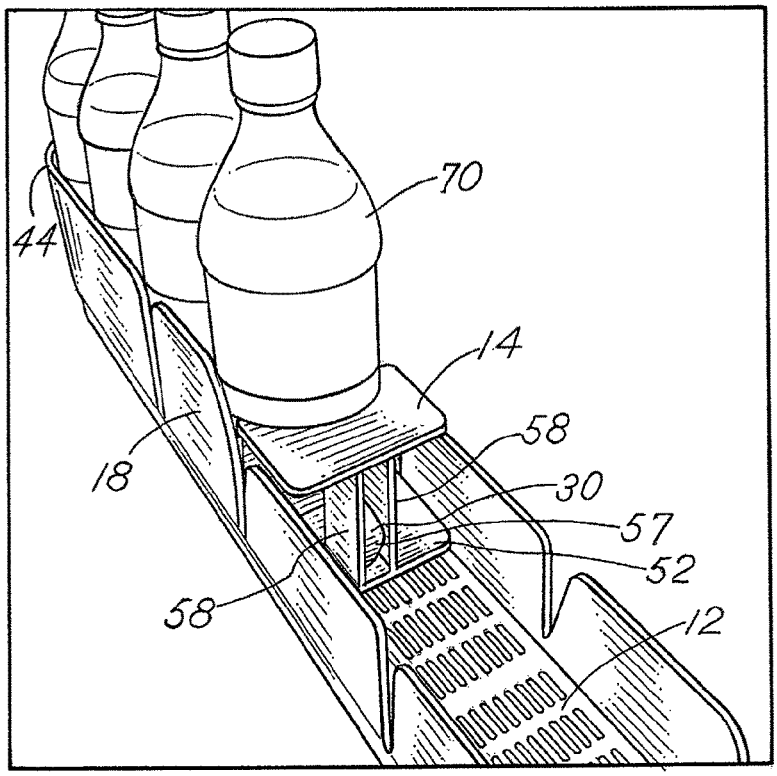
FIG. 5 depicts an isometric rear view of the system of FIG. 4.

In one aspect, the pusher paddle 50 forms a curved-shape pusher surface or face 54 that is configured to match the shape of the product to be merchandised, such as plastic bottles or cans containing a beverage, as depicted in FIGS. 3-5. The curve-shaped pusher surface 54 permits the pusher to remain centrally aligned with the last product in the tray. This configuration reduces friction and drag between the pusher and the divider walls. In an alternative aspect, the pusher surface or face may be a flat surface. In yet another aspect, the flat pusher surface may be accompanied by a curved shaped rib that is positioned near or on the top of the pusher paddle and that may be used to center and align product in the tray, in a manner similar to the curve-shaped pusher surface 54 depicted in FIG. 1. The curve shaped rib may define other shapes and configurations that permit cylindrical or similar shaped products to be properly pushed in the tray. Advertisement, product identification or other product information may be placed on the pusher surface 54.

Positioned behind the pusher surface or face 54 may be one or more support members 58, such as ribs, walls, or gussets. The support members 58 are configured to support the pusher surface 54 and further connect the pusher paddle 50 to the pusher floor 52. As can be seen in FIG. 5, positioned between the support members 58 is the coiled spring 30, and more specifically the coiled end 57 that is used to urge the pusher paddle 50 forward and along the tray 12, as understood in the art. Any technique used to operatively connect the coiled spring to the pusher paddle 50 may be used with the invention.

As shown in FIG. 1, the pusher floor 52 may be positioned below the pusher paddle 50 and may extend forward of the pusher surface 54 of the pusher paddle. The pusher floor 52 may extend any predetermined distance and at any predetermined angle. For example, the pusher floor 52 may extend substantially perpendicular to the pusher surface 54. In the exemplary embodiment, the pusher floor 52 may extend a sufficient distance to permit one product, such as a single bottle or can, to be placed on the pusher floor. In another aspect, the pusher floor 52 may be configured to permit more than one product to be placed on the pusher floor. The pusher floor 52 may define any shape, including the depicted round shape and may define any product retaining features on the surface of the pusher floor, such as ribs, walls, or the like, to further hold the product on the pusher floor.

Figure 2:
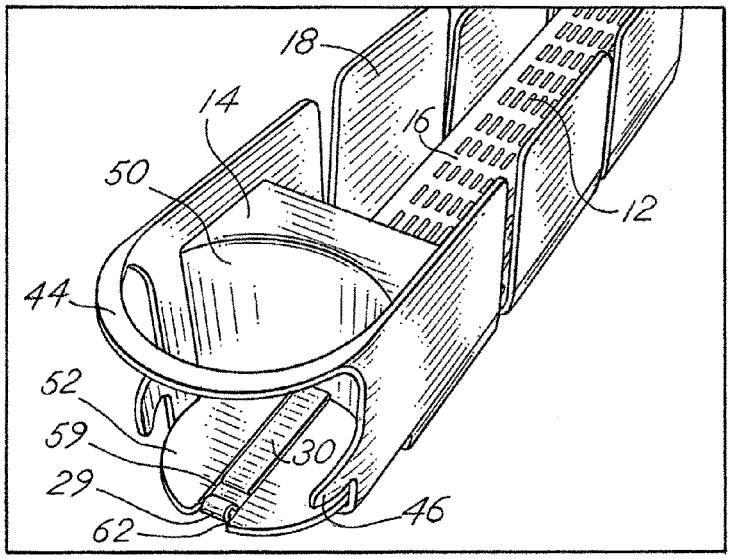
FIG. 2 depicts an isometric view of an exemplary pusher mechanism mounted to an exemplary tray or product channel of the present invention.
Figure 19:
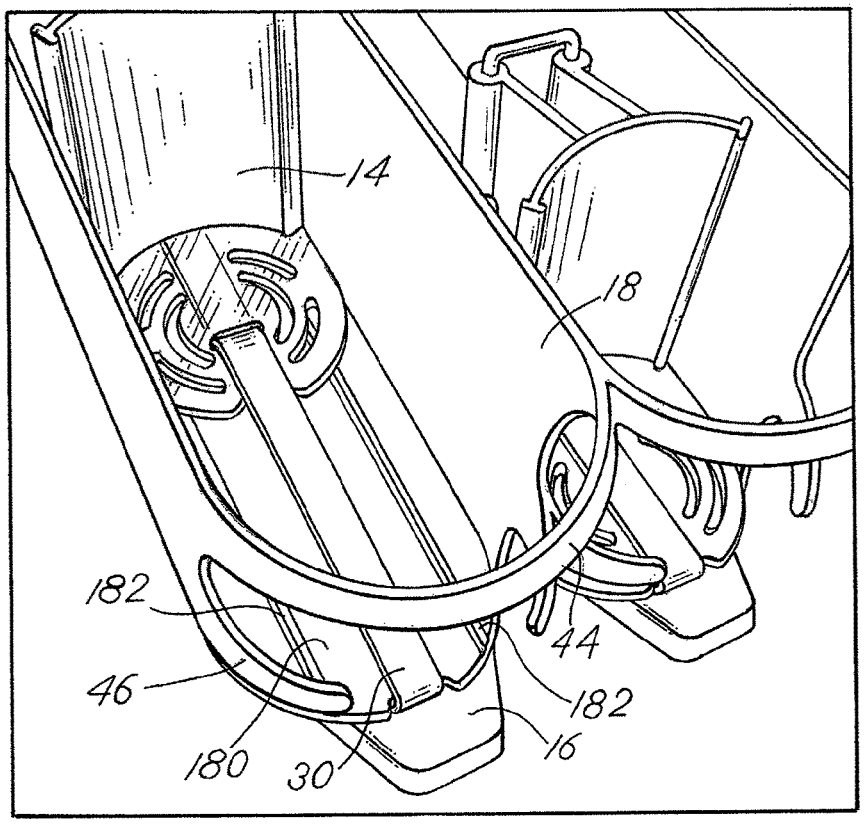
FIG. 19 depicts an isometric view of an installed adaptor of the invention.
Figure 20:
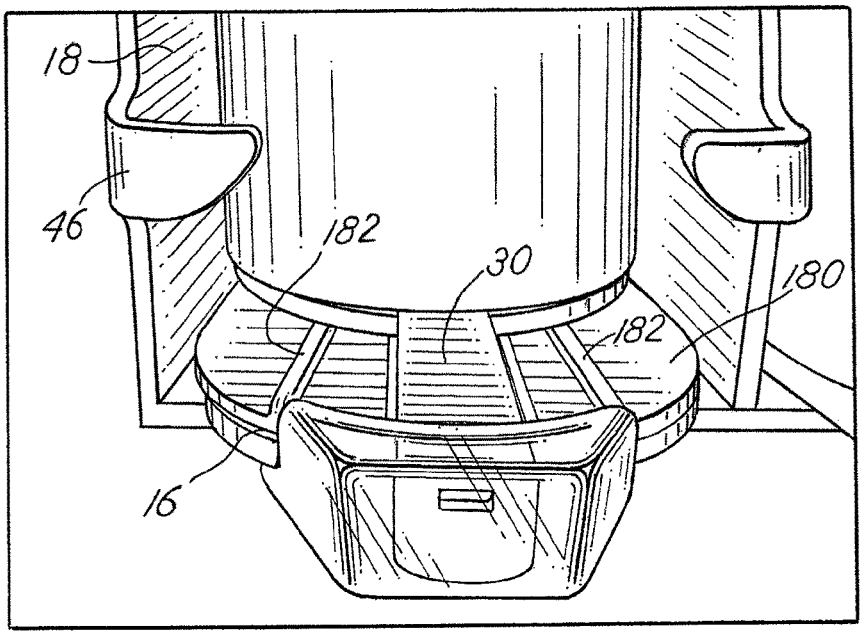
FIG. 20 depicts a front view of an installed adaptor of the invention.

As can be seen in FIG. 2, the pusher floor 52 may define an elongated channel, groove or recessed portion 59 that is sized, shaped and configured to seat the coiled spring 30. In the exemplary embodiment, the channel or groove 59 may extend across the floor 52 and in a substantially perpendicular manner relative to the pusher paddle 50. In an alternative aspect, the groove or channel may extend part-way or across the entire pusher floor 52, as shown in FIG. 19. Such configuration permits the proper alignment and positioning of the pusher paddle 50 in the tray. The groove 59 may define a depth that matches or exceeds the thickness of the coiled spring 30. With this configuration, the coiled spring 30 will seat at or below the pusher floor surface such that product will not sit directly on the coiled spring, rather, such product will sit on the pusher floor surface. As shown in FIG. 19, the pusher floor may include apertures and openings through which debris or other items may pass. Alternatively, the floor may be a solid surface.

Figure 16:
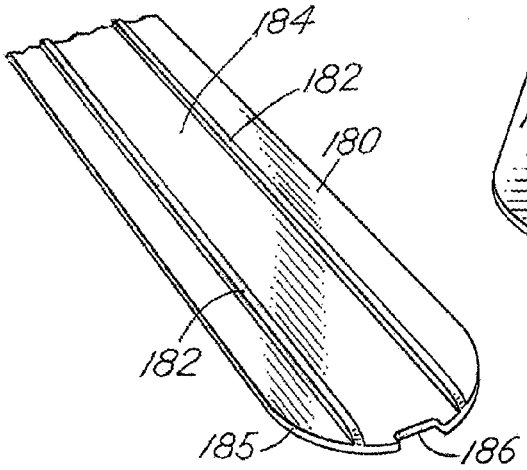
FIG. 16 depicts an isometric view of an adaptor that may be used with the invention.
Figure 17:
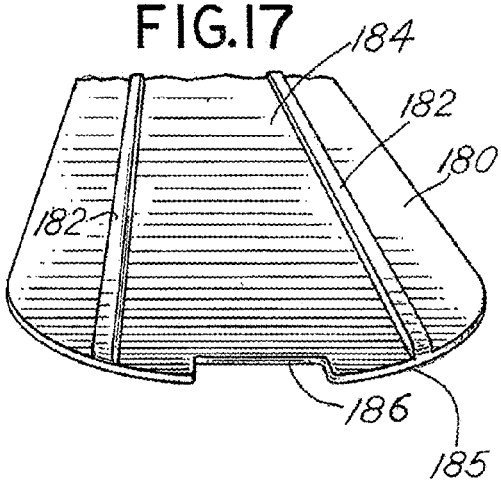
FIG. 17 depicts a front view of the adaptor of FIG. 16.

In an alternative aspect of the invention, as shown in FIGS. 16-20, an adaptor 180 may be positioned on the surface 16. Referring to FIGS. 16 and 17, the adaptor 180 may include one or more raised ribs 182 on which a product may sit. The raised ribs 182 may extend longitudinally along the length of the adaptor 180. The adaptor 180 may be a flat extrusion of plastic material (or any other suitable material) defining a planar surface 184 with the one or more ribs 182 extending outwardly from the planar surface 184. The adaptor 180 may define a rounded end 185 and include a notch or cut-away portion 186 through which or across which the coiled spring may extend. The rounded end 185 may be configured to match the shape of the product that is placed on the tray. Other shapes of the end 185, notch 186 and adaptor 180 may be used with the disclosure depending on the product to be merchandised. The adaptor 180 may be a separate, insertable piece or, alternatively, a piece formed integral with the surface 16.

Figure 18:
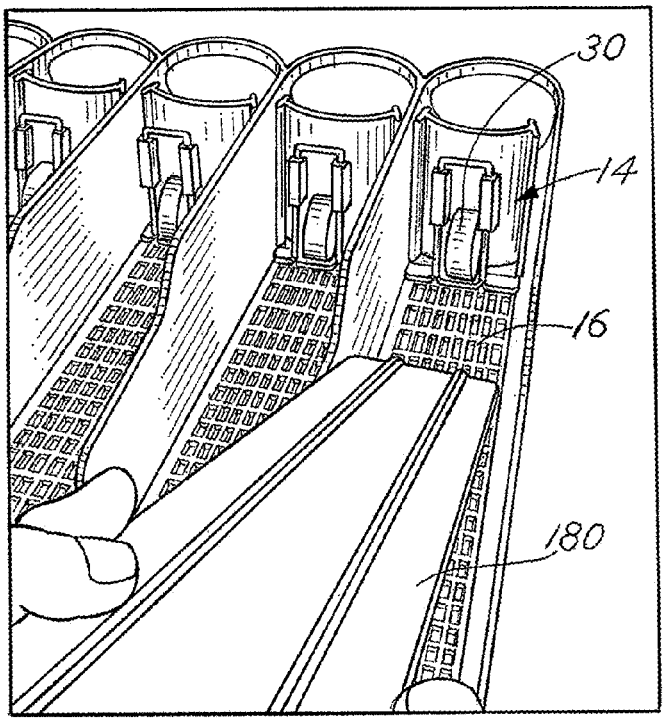
FIG. 18 depicts an exemplary installation of the adaptor of the invention.

Referring to FIG. 18, the adaptor 180 may be easily insertable onto the surface 16 and between the dividers 18. Referring to FIG. 19, once the adaptor 180 is installed, the pusher mechanism 14 may be positioned on top of the adaptor 180 and may slide freely across the ribs 182 of the adaptor 180. The coiled spring 30 may extend in a parallel manner between the ribs 182 and may seat at or below the top surface of the ribs 182, as more clearly shown in FIG. 20. With this configuration, the product to be merchandised may sit on, and slide along, the ribs 182 and not on the coiled spring 30.

In an alternative aspect, the ribs 182 may be a raised bead or raised beads, or a series of fingers that may be used to facilitate the movement of the product on the surface 16. In yet another alternative embodiment, the ribs 182 may be product moving members, such as runners or one or more rollers or rolling members that permit the product to roll across the rolling members and toward the front of the product display system. Exemplary roller assemblies include those disclosed and described in U.S. application Ser. No. 11/257,718 filed Oct. 25, 2005 and assigned to RTC Industries, Inc, which application is incorporated herein by reference. As should be appreciated by those skilled in the art, there are many possible techniques that may be used with the described pusher mechanisms for facilitating the movement of the product on the shelf or floor.

The underneath side of the pusher floor 52 may be a smooth planar surface that will slide freely along the surface 16. Alternatively, and similar to above, the pusher floor 52 may include beads, runners, rollers or the like that will permit the pusher floor to slide along the surface yet raise the pusher floor up off of the surface 16. In another alternative embodiment, the underneath side of the pusher floor may be configured with rail mounting members to permit the mounting of the pusher to a track or rail, as understood in the art.

The pusher floor further defines a notch or cut-out portion 62 through which will pass the coiled spring 30. The end 29 of the coiled spring 30 will pass through the notch 62 and through the notch 26 of the surface 16 and will mount to the tray using any of the techniques described above.

In use, as the pusher mechanism 14 is urged rearward in the tray 12, the end 29 of the coiled spring 30 will be held in position as described above and the coiled end 57 of the spring 30 will begin to uncoil behind the pusher paddle 50. If the pusher 14 is allowed to move forward in the tray 14, such as when product is removed from the front of the tray, the coiled end 57 of the spring 30 will coil and force the pusher paddle 50 forward in the tray 12, thereby urging product toward the front of the tray.

In an alternative embodiment, the coiled spring 30 may extend below and underneath the pusher floor 52 as opposed to above and across the pusher floor, as depicted in the figures. With this configuration, the groove 59 and notch 62 may not be necessary.

The coiled spring 30 may be any biasing element including, without limitation, a flat coil spring commonly used with pusher systems. The present disclosure may use one or more coiled springs to urge the pusher mechanism 14 forward depending on the desired application. The coil tension of the spring 30 may also vary depending on the particular application.

Referring to FIG. 2, the trackless pusher mechanism 14 is shown mounted to the tray 12. As illustrated, the pusher mechanism 14 fits in the tray 12 between the dividers 18. End 29 of the coiled spring 30 extends through the notch in the pusher floor and mounts to the tray as described above. In use, the pusher mechanism 14 will slide along the surface 16 of the tray 12 without the use of tracks, rails, or guides. As depicted in FIG. 2, the pusher mechanism 14 is shown in a forward position.

Referring to FIG. 3, the pusher mechanism 14 is shown merchandising one product 70 in the merchandise system 10. The product is prevented from tipping out of the tray by the product-retaining member 44. The product 70 may be any product to be merchandised including the depicted soft drink bottle. As shown in this Figure, the product 70 sits on the pusher floor 52 and the coiled spring 30 that extends below the product. The weight of the product on the floor 52 and the positioning of the product across the spring 30 prevent the paddle 50 from tipping in the tray 12.

Referring to FIG. 4, the pusher mechanism 14 is shown merchandising multiple products 70 in the merchandise system 10. As shown in this Figure, the product next to the pusher paddle 50 sits on the pusher floor 52 and the coiled spring 30 that extends below the product. The other products will sit on the coiled spring 30 that will extend below these products. Alternatively, the adaptor 180 may be positioned in the system in which case the product may sit on the ribs 182 of the adaptor as opposed to the coiled spring. Again, the weight of the product on the pusher floor 52 and the positioning of the products across the spring 30 prevent the paddle 50 from tipping in the tray. In use, as one product is removed from the front of the tray near the product-retaining member 44, the pusher mechanism 14 (through the urging of the coiled spring 30) will push the remaining product forward in the tray 12 until the forward-most product contacts the product-retaining member 44. As additional products are removed, the pusher mechanism 14 will continue to push the remaining product toward the product-retaining member 44.

Referring to FIG. 5, a rear view of the pusher mechanism 14 shows the pusher mechanism 14 merchandising multiple products 70 in the merchandise system 10. Again, the product next to the pusher paddle 50 sits on the pusher floor 52 and the coiled spring 30 that extends below the product. The other products will sit on the coiled spring that will extend below these products. Alternatively, the adaptor 180 may be positioned in the system in which case the product may sit on the ribs 182 of the adaptor as opposed to the coiled spring. As one product is removed from the front of the tray near the product-retaining member 44, the coiled end 57 of the spring 30 will urge the pusher paddle 50 of the pusher mechanism 14 forward in the tray 12 until the forward-most product contacts the product-retaining member 44. As can be seen in this Figure, the coiled end 57 may be positioned between two support members 58. The support members will retain the coiled spring between these members. As can be seen in this Figure, the pusher floor 52 may also extend below the support members 58.

Referring to FIG. 6, an alternative embodiment of the pusher tray is depicted. With this embodiment, multiple trays 12 may be formed into a single multi-tray assembly 80. The multi-trays may have a common floor with dividers 18 extending upwardly from the floor to create the multiple trays or rows. In this embodiment, the product-retaining member 44 may be a solid member that extends between two dividers, as discussed above. One or more of the multi-tray assemblies 80 may be coupled or joined together in a side-by-side manner using any known technique, including clips, dovetailing, fasteners, or the like. With this configuration, numerous rows of product can be provided for the merchandising of numerous products.

As stated above, the trackless pusher mechanism 14 may be used with gravity-fed systems, that is, systems having trays or product channels that are mounted on an incline to permit gravity to assist with the merchandising of the product. Alternatively, the trackless pusher mechanism 14 may be used with systems that are mounted in a non-inclined or in a horizontal manner where gravity will provide little or no assistance with the merchandising of the product. The trackless pusher mechanism 14 may also be used to push various shaped products.

FIG. 7 depicts an exemplary tip 60 for the end 29 of a coiled spring 30 that may be used with the merchandise system 10. As illustrated, the tip 60 defines an aperture 61 for receiving the end 29 of the coiled spring and an aperture 63 for mounting to the surface 16 of the tray. As can be seen in FIG. 7, in one aspect of an alternative embodiment, extending beneath the surface 16 may be a tongue or mounting member 65 that may be configured to mate with the aperture 63 and to snap-fit the tip 60 onto the tongue 65 and thus to the surface 16.

Figure 8:
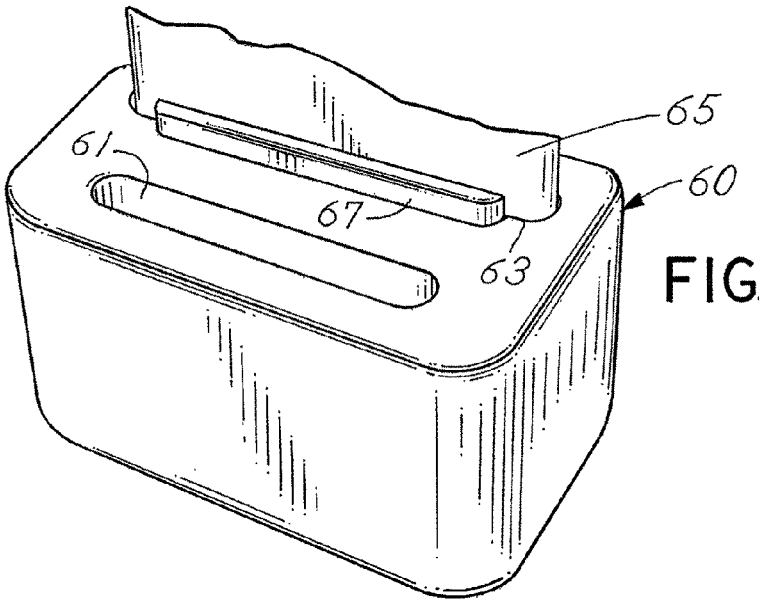
FIG. 8 depicts the exemplary tip of FIG. 7 being mounted to a surface of a tray or product channel.
Figure 15:
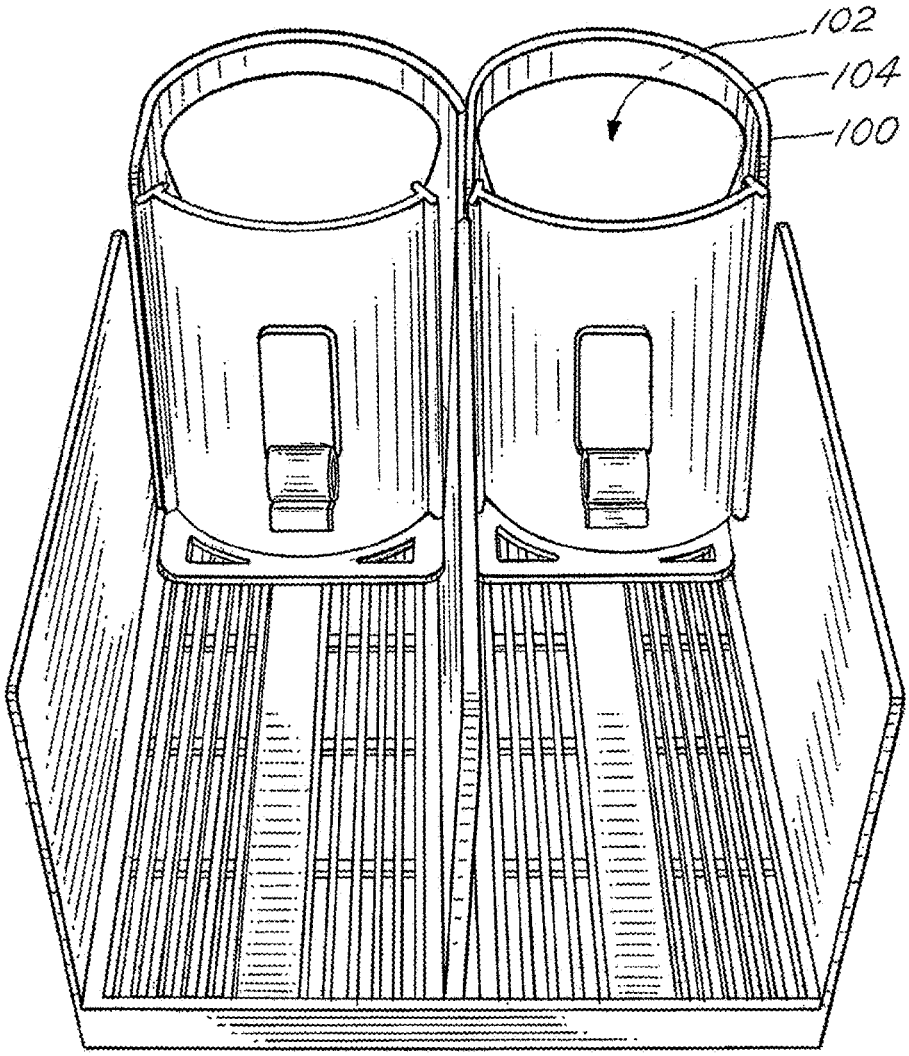
FIG. 15 depicts a back view of the system of FIG. 11.

Referring to FIG. 8, the exemplary tip 60 of FIG. 7 is shown being mounted to the tongue or mounting member 65. The tongue 65 may include an elongated outwardly extending rib 67 that is used to snap-fit the tip 60 onto the tongue 65. One skilled in the art will appreciate that other techniques may be used to mount the tip 60 to the surface 16 and that the depicted technique is merely an exemplary embodiment of one such technique.

Referring to FIG. 9, the exemplary tip 60 is shown fully mounted in a snap-fit manner to the surface 16, and more specifically to the end portion 24 of the surface 16 of the tray 12. Also depicted is the mounting of the end 29 of the coiled spring 30 to the aperture 61 of the tip 60. As shown in FIG. 9, the end 29 of the coiled spring may be inserted into the aperture 61. The aperture 61 is configured to receive the end 29 of the coiled spring and hold the end 29 in position, and to also permit the removal of the end 29 of the coiled spring from the aperture 61 in those circumstances where it is desirable to disconnect the coiled spring from the tip to permit the removal of the pusher mechanism 14 from the system.

Referring to FIG. 10 there is shown the end 29 of the coiled spring fully mounted to the exemplary tip 60. As illustrated in this figure, the coiled spring 30 is now operatively connected to the surface 16 of the tray 12. As a result, the pusher mechanism 14 is now mounted to the tray 12.

Referring to FIGS. 21-27 there is shown an alternative technique for mounting the end 29 of the coiled spring 30 to the merchandise display system. A mounting member 130 may be used to mount the end 29 of the coiled spring to the floor 131 of the system. For those systems that include spaced-apart glide rails 132 that are joined together by connecting ribs 134 (FIGS. 26-27), the mounting member 130 may be snap-fit to or otherwise mounted on the floor 131 and between the glide rails 132. The mounting member will thus hold the end of the coiled spring in position and to the floor of the system.

Figure 26:
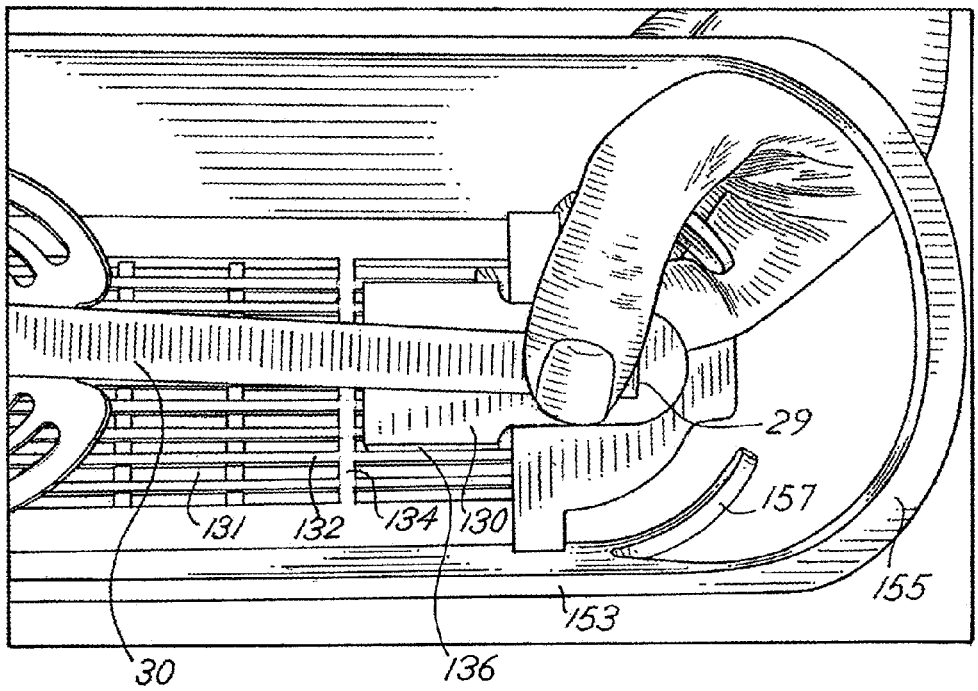
FIG. 26 depicts the exemplary mounting member of FIG. 22 with attached coiled spring being mounted to the floor of the system.
Figure 27:
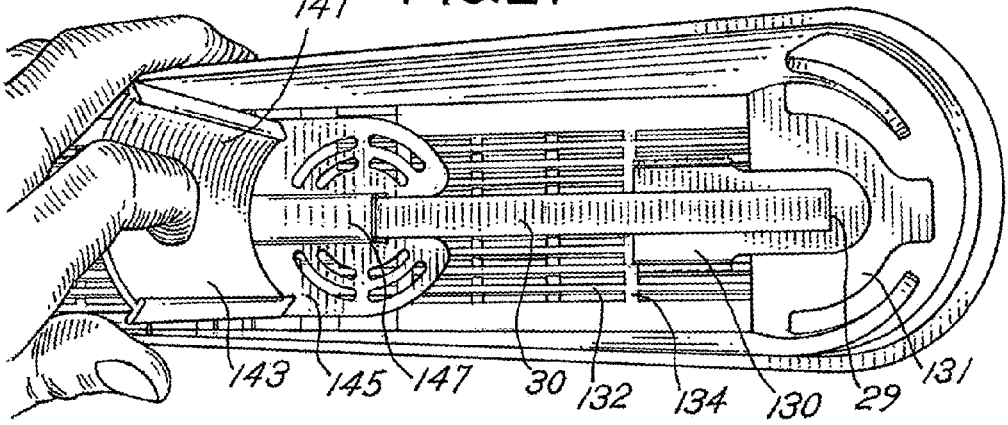
FIG. 27 depicts the exemplary mounting member of FIG. 22 installed on the floor of the system.

Referring to FIGS. 22-23, the mounting member 130 may include one or more legs 136 on one or more sides of the member 130. The legs may be configured to snap-fit to the underside of the rails 132 to thereby hold the mounting member 130 to the floor of the system. The legs 136 may include legs ends 137 defining an L-shape or angled surfaces that are configured to contact the underside of the rail 132 and prevent the mounting member 130 from being lifted up from the floor, except by the intentional flexing of the legs out from the underside of the rail 132. The legs 136 may contact the connecting ribs 134 which will prevent slidable movement of the mounting member 130 relative to the floor. Referring to FIG. 26, the mounting member 130 is shown being mounted to the floor of the system and more specifically to the rails. FIG. 27 illustrates that the mounting member 130 remains in position as the pusher paddle 141 is pulled away from the front of the system. The mounting member 130 may be connected to this type of system floor 131 using other techniques. For example, a separate mounting clip, one or more fasteners, adhesives, or other techniques may be used to secure the mounting member 130 to the floor 131.

Referring to FIGS. 22-23, the mounting member 130 may also include an aperture or opening or slot 138 that will receive the end 29 of the spring. The spring may be mounted using any of the techniques described herein, or other techniques. The configuration of the aperture 138 and mounting member 130 will hold the spring in position on the mounting member 130, similar to the technique described above.

The mounting member 130 may also include glide ribs 139 on a top surface that allow product placed thereon to slide more easily across the mounting member after the mounting member is installed to the floor of the system. The mounting member 130 may also include an elongated flat body 140 that extends forward of the location of the legs 136 to provide stability to the mounting member 130 after it is mounted to the floor of the system.

Figure 24:
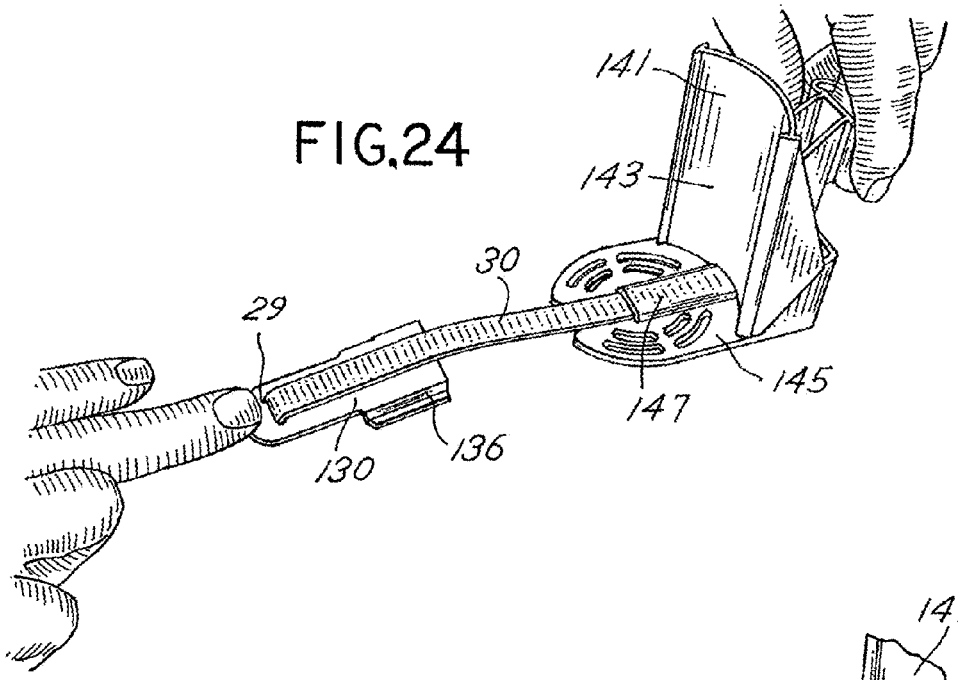
FIG. 24 depicts the exemplary mounting member of FIG. 22 mounted to the end of the coiled spring with the coiled spring mounted to an exemplary pusher paddle.
Figure 25:
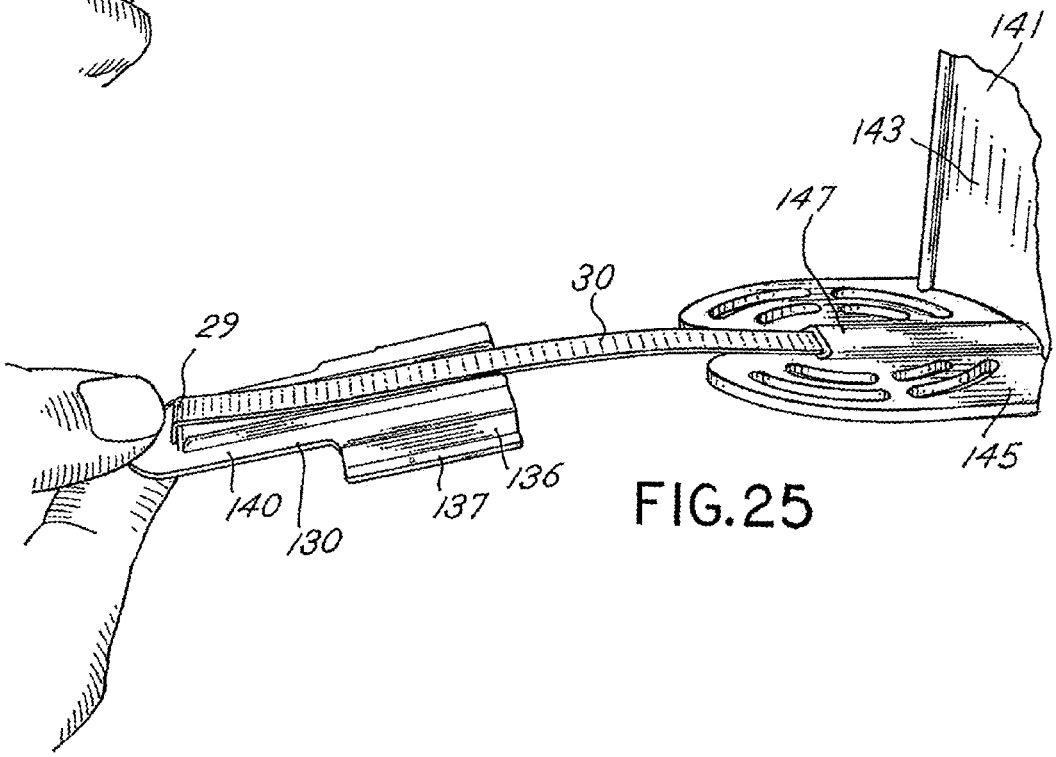
FIG. 25 depicts another view of the exemplary mounting member of FIG. 22 mounted to the end of the coiled spring with the coiled spring mounted to an exemplary pusher paddle.

Referring to FIGS. 24-25 and 27, the pusher paddle or pusher mechanism 141 may include a pusher face 143 configured to match the shape of the product against which it pushes. As illustrated, the pusher face 143 may be curve shaped to match the shape of a bottle or other cylindrical object. The pusher paddle 141 may also include a pusher floor 145 similar to the pusher floor configurations described above. The pusher floor 145 may further include a spring sleeve 147 that receives the coiled spring 30 to shield and protect the spring. The spring sleeve 147 may extend partly or fully across the pusher floor 145 and in the direction of the spring 30. The spring sleeve 147 may have a relatively short height and a flat surface 149 to permit product to sit thereon without significant tipping or leaning of the product.

The pusher paddle 141 may be positioned on top of the floor 131 to glide on top of the surface, as describe above. The pusher paddle may be positioned between two product divider walls 153 that are joined together by a product retaining member 155. Additional product retaining members 157 may extend outwardly from the product dividers.

Referring to FIGS. 28 and 29 there is shown yet another alternative technique for mounting the end 29 of the coiled spring 30 to the merchandise display system. In this embodiment, the end 29 is riveted to the tray 216.

Referring to FIGS. 28-32 in an alternative embodiment, the trackless pusher system may be retrofitted to an existing shelf assembly 230, which may have product dividers already built in. For example, in one embodiment, the trackless pusher system may be retrofitted to an existing wire shelf assembly. Referring to FIGS. 30-32, a tray or adaptor 216 may have a glide floor 222 that may be sized to a single lane of the shelf 234 or sized to an entire shelf width. The glide floor 222 may include several raised ribs 224, which help to reduce friction for the products merchandised on the tray 216. It should be understood that one or more raised ribs 224 may be used with the glide floor 222. Alternatively, the glide floor 222 may be a flat, planar surface without raised ribs. The tray or adaptor 216 may be configured similar to the adaptor 180 of FIG. 16.

As shown in FIGS. 28 and 30, the end 29 of coiled spring 30 may be riveted, via a rivet 229, to the front end 228 of the tray 216, or may be attached by any other attachment technique. The tray 216 can be retained to the shelf by any attachment technique suitable for the particular shelf. In one embodiment, and as illustrated in FIGS. 29-32, the tray 216 may include one or more outwardly extending fingers or snaps 220, which may engage one or more individual wires 232 of the shelf 234 to retain the tray 216 on the shelf 234. The fingers or snaps 220 may extend longitudinally along the length of the tray 216, or may be spaced apart along the length of the tray. The snaps 220 may be used to snap-fit the tray 216 to the existing wire shelf. As depicted in FIGS. 29A and 29B, the snaps 220A and 220B may define numerous configurations that permit the tray 216 to be snap fit to the shelf. The embodiment depicted in FIGS. 28-32 allows for the placement of the trackless pusher system in an existing shelving system, such as a wire shelf system, as a low cost alternative to the entire trackless pusher assembly. It should be understood that with this embodiment, any pusher mechanism described herein may be used.

Figure 33:
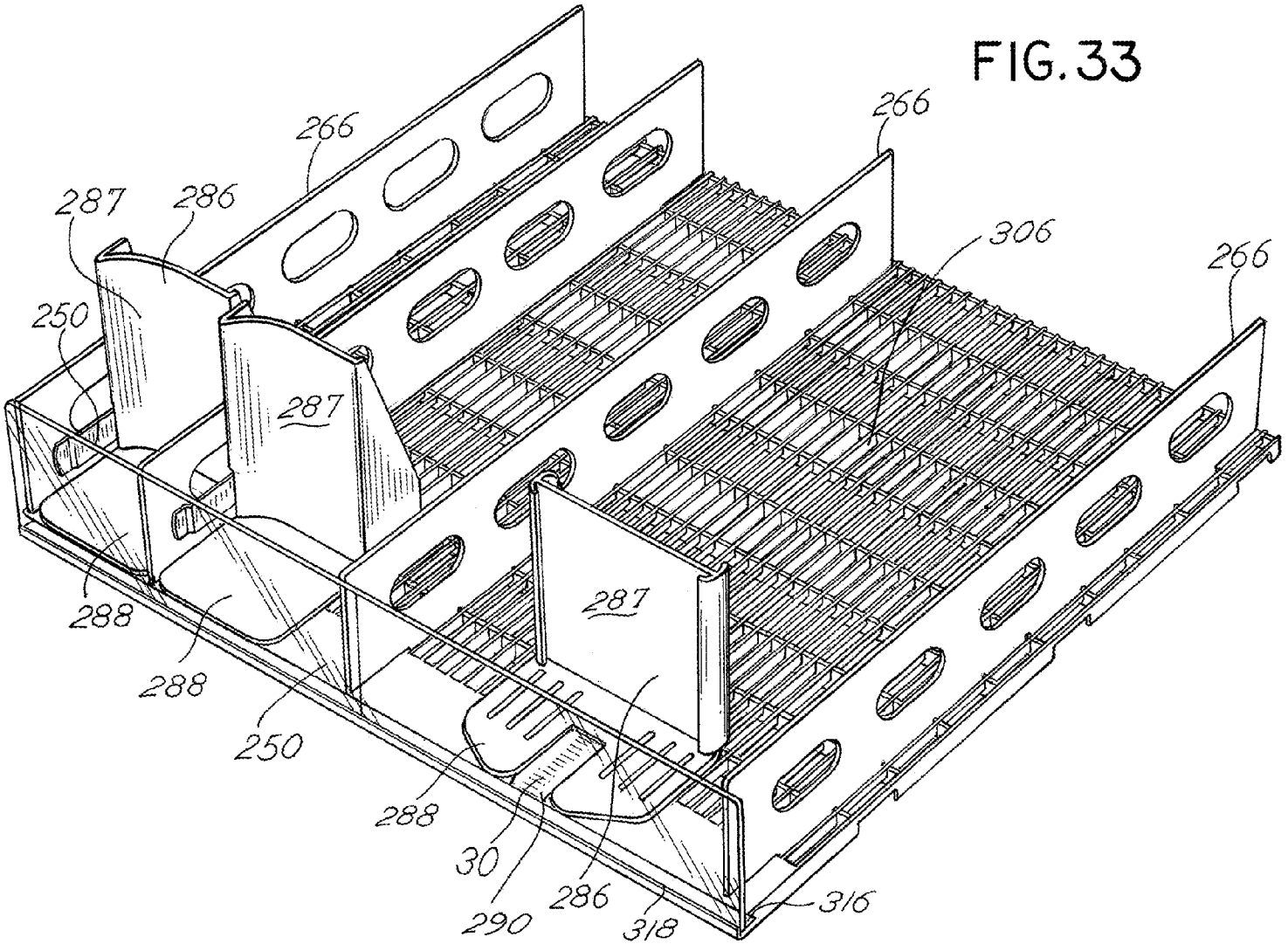
FIG. 33 depicts an isometric view of an exemplary embodiment of the display system.
Figure 44:
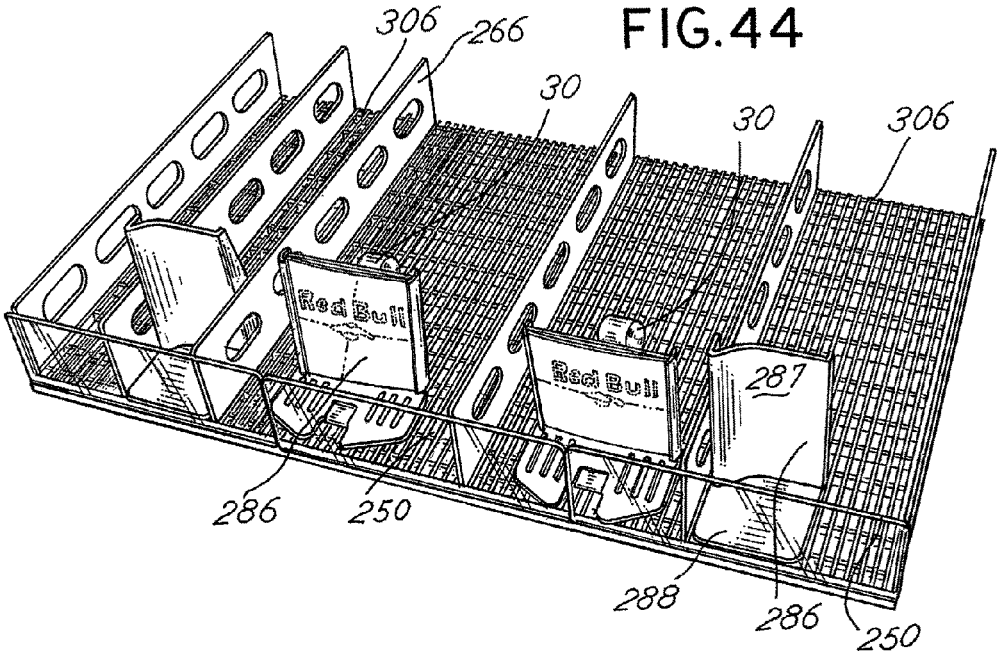
FIG. 44 depicts an isometric view of an exemplary embodiment of a product management display system.

As depicted in FIGS. 33 and 44, in another exemplary embodiment, the display management system comprises one or more pusher mechanisms 286, one or more dividers 266, one or more trays 306, and one or more retainers 250. The pusher mechanisms 286 can be formed of a pusher paddle 287 and a pusher floor 288. Product is placed on the pusher floor 288 and guided to the front of the display management system via the dividers 266 and the pusher paddle 287. The coiled spring 30 biases the pusher mechanism 286 toward the retainer 250 such that product moves to the front of the system.

Figure 34:
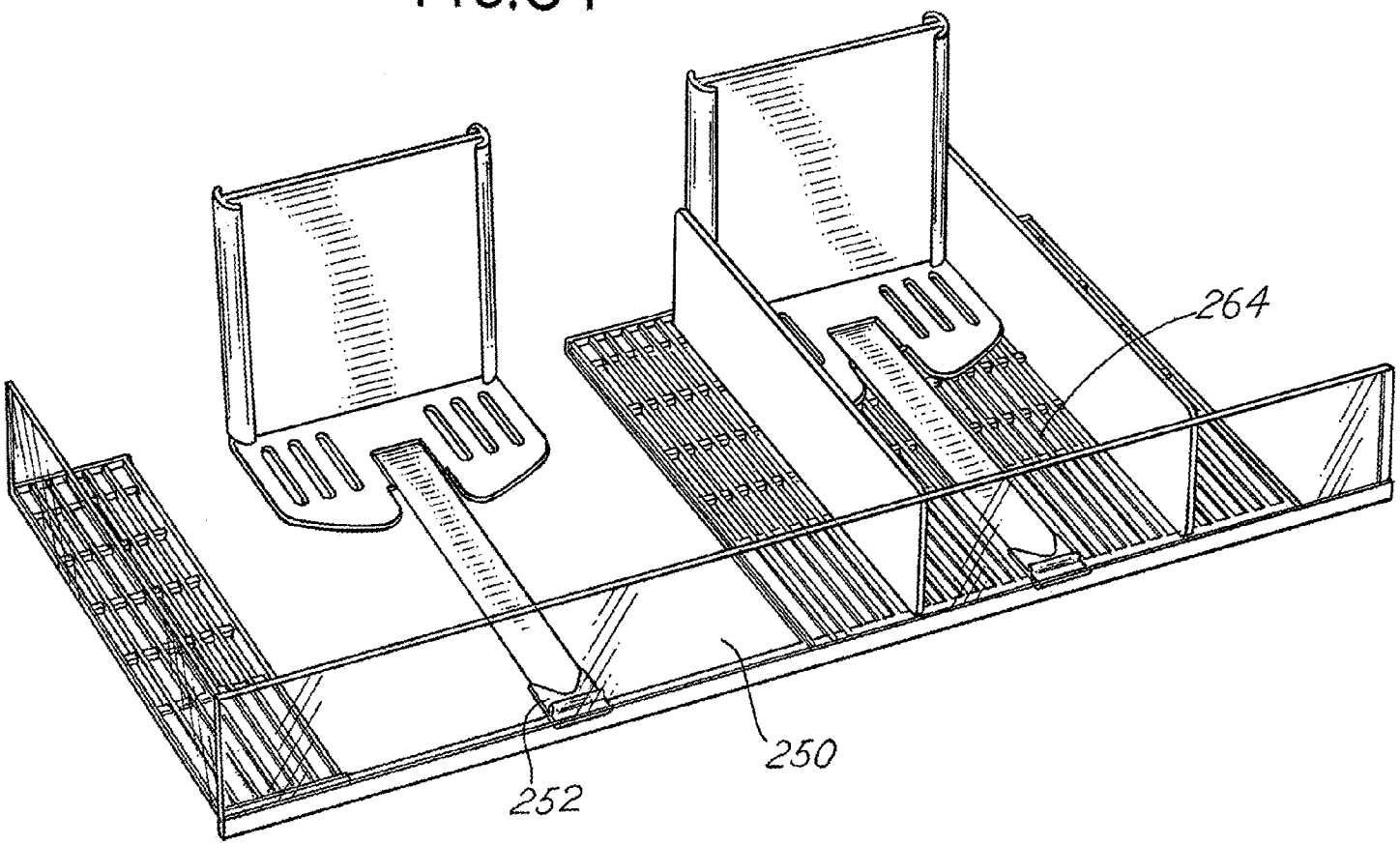
FIG. 34 depicts an isometric view of an exemplary embodiment of the display system.
Figure 48:
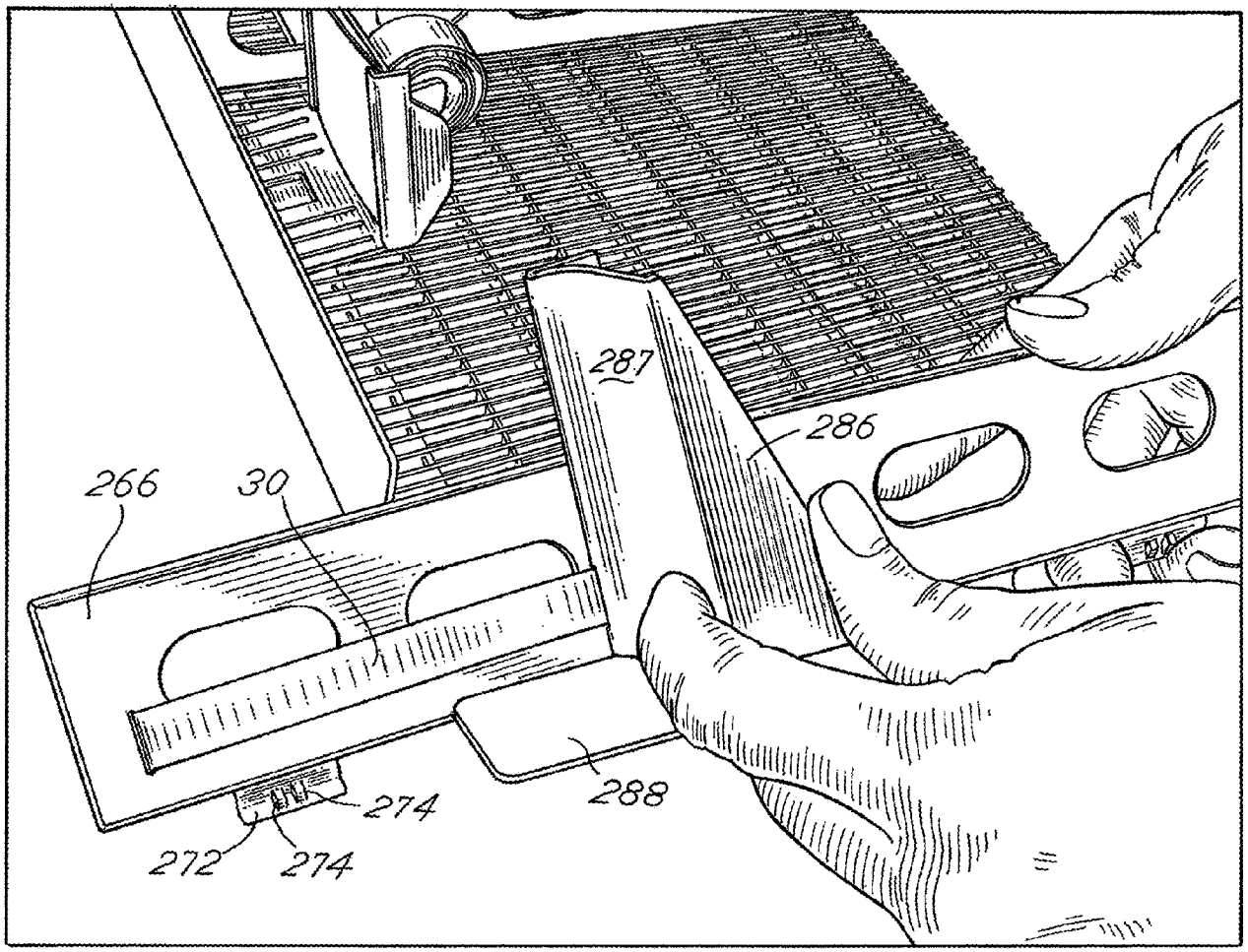
FIG. 48 depicts an isometric view of an exemplary embodiment of the pusher mechanism mounted to a divider.
Figure 49:
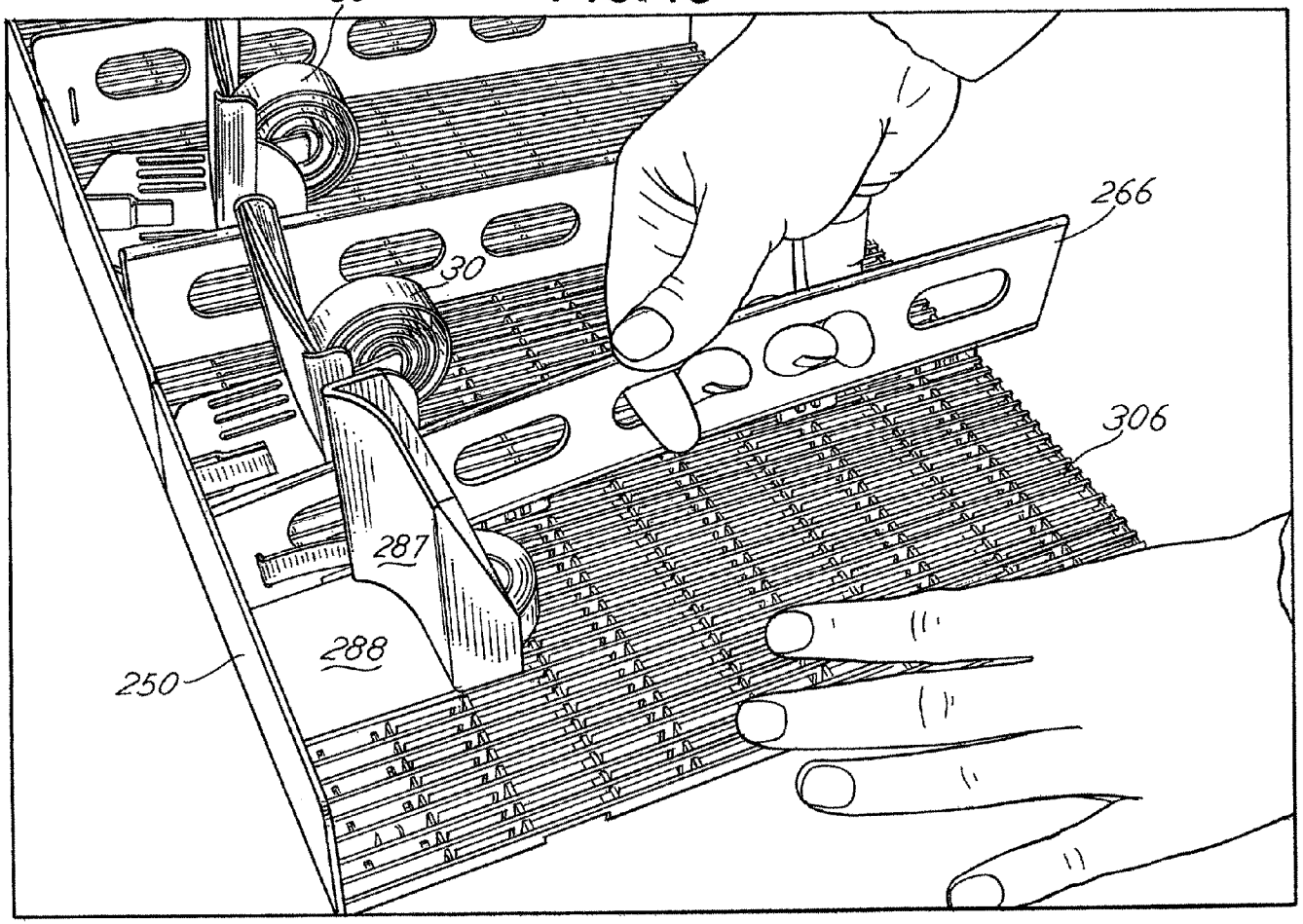
FIG. 49 depicts another isometric view of the divider and pusher mechanism being assembled to the product management display system.

In one exemplary embodiment, depicted in FIG. 33, the coiled spring 30 can be mounted to the retainer 250. Alternatively, the coiled spring 30 can be mounted to a divider 266 (also shown in FIGS. 48 and 49). The coiled spring 30 can be directly mounted to the retainer 250, as depicted in FIG. 33, or can be mounted to the retainer 250 via a separate adapter 252, as depicted in FIG. 34.

Figures 35, 36:
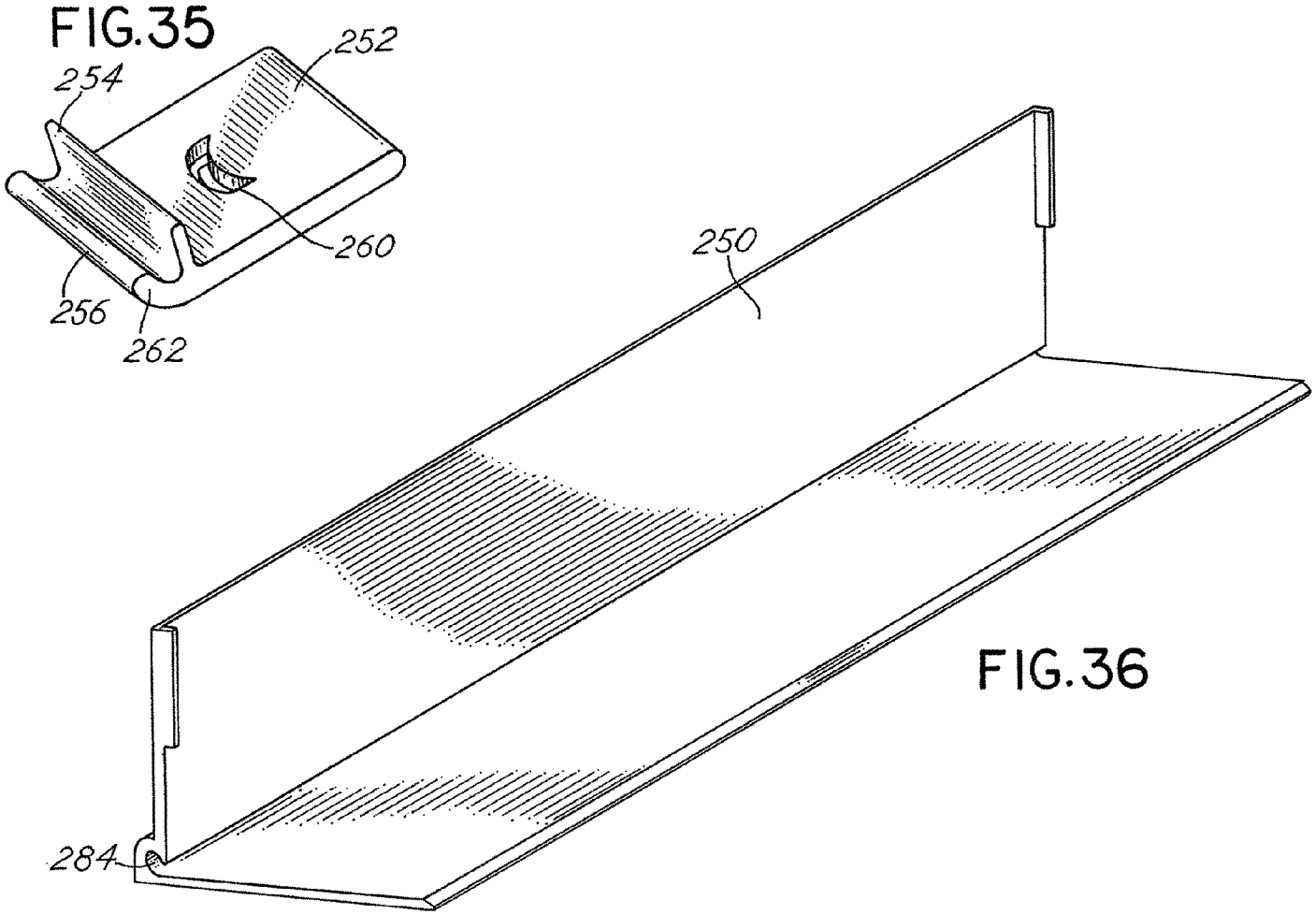
FIG. 35 depicts an isometric view of an exemplary embodiment of an adapter.
FIG. 36 depicts an isometric view of an exemplary embodiment of a retainer.

As depicted in FIG. 35, the adapter 252 has a wall 254 proximate a first end 256. The first end 256 has a curved portion 262, which curves upwardly. The middle portion of the adapter 252 may be provided with a curved slot 260, which is adapted to receive a correspondingly shaped spring end (not shown).

The coiled spring 30 at one end can be secured to the middle portion of the adapter 252. In an exemplary embodiment, the curved slot 260 corresponds in shape and size of the first spring end. Additionally, the first spring end of the coiled spring 30 can be crimped or bent to provide for additional fastening. Nevertheless, any sufficient fastening method can be used to fix the first spring end of the coiled spring 30 to the adapter 252.

Figure 37:
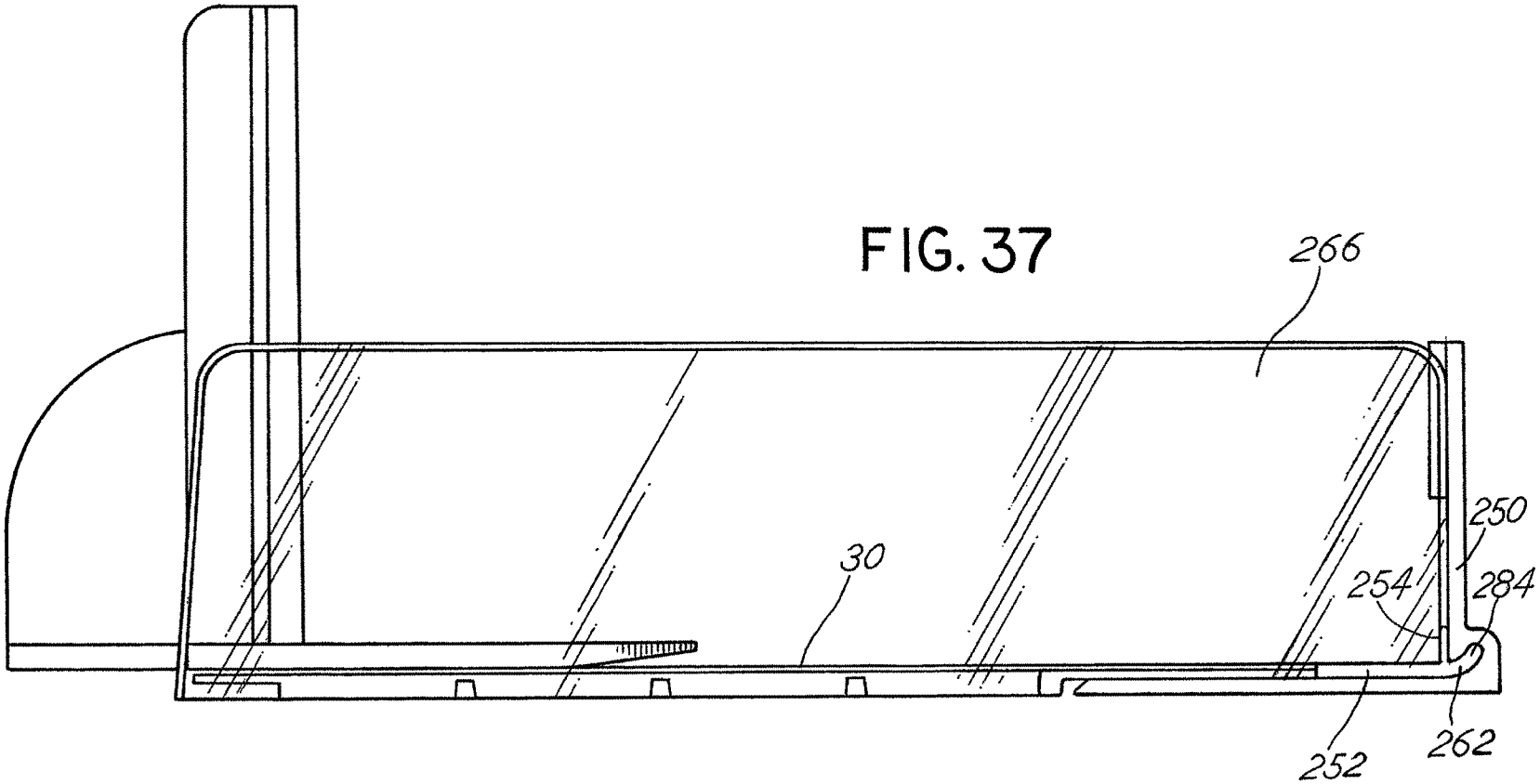
FIG. 37 depicts a side view of an exemplary embodiment of the display system.
Figure 38:
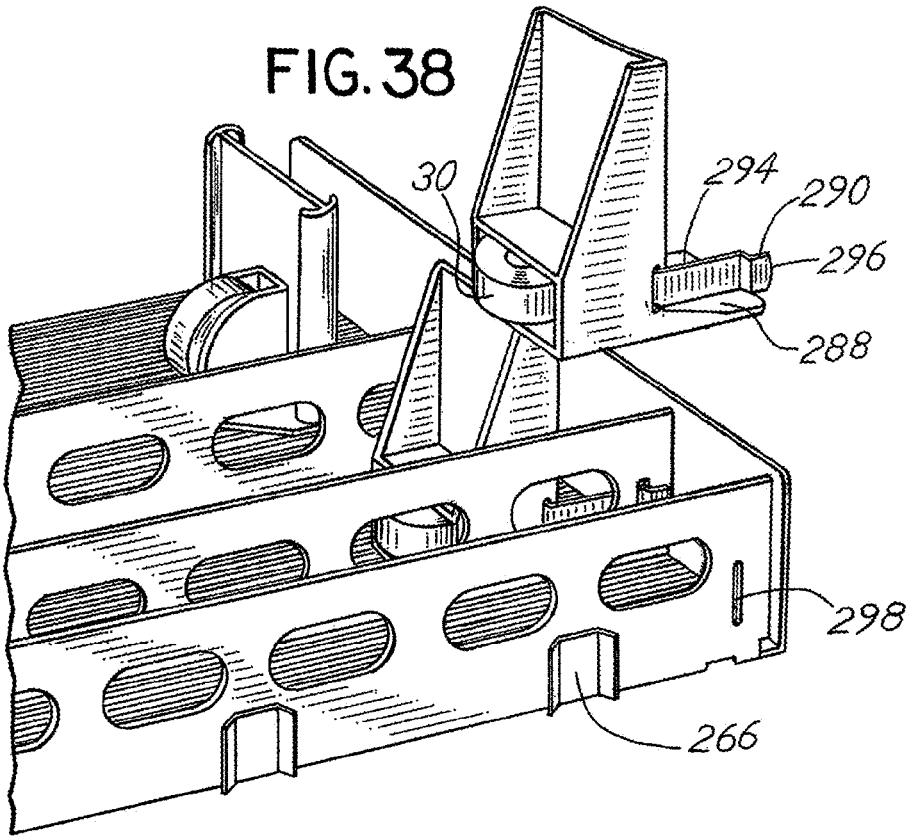
FIG. 38 depicts an isometric view of an exemplary embodiment of the display system.
Figure 39:
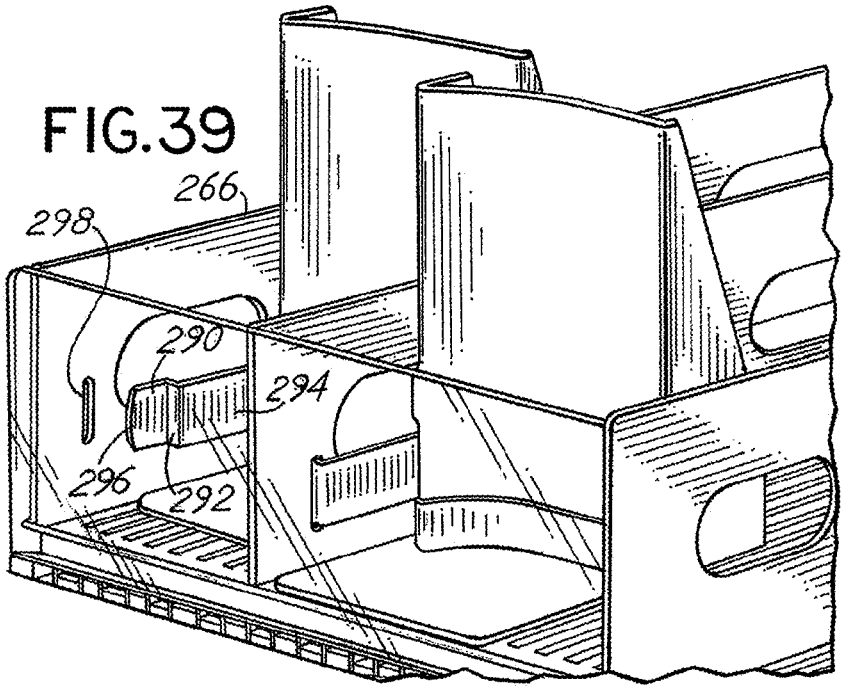
FIG. 39 depicts an isometric view of an exemplary embodiment of the display system.

In an exemplary embodiment, shown in FIGS. 36 and 37, the retainer 250 has a curved slot 284 corresponding in shape and size to the curved portion 262 of the adapter 252. The curved slot 284 extends the length of the retainer to allow for unlimited positioning of the adapter 252 along the length of the retainer 250.

To secure the first spring end of the coiled spring 30 to the retainer 250, the curved portion 262 of the adapter 252 is placed into the curved slot 284 of the retainer 250. The curved slot 284 secures the adapter 252 and the first spring end of the coiled spring 30 to the retainer 250 and provides for a quick and easy assembly of the display system. The wall 254 provides additional stability in the connection between the retainer 250 and the adapter 252. Other methods, however, can be used to secure the adapter 252 and/or the first spring end of the coiled spring 30 to the retainer 250.

Alternatively, as depicted in FIGS. 33 and 44 the coiled spring 30 of the pusher paddle 287 can be mounted directly to the front of the tray 306. The first spring end 290 of the coiled spring 30 is provided with a curved portion. The curved portion curves downwardly from the pusher floor 288 and is adapted to be received in a recess 316 (shown in FIG. 33) defined by a lip 318 of the front surface of the dispensing tray 306 and the retainer 250. A vertically oriented surface of the retainer 250 and the lip 318 are spaced such that a gap is formed between the vertically oriented surface and a front edge of the lip 250. To secure the coiled spring 30 and the pusher mechanism 286 to the assembly, the first spring end 290 is inserted into the gap formed between the vertically oriented surface of the retainer 250 and the front edge of the lip 318 and placed into the recess 316 formed by the lip 318 of the dispensing tray 306 and the retainer 250.

In another exemplary embodiment depicted in FIGS. 38, 39, 48 and 49, the coiled spring 30 can be directly mounted to a divider 266. In addition, in this exemplary embodiment the coiled spring 30 can be mounted perpendicular to the pusher floor 288 such that the axis, about which the coiled spring 30 is coiled, is perpendicular to the pusher floor 288. The first spring end 290 can be provided with an angled portion 292 and a tip portion 296. In one exemplary embodiment, the angled portion 292 can be bent perpendicular to the coiled spring body 294. The divider can be provided with a slot 298, which is adapted to receive the tip portion 296 of the first spring end 290.

To secure the coiled spring to the divider, the tip portion 296 is inserted into the slot 298. Once the tip portion 296 is fully inserted into the slot 298, the angled portion 292 engages the slot 298 so as to secure the first spring end 290 to the divider 266.

As depicted in FIG. 33, various pusher mechanism designs can be implemented. The pusher paddle 287 can be formed flat to accommodate correspondingly shaped product. Alternatively, the pusher paddle 286 can have a curved first end and a flat second end. This serves to accommodate a variety of cylindrical products having a variety of different sized diameters and to facilitate the operation of the pusher mechanism 286. During operation, the product in the pusher mechanism 286 and the curved first end together force the pusher mechanism against the divider 266, such that the coil spring 30 remains flat against the divider 266 holding the first spring end 290, while in tension or in operation. This allows for a smoother operation of the pusher mechanism and ensures that the product is properly dispensed as users remove the product from the system.

Figure 40:
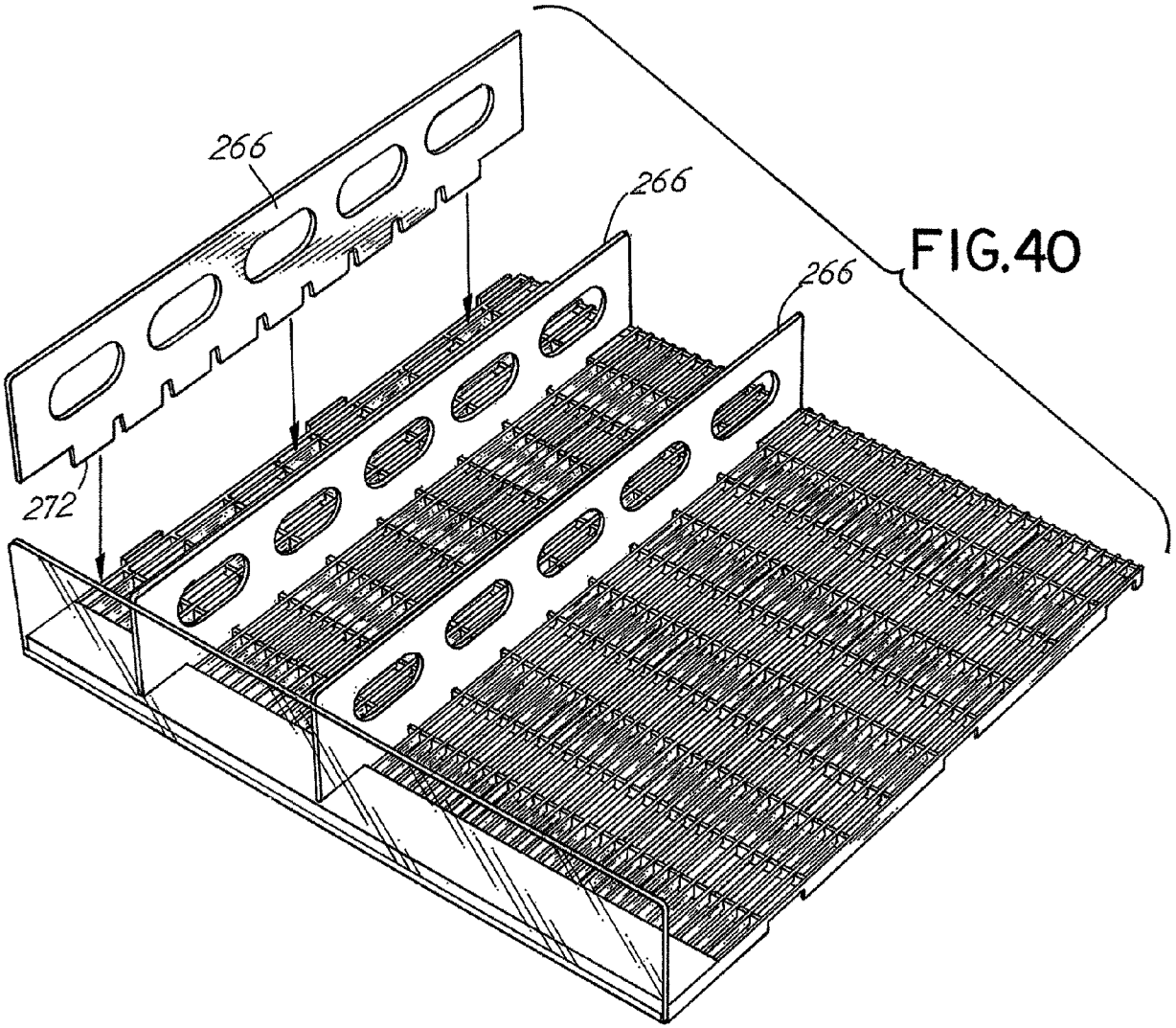
FIG. 40 depicts an isometric view of an exemplary embodiment of the display system.
Figure 41A:
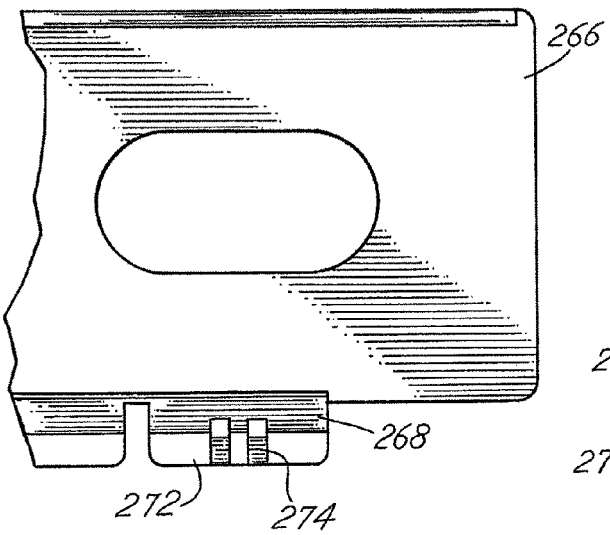
FIG. 41A depicts a sectional side view of an exemplary embodiment of a divider.
Figure 41D:
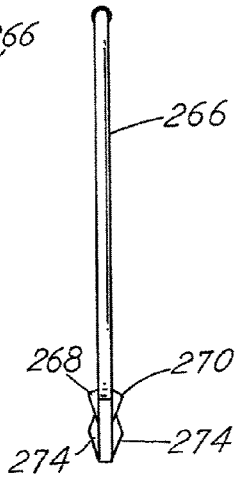
FIG. 41D depicts a front view of an exemplary embodiment of a divider.

In another exemplary embodiment depicted in FIGS. 40-41D, the distance between the dividers 266 can be adjusted to accommodate different sized containers. The dividers 266 can be provided with connecting portions 272. The connecting portions 272 can be provided with a first elongated angled surface 268 and a second elongated angled surface 270. Additionally, the connecting portions 272 can be provided with a plurality of projections 274. As depicted in FIG. 41B, the rails can be formed of teeth 278 having face surfaces 280 and flank surfaces 282.

Figure 41C:
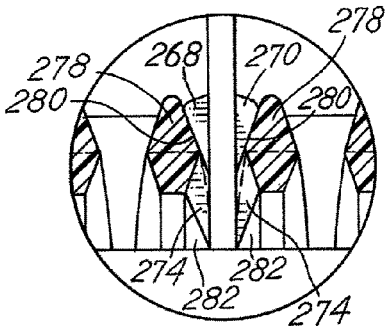
FIG. 41C depicts a close up view of a section of FIG. 41B.
Figure 41B:
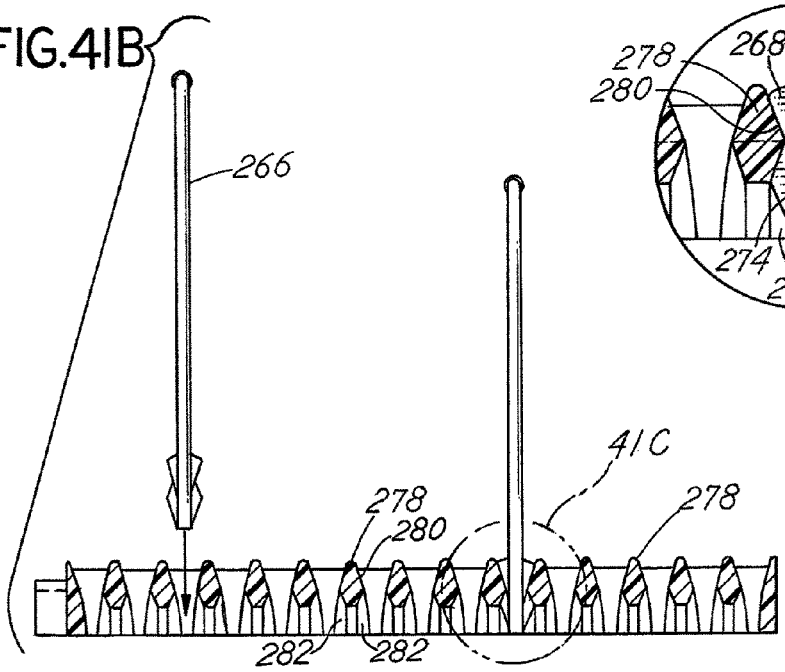
FIG. 41B depicts a front view of an exemplary embodiment of the display system.

When assembled, as depicted in FIG. 41C, the connecting portions 272 are received between the teeth 278 of the rails. Additionally, the elongated angled surfaces 268 and 270 and the projections 274 are wedged between the teeth 278. Also as shown in FIG. 41C, the elongated angled surfaces 268 and 270 engage the face surfaces 280 and the projections 274 engage the flank surfaces 282 of the teeth 278 to secure the connecting portions 272 between the rails.

Figure 42:
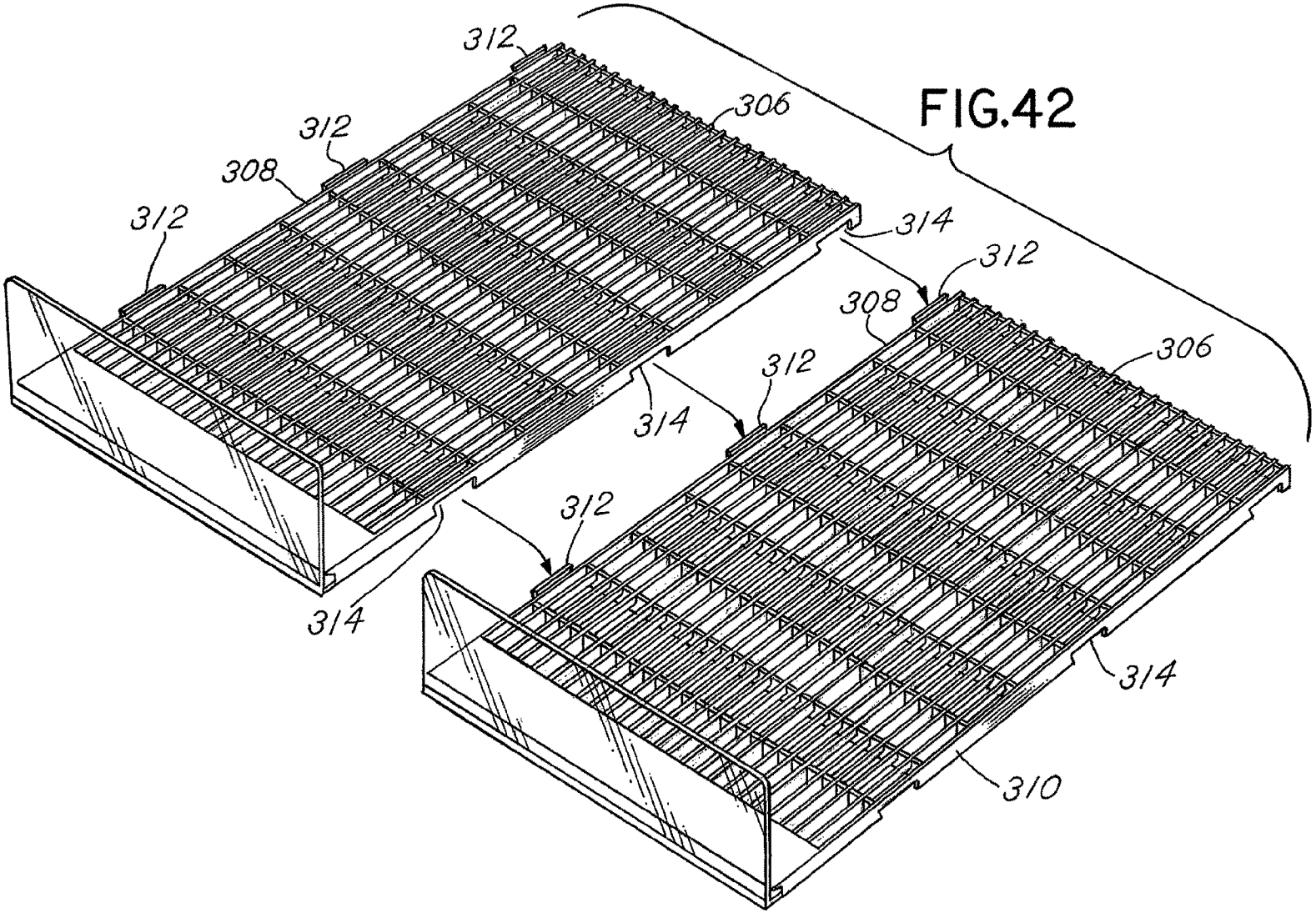
FIG. 42 depicts an isometric view of an exemplary embodiment of the display system.

In an exemplary embodiment depicted in FIG. 42, the trays 306 are provided with dovetail connections. A first side 308 of the trays 306 is provided with tongues 312 adapted to fit within grooves 314 located on a second side 310 of the trays 306. To connect the trays, the grooves 314 are aligned with tongues 312 such that the tongues 312 are firmly secured within the grooves 314.

Figure 43:
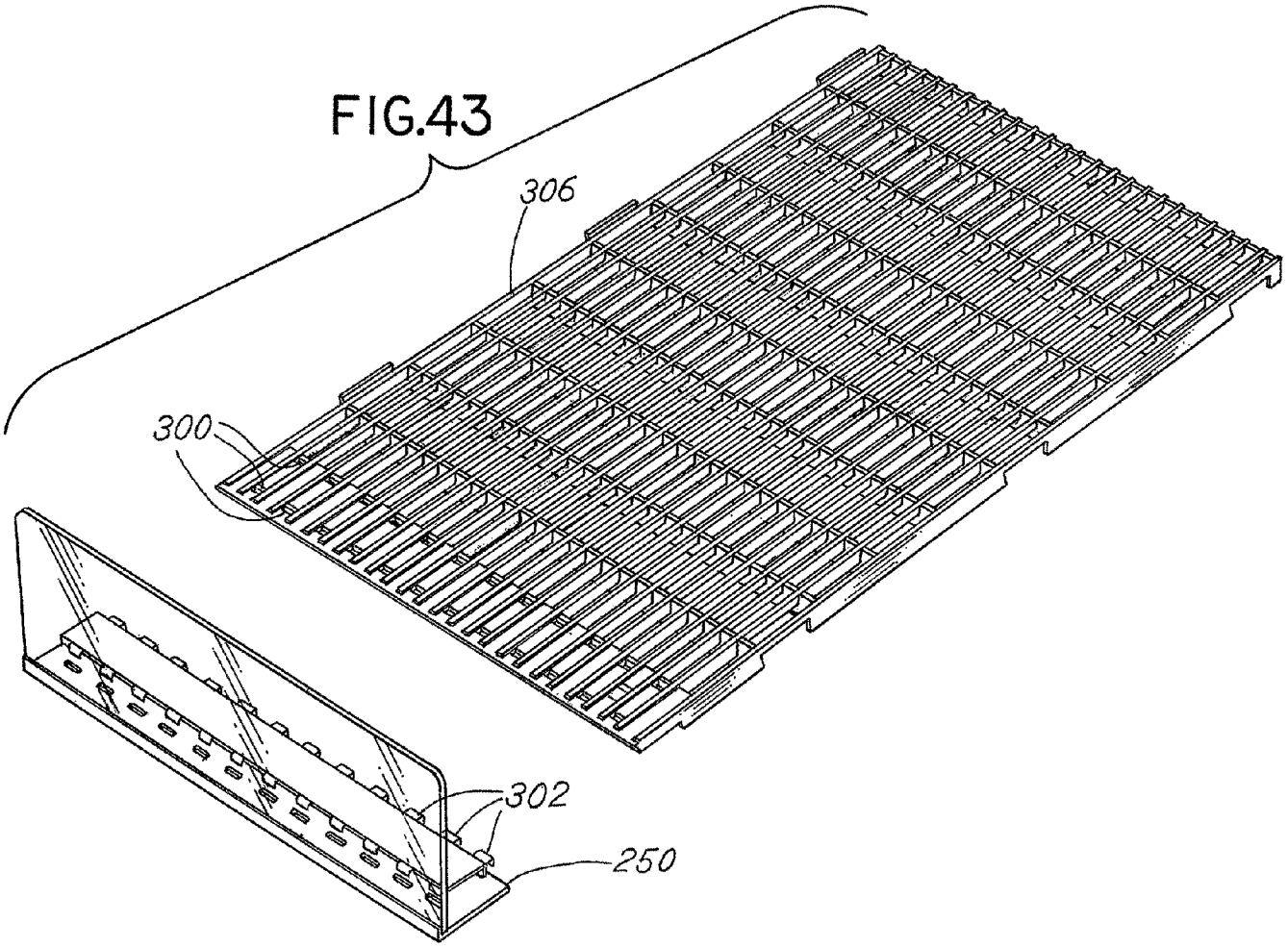
FIG. 43 depicts an isometric view of an exemplary embodiment of the display system.

In an exemplary embodiment depicted in FIG. 43, the trays 306 are configured to receive the retainer 250 at a front end. The retainer can be provided with rectangular holes 300, and the retainer is provided with correspondingly shaped and sized projections 302. To secure the retainer 250 to the tray 306, the projections 302 fit into holes 300 to lock the retainer into place on the tray 306.

Figure 45:
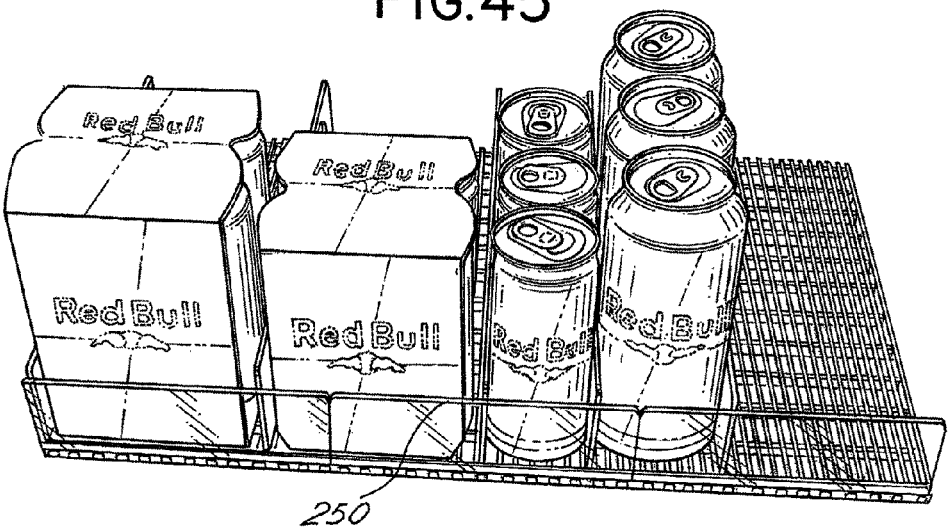
FIG. 45 depicts another isometric view of an exemplary embodiment of a product management display system with product in the system.
Figure 46:
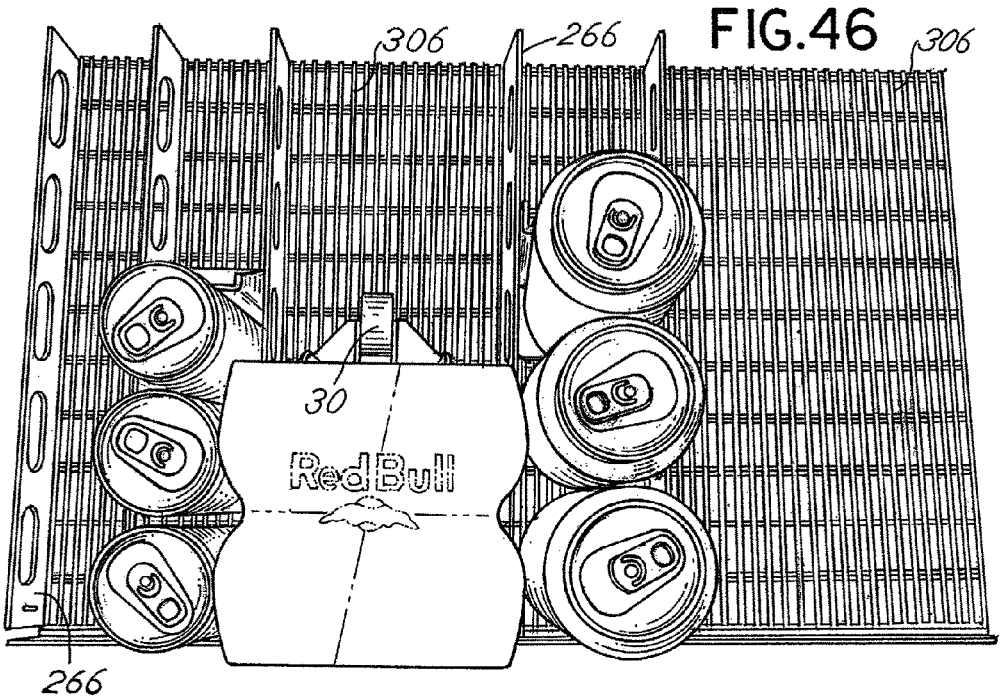
FIG. 46 depicts a top view of another exemplary embodiment of a product management display system with product in the system.
Figure 47:
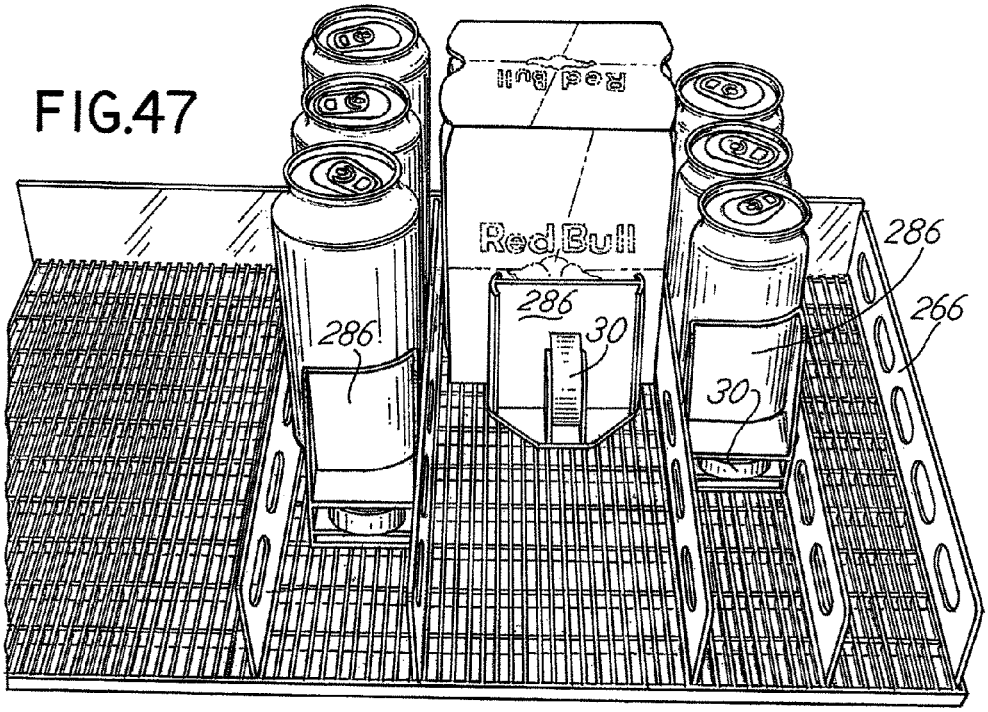
FIG. 47 depicts an isometric-rear view of an exemplary embodiment of a product management display system with product in the system.

As depicted in FIGS. 45-47, after the product management display system is assembled, product is loaded into the system. By adjusting the dividers 266 a wide variety of product sizes and shapes can be loaded into the system. As shown in FIGS. 46 and 47, the coil spring 30 in conjunction with the pusher paddle 287 push the product toward the retainer 250. As a user takes product out of the system, the pusher paddle 287 pushes the remaining product such that the product slides along the floor 264 to the retainer 250. This assures that all product remains at the front of the display system.

Figure 50:
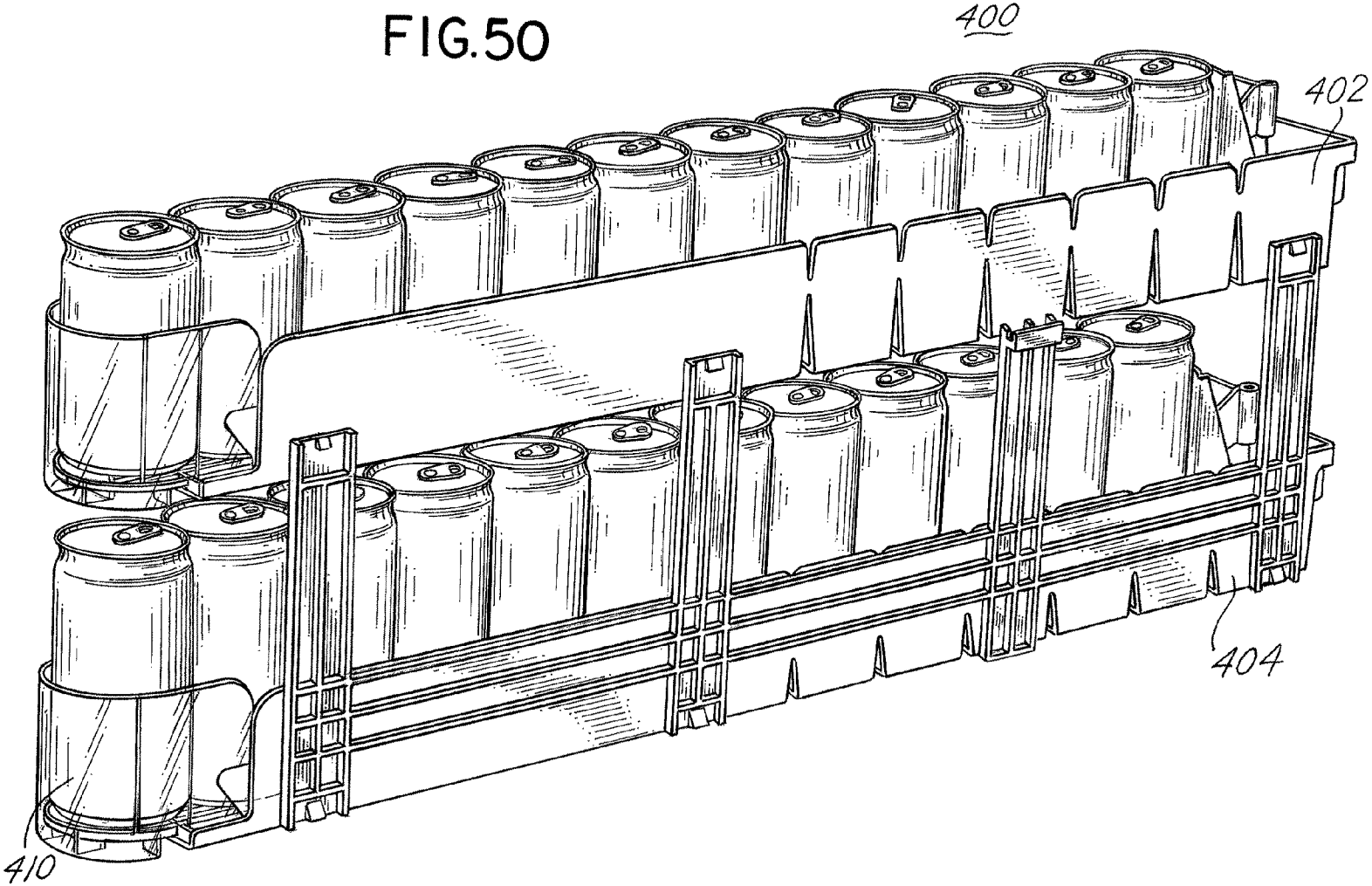
FIG. 50 depicts an isometric view of yet another exemplary embodiment of the product management display system.
Figure 51:
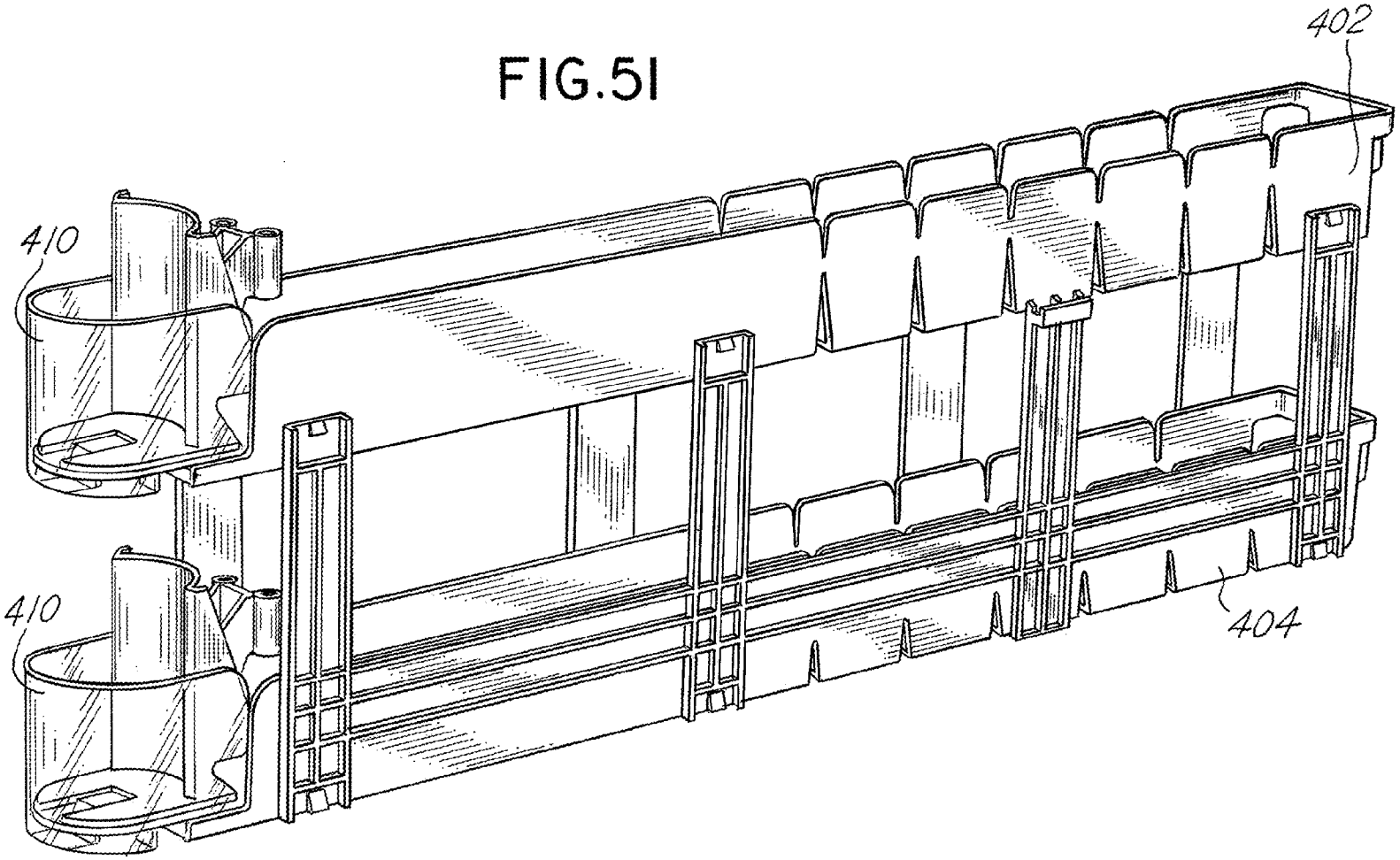
FIG. 51 depicts another isometric view of the exemplary embodiment of the product management display system of FIG. 50 without product.
Figure 52:
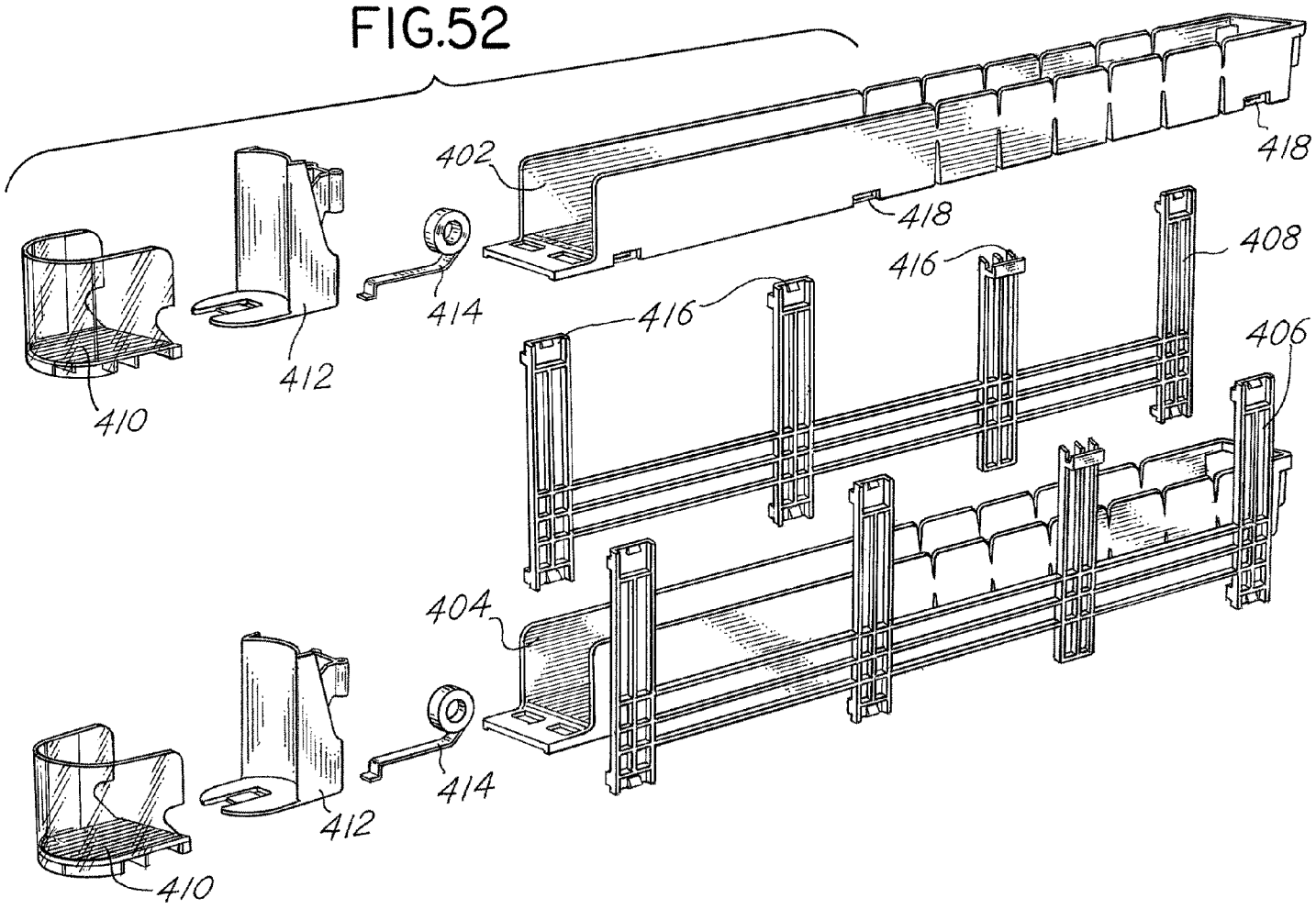
FIG. 52 depicts an exploded isometric view of the exemplary embodiment of the product management display system of FIG. 50.

As depicted in FIGS. 50-52, the product management display system 400 can be arranged such that trays 402, 404 can be stacked on top of one another. This embodiment can consist generally of a first tray 402, a second tray 404, a first spacer 406, and a second spacer 408.

The trays 402, 404 are each arranged to house product to be dispensed. The first tray 402 and the second tray 404 can be each provided with a clear retainer 410, a pusher mechanism 412, first and second guiding walls, and a coil spring 414.

The pusher mechanism 414 is arranged in a similar fashion as the embodiments discussed above, such that it slides product along the surface of the trays 402, 404, while product is removed. Additionally, any of the alternative arrangements of the pusher mechanism discussed above may be implemented in a stackable tray arrangement.

To provide for an easy assembly and disassembly, the stackable product management display system can be provided with a dovetail connection or any other suitable connection, such as a snap-fit connection, screw-thread connection, or a rivet connection. The first and second trays are provided with detents 416 for assembling the first and second spacers 406, 408 to the first and second trays 402, 404. Each of the first and second trays 402, 404 can be provided with sockets 418 on their respective outside surfaces for receiving the correspondingly shaped detents 416 located on the first and second spacers 406, 408.

To assemble the stackable product management display system, the detents 416 located on the first and second spacers 406, 408 are placed into the correspondingly shaped sockets 418 on the outside surfaces of the first and second trays 402, 404 in a locking arrangement. This provides for a stackable arrangement that can be implemented in conjunction with any of the embodiments discussed above.

Figure 53:
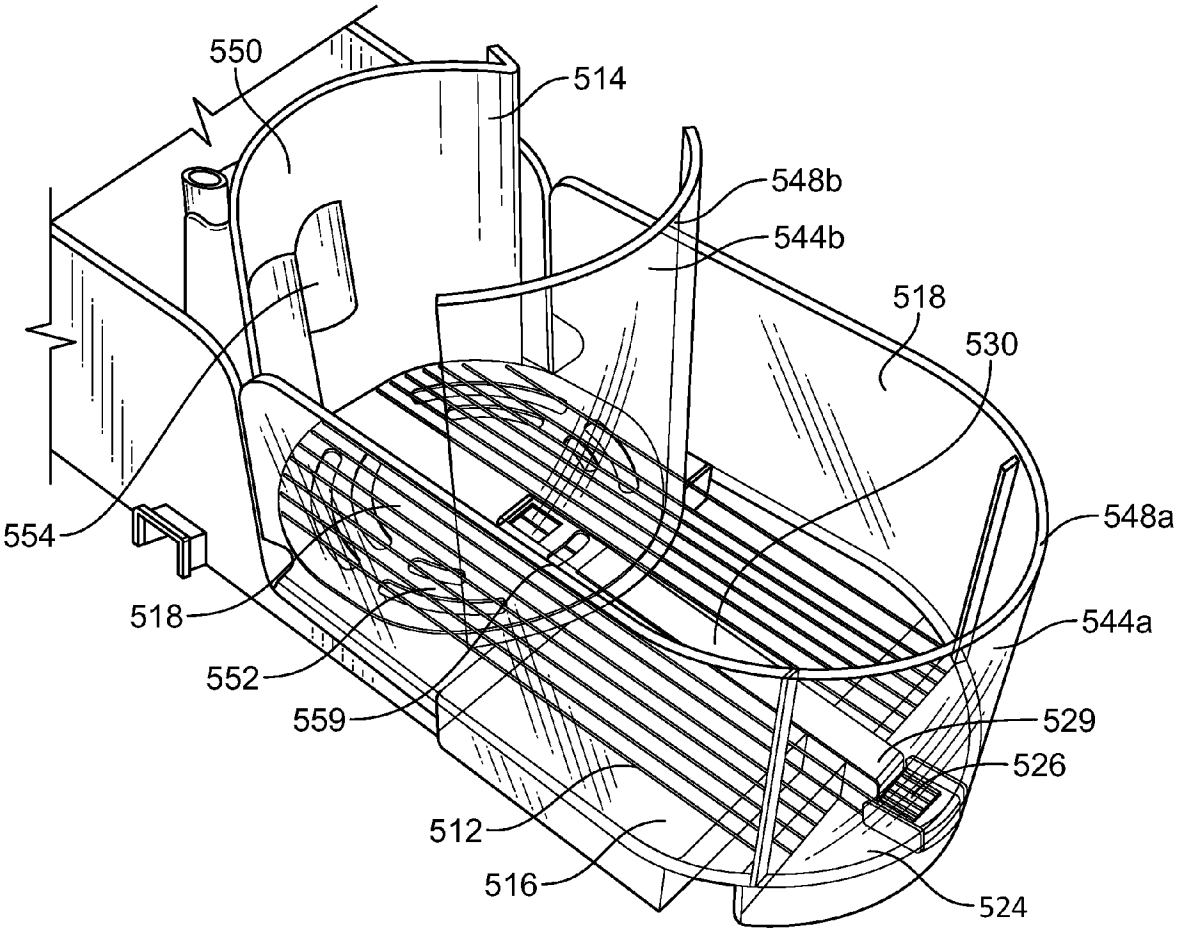
FIGS. 53-55 depict another example product management display system.
Figure 54:
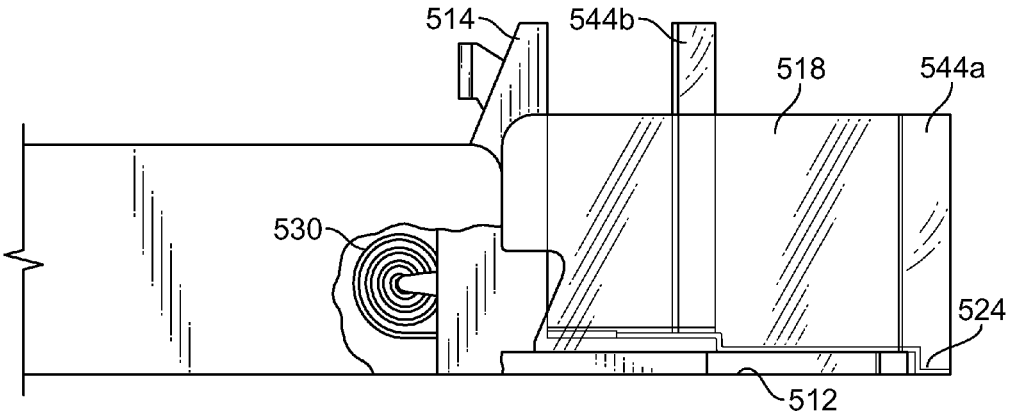
Figure 55:
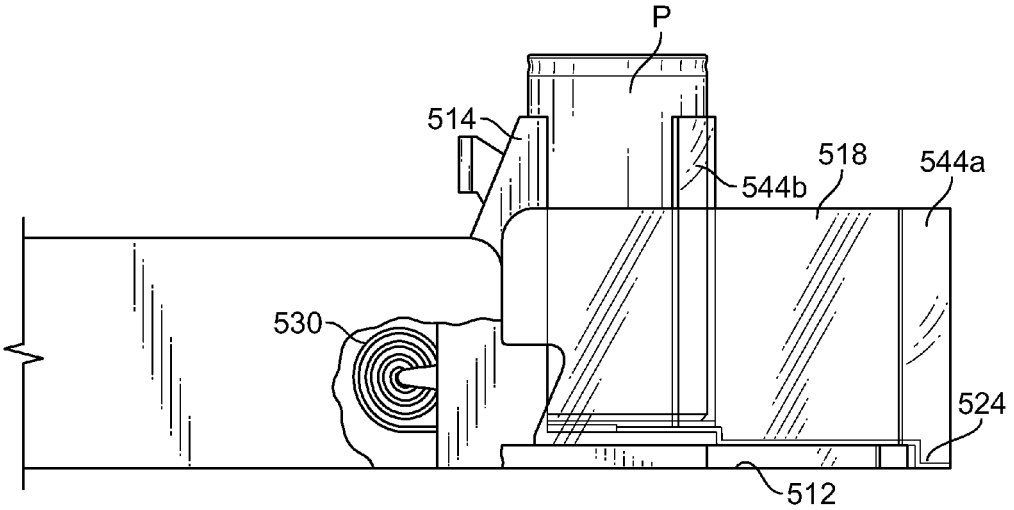

FIGS. 53-55 depicts another example merchandise display system, which is similar to the examples discussed herein, where similar reference numbers are used to identify similar components. However, in this example, an additional product-retaining member 544*b* may be provided to limit the movement of the last product P in a product row.

Similar to the embodiments above, the exemplary tray 512 may define a surface 516 and one or more dividing portions, panels, or dividers 518 to guide product therein. The surface 516 may be a solid surface or may be a surface defining a plurality of spaced-apart apertures separated by a plurality of support ribs as discussed herein. The surface 516 may be made of any suitable material that permits the slidable movement of product on the surface 516.

In this example, the surface 516 provides a single row for the positioning of a plurality of products. In an alternative aspect, the tray 512 may be a shelf or any other surface on which singular or multiple rows of products may be placed for merchandising. For example, multiple dividers may be provided to separate the tray into numerous rows for placement of products. Other surface or floor configurations are known and may be used with the principles of the disclosure.

In this example, the surface 516 may define a rounded end portion 524 that includes a slot 526 for receiving an end of the coiled spring 530. The end portion 524 may be rounded to match the shape of the product that is placed on the tray. For example, the depicted end portion 524 is rounded or defines a semi-circular shape to match the contour of a container, bottle, or can that may be placed in the tray and on the end portion 524. Other shapes of the end portion may be used with the disclosure depending on the product to be merchandised.

The slot 526 may be used to receive and mount an end 529 of a coiled spring 530 or similar biasing element. This configuration will center the coiled spring 530 relative to the tray 512 and will permit the spring to extend in a substantially parallel manner relative to the length of the tray. One skilled in the art will appreciate that the location and configuration of the slot 526 may vary depending on the desired placement of the spring.

The coiled spring 530 may define an end 529 that is configured to be placed in the slot 526. In one aspect, the end 529 of the coiled spring may be L-shaped and function as a hook such that the end 529 will extend downward and engage the slot to retain the end 529 of the coiled spring. This configuration permits an easy installation of the coiled spring onto the tray.

The dividers 518 may be used to guide products disposed therein. The dividers 518 extend substantially upwardly from the surface 516 and as illustrated in FIG. 53, may be positioned on opposing sides of the surface 516. However, the dividers 518 may be positioned at any desired position on the tray 512 or to the surface 516 to accommodate various product types. The dividers 518 may be formed as a unitary structure with the surface 516, or the dividers 518 may be detachable to provide added flexibility with the system. The dividers 518 may be attached to a front or back rail depending on the system. The dividers 518 may define numerous configurations and may extend upwardly any desired distance to provide the desired height of the dividers between the rows of product to be merchandised. This height may be adjustable by adding divider extenders or the like.

A first product-retaining member 544*a* may be located at the front of the tray 512, which can extend between the dividers 518. In this example, the product retaining member 544*a* serves as a front retaining wall or bar to hold the product in the tray 512 and to prevent the product from falling out of the tray 512. The product retaining member 544*a* is also configured to permit the easy removal of the forward-most product positioned in the tray 512. Additionally, the first product-retaining member 544*a* can be a curve-shaped solid retaining walls 548*a* or any another retaining member as discussed herein. The retaining wall 548*a* may be transparent or semi-transparent to permit visualization of the product on the shelf. In another aspect, the retaining wall 548*a* may also extend part-way between the dividers 518 so as to not connect the dividers 518. Also as shown in this example, the dividers 518 may have curved portions in the front so as to provide additional product retention in the forward direction of the tray.

Similar to the examples discussed above, the merchandizing system may include a trackless pusher mechanism 514, which can be any of the pusher mechanisms described herein and/or can include one or more of the features and functionality of any of the pusher mechanisms disclosed herein. In one example, the pusher mechanism 514 defines a pusher paddle or pusher surface 550, a pusher floor 552, and a second product-retaining member or product retainer 544*b*. The pusher paddle 550, pusher floor 552, and the second product retaining member 544*b* may be formed as a single, unitary structure or may be separate structures that are joined together using known techniques such as any known permanent or removable connection methods. In addition, the pusher paddle 550, pusher floor 552, and the second product retaining member 544*b* may be made of any known suitable plastic or metal material. The pusher paddle 550, pusher floor 552, and the second product retaining member 544*b* can be formed of a colored or clear plastic material. Also, the pusher paddle 550, pusher floor 552, and the second product retaining member 544*b* may be reinforced using any known reinforcing techniques.

In one aspect, the pusher paddle 550 forms a curved-shape pusher surface or face 554 that is configured to match the shape of the product to be merchandised, such as plastic bottles or cans containing a beverage. Also the second product retaining member 544*b* can be curved shaped and can be configured to match the shape of the product to be merchandised. The curve-shaped pusher surface 554 and the correspondingly curve-shaped second product-retaining member 544*b* permit the pusher to remain centrally aligned with the last product in the tray. Advertisement, product identification or other product information may be placed on the pusher surface 554 or on the second product retaining member 544*b*.

The pusher floor 552 may be positioned below the pusher paddle 550 and may extend forward of the pusher surface 554 of the pusher paddle. The pusher floor 552 may extend any predetermined distance and at any predetermined angle. For example, the pusher floor 552 may extend substantially perpendicular to the pusher surface 554. In an exemplary embodiment, the pusher floor 552 may extend a sufficient distance to permit one product, such as a single bottle or can, to be placed on the pusher floor. In another aspect, the pusher floor 552 may be configured to permit more than one product to be placed on the pusher floor. The pusher floor 552 may define any shape, including the depicted round shape and may define any product retaining features on the surface of the pusher floor, such as ribs, walls, or the like, to further hold the product on the pusher floor.

The pusher floor 552 may define an elongated channel, groove or recessed portion 559 that is sized, shaped and configured to seat the coiled spring 530. In the exemplary embodiment, the channel or groove 559 may extend part of the way across the floor 552 and in a substantially perpendicular manner relative to the pusher paddle 550. Such configuration permits the proper alignment and positioning of the pusher paddle 550 in the tray 512. The groove 559 may define a depth that matches or exceeds the thickness of the coiled spring 530. With this configuration, the coiled spring 530 will seat at or below the pusher floor surface such that product will not sit directly on the coiled spring, rather, such product will sit on the pusher floor surface. The pusher floor 552 may include apertures and openings through which debris or other items may pass. Alternatively, the floor may be a solid surface.

The second product-retaining member 544*b* can be formed as a curve-shaped solid retaining wall 548 can be formed integral with the pusher mechanism 514. As shown in FIG. 53, the second product-retaining member 544*b* may extend parallel to the pusher surface 554. The pusher surface 554 and the second product-retaining member 544*b* extend upwardly from the pusher floor. Also the second product-retaining member 544*b* can be spaced apart from the pusher surface 544 such that the pusher surface 544, the second product-retaining member 544*b*, and the pusher floor 552 define a space for receiving at least one product therein.

The second product-retaining member 544*b* is configured to hold at least one product against the pusher surface 554 so that the last product is held in between the pusher surface 554 and the second product-retaining member 554*b*. For example, the product can be a bottle, can or container and can be configured to fit between the pusher surface 544 and the product-retaining member 544*b*. In one example, the second product-retaining member 544*b* can be configured to hold a single container, bottle, or can against the pusher surface 554, or only one container, bottle, or can fits between the pusher surface 544 and the product retaining member 544*b*. For example, the tray 512 can hold a number of products therein, and the second product-retaining member 554*b* can be configured to hold the last product of the number of products against the pusher surface 554 or the second product-retainer member 554*b* is configured to hold the last one of the row products. In this way, the second product-retaining member 554*b* can prevent the last product on the tray or the shelf from being pushed by the pusher mechanism over the first retainer 554*a* and onto another shelf or floor. Additionally, the second product-retaining member 554*b* maintains the last product in an upright position on the tray or the shelf.

The second product-retaining member 544*b* can be configured to extend between the dividers 552 and can abut the dividers 552 or the dividers 552 and the second product retaining member 554*b* can define a gap on either side of the tray 512. In one example, the second product retaining member 554*b* can be formed transparent such that customers can see the product through the retainer 554*b*.

Additionally, the second product-retaining member 544*b* can be a curve-shaped solid retaining wall 548*b* or any another retaining member as discussed herein. The retaining wall 548*b* may be transparent or semi-transparent to permit visualization of the product on the shelf. In another aspect, the retaining wall 548*b* may also extend part-way between the dividers 518 so as to not connect the dividers 518.

As in the previous examples, in use, as the pusher mechanism 514 is urged rearward in the tray 512, the end 529 of the coiled spring 530 will be held in position as described above and the coiled end of the spring 530 will begin to uncoil behind the pusher paddle 550. If the pusher 514 is allowed to move forward in the tray 514, such as when product is removed from the front of the tray, the coiled end of the spring 530 will coil and force the pusher paddle 550 forward in the tray 512, thereby urging product toward the front of the tray.

As in certain examples discussed herein, the trackless pusher mechanism 514 is shown mounted to the tray 512. As illustrated, the pusher mechanism 514 fits in the tray 512 between the dividers 518. In use, the pusher mechanism 514 will slide along the surface 516 of the tray 512 without the use of tracks, rails, or guides.

As in certain examples discussed herein, the weight of the product on the pusher floor 552, and the positioning of the products across the spring 530 prevent the paddle 550 from tipping in the tray. In use, as one product is removed from the front of the tray near the product-retaining member 544, the pusher mechanism 514 (through the urging of the coiled spring 530) will push the remaining product forward in the tray 512 until the forward-most product contacts the product-retaining member 544. As additional products are removed, the pusher mechanism 514 will continue to push the remaining product toward the product-retaining member 544*a*.

Additionally, the last product in the product row can be held between the second product-retaining member 544*b* and the pusher surface 554 such that the last product in the product row is maintained in the pusher mechanism 514 and prevented from falling off of the tray 512. In certain instances, a larger product-retaining member 544*a* may be needed to prevent the last container or bottle from falling over the product-retaining member 544*a*. However, it may, in certain instances, be desirable to have a smaller product-retaining member 544*a*. However, when using smaller product-retaining members, the last container may fall over the product-retaining member 544*a*. Therefore, securing the last bottle with a second product-retaining member 544*b* may help to prevent last container from being pushed over the product-retaining member while being able to use a smaller product-retaining member 544*a*.

Variations and modifications of the foregoing are within the scope of the present invention. For example, one of skill in the art will understand that multiples of the described components may be used in stores and in various configurations. The present invention is therefore not to be limited to a single system, nor the upright pusher configuration, depicted in the Figures, as the system is simply illustrative of the features, teachings and principles of the disclosure. It should further be understood that the examples defined herein can be applied to all alternative combinations of two or more of the individual features mentioned or evident from the text and/or drawings. All of these different combinations constitute various alternative aspects of the present disclosure. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A pusher mechanism for a product management display system having a surface, the pusher mechanism comprising:

a pusher surface;

a product retainer extending parallel to the pusher surface;

a pusher floor extending forwardly from the pusher surface, the pusher floor configured to permit at least one product to sit upon the pusher floor, the pusher floor positionable on and movable across at least a portion of the surface of the display system; and a coiled spring;

wherein the pusher mechanism sits on top of the surface of the display system, is positionable on the surface of the display system, and is mounted to and held onto the display system by the coiled spring;

wherein the coiled spring includes a coiled end which is positioned behind and connected to the pusher surface;

wherein the pusher floor is substantially parallel to the surface of the display system and the pusher floor defines a channel for receiving the coiled spring;

wherein the pusher surface and the product retainer extend upwardly from the pusher floor, the product retainer being spaced apart from the pusher surface such that the pusher surface, the product retainer and the pusher floor define a space for receiving at least one product therein.

2. The pusher mechanism of claim 1 wherein the product is a bottle and the pusher surface and the product retainer are positioned to receive the bottle in a space defined by the pusher surface and the product retainer.

3. The pusher mechanism of claim 2 wherein only one bottle is permitted to fit between the pusher surface and the product retainer.

4. The pusher mechanism of claim 1, wherein the pusher surface is concave shaped.

5. The pusher mechanism of claim 1, wherein the coiled spring is extendable across at least a portion of the pusher floor and operatively attached behind the pusher surface.

6. The pusher mechanism of claim 1 wherein the pusher mechanism is mounted to the surface of the display system only by the coiled spring.

7. A product management display system comprising:

a tray defining a surface configured to hold a row of products;

a first product retainer mounted to the tray, the first product retainer configured to prevent product from falling off of the tray;

a pusher mechanism having a pusher surface, a second product retainer extending parallel to the pusher surface, the pusher mechanism configured to slide across at least a portion of the surface of the tray;

a coiled spring having a coiled end positioned behind the pusher surface and a front end wherein at least a portion of the coiled spring extends across at least a portion of the tray surface to a front portion of the tray;

at least one divider connected to the tray for maintaining the products in a row;

wherein the pusher mechanism is configured to sit on top of the surface of the tray;

wherein the pusher mechanism is mounted to the surface of the display system by the coiled spring;

wherein the pusher surface and the second product retainer extend upwardly from the pusher floor, the product retainer being spaced apart from the pusher surface for receiving at least one product therein.

8. The product management display system of claim 7 wherein the pusher surface and the second product retainer define a space that is configured to receive a last one of the row of products.

9. The product management display system of claim 8 wherein the space is configured to receive only one bottle.

10. The product management display system of claim 7 wherein the pusher mechanism is mounted to the surface of the display system only by the coiled spring.

11. The product management display system of claim 7 further comprising a first divider and a second divider connected to the tray and wherein the first product retainer and the second product retainer are configured to extend between the first divider and the second divider.

12. The product management display system of claim 7, wherein first product retainer and the second product retainer are transparent.

13. A product management display system comprising:

a tray defining a surface for holding a plurality of products;

a first product retainer mounted to the tray configured to prevent the plurality of products from falling off of the tray;

a pusher mechanism comprising a pusher surface, a second product retainer, a coiled spring, and a pusher floor extending forwardly from the pusher surface, the pusher floor defining a plurality of apertures, the pusher floor configured to receive a last one of the plurality of products upon the pusher floor between the pusher surface and the second product retainer, the pusher floor positionable on and movable across the surface of the tray;

wherein the pusher mechanism sits on top of the surface of the tray, and is mounted to and held onto the tray only by the coiled spring.

14. The product management display system of claim 13, wherein the pusher surface is concave shaped.

15. The product management display system of claim 13, wherein the pusher surface, the pusher floor, and the second product retainer are configured to hold a single bottle.

16. The product management display system of claim 13, further comprising a first divider and a second divider connected to the tray and wherein the first product retainer and the second product retainer are configured to extend between the first divider and the second divider.

17. The product management display system of claim 13, wherein first product retainer and the second product retainer are transparent.

* * * * *